US007965270B2

(12) United States Patent
Kawabe et al.

(10) Patent No.: US 7,965,270 B2
(45) Date of Patent: Jun. 21, 2011

(54) DISPLAY DEVICE INCLUDING A DATA GENERATING CIRCUIT TO DIVIDE IMAGE DATA FOR ONE FRAME INTO A PLURALITY OF PIECES OF SUB-FIELD IMAGE DATA

(75) Inventors: Kazuyoshi Kawabe, Fujisawa (JP); Junichi Hirakata, Chiba (JP)

(73) Assignee: Hitachi, Ltd., Tokyo (JP)

( * ) Notice: Subject to any disclaimer, the term of this patent is extended or adjusted under 35 U.S.C. 154(b) by 1093 days.

(21) Appl. No.: 11/638,378

(22) Filed: Dec. 14, 2006

(65) Prior Publication Data

US 2007/0085794 A1 Apr. 19, 2007

Related U.S. Application Data

(63) Continuation of application No. 10/200,536, filed on Jul. 23, 2002, now Pat. No. 7,161,576.

(30) Foreign Application Priority Data

Jul. 23, 2001 (JP) ..... 2001-220832
Aug. 28, 2001 (JP) ..... 2001-257128

(51) Int. Cl.
*G09G 3/36* (2006.01)

(52) U.S. Cl. ..... 345/89

(58) Field of Classification Search ..... 345/87–89, 345/99, 102, 690, 60–72
See application file for complete search history.

(56) References Cited

U.S. PATENT DOCUMENTS 5,168,362 A 12/1992 Yoshida
5,430,488 A 7/1995 Hedley
5,844,539 A 12/1998 Kitagawa
6,018,331 A 1/2000 Ogawa
6,124,842 A 9/2000 Mizutome et al.
6,236,388 B1 5/2001 Iida et al.
6,366,700 B1 4/2002 Tsuboi et al.
6,396,469 B1 5/2002 Miwa et al.
6,448,951 B1 9/2002 Sakaguchi et al.
6,466,186 B1 10/2002 Shimizu et al.
6,570,550 B1 * 5/2003 Handschy et al. ..... 345/89

(Continued)

FOREIGN PATENT DOCUMENTS

EP 1107223 6/2000

(Continued)

OTHER PUBLICATIONS

Office Action dated Jun. 9, 2009, in Japanese Patent Appln. 2001-257128 (in Japanese)(2 pages); English translation 4 pages).

(Continued)

*Primary Examiner* — Sumati Lefkowitz
*Assistant Examiner* — Rodney Amadiz
(74) *Attorney, Agent, or Firm* — Antonelli, Terry, Stout & Kraus, LLP.

(57) ABSTRACT

A display device includes a display panel having display elements, arranged in a matrix, a drain driver which supplies gradation voltages corresponding to image data to the display elements, a gate driver which scans lines of the display elements for supplying the gradation voltage, and a data generation circuit which divides image data for one frame into a plurality of pieces of sub-field image data in a time direction. The data generation circuit operates to convert one piece of sub-field image data into bright gradation data which has a higher brightness than the inputted image data which has been inputted, and to convert another piece of sub-field image data into dark gradation data which has a lower brightness than the inputted image data.

14 Claims, 50 Drawing Sheets

U.S. PATENT DOCUMENTS

| | | | |
|---|---|---|---|
| 6,600,469 | B1 | 7/2003 | Nukiyama et al. |
| 6,633,283 | B2 | 10/2003 | Fukuda et al. |
| 6,753,835 | B1 | 6/2004 | Sakai |
| 6,903,716 | B2 | 6/2005 | Kawabe et al. |
| 2002/0154088 | A1 | 10/2002 | Nishimura |
| 2002/0190944 | A1 | 12/2002 | Morita |
| 2006/0139289 | A1 | 6/2006 | Yoshida et al. |

FOREIGN PATENT DOCUMENTS

| | | |
|---|---|---|
| JP | 62-138893 | 6/1987 |
| JP | 04-044478 | 2/1992 |
| JP | 07-175452 | 7/1995 |
| JP | 08-227285 | 9/1996 |
| JP | 08-234702 | 9/1996 |
| JP | 08-314421 | 11/1996 |
| JP | 11-109921 | 4/1999 |
| JP | 2001-042282 | 2/2001 |
| JP | 2001-184034 | 7/2001 |

OTHER PUBLICATIONS

Korean Office Action dated Dec. 8, 2004 and translation of same.

* cited by examiner

FIG.9A
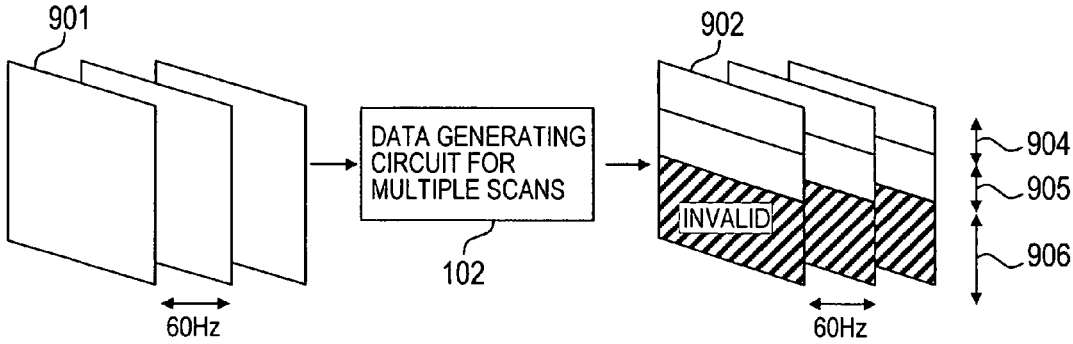
FIG.9B
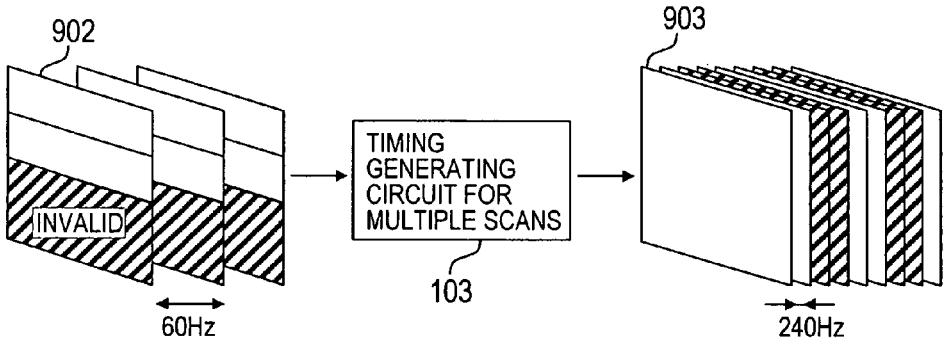
FIG.10
| NAME | HORIZONTAL | VERTICAL | ASPECT RATIO |
|---|---|---|---|
| VGA | 640 | 480 | 4:3 |
| XGA | 1024 | 768 | 4:3 |
| SXGA | 1280 | 1024 | 5:4 |
| UXGA | 1600 | 1200 | 4:3 |
| WVGA | 800 | 480 | 5:3 |
| WXGA | 1280 | 768 | 5:3 |
| WUXGA | 1920 | 1200 | 8:5 |

FIG.11
| NUMBER OF VALID SCANNING LINES | ASPECT RATIO |
|---|---|
| 480i | 16:9 or 4:3 |
| 480p | 16:9 |
| 1080i | 16:9 |
| 720p | 16:9 |
| 1080p | 16:9 |
FIG.12A
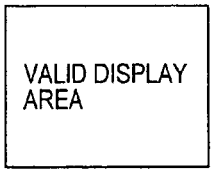
FIG.12B
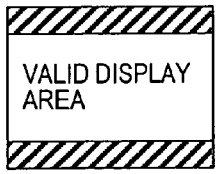
FIG.12C
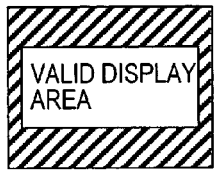
FIG.12D
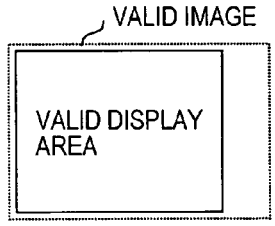
FIG.13A
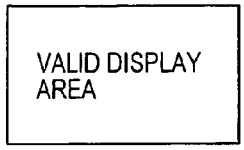
FIG.13B
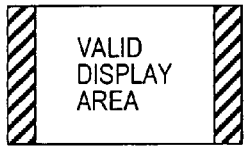
FIG.13C
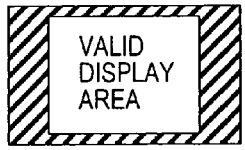
FIG.13D
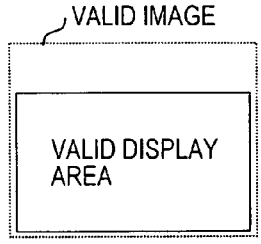

FIG.14

| | (A) NUMBER OF DISPLAY ARRAY VERTICAL SCANNING LINES | | | | (B) NUMBER OF VIDEO SIGNAL VERTICAL SCANNING LINES | | | | |
|---|---|---|---|---|---|---|---|---|---|
| | 4:3 | | 16:9 | | 4:3 | 16:9 | | | |
| DISPLAY ARRAY | VALID | BLANK | VALID | BLANK | 480i | 480p | 1080i | 720p | 1080p |
| VGA | 480 | 0 | 360 | 120 | +240 | -120 | -180 | -360 | -720 |
| XGA | 768 | 0 | 576 | 192 | +528 | +96 | +36 | -144 | -504 |
| SXGA | 960 | 84 | 720 | 304 | +720 | +240 | +180 | 0 | -360 |
| UXGA | 1200 | 0 | 900 | 300 | +960 | +420 | +360 | +180 | -180 |
| WVGA | 480 | 0 | 450 | 30 | +240 | -30 | -90 | -270 | -630 |
| WXGA | 768 | 0 | 720 | 48 | +528 | +240 | +180 | 0 | -360 |
| WUXGA | 1200 | 0 | 1080 | 120 | +960 | +600 | +540 | +360 | 0 |

− NUMBER OS LOST SCANNING LINES
+ NUMBER OF SUPPLEMENTED SCANNING LINES

| CONTROL PARAMETERS | VALUES |
|---|---|
| NUMBER OF SYNCHRONOUS WRITING LINES | 1,2,3,4... |
| NUMBER OF INTERLACE LINES | 1,2,3,4... |
| IMPULSED BLANKING | 1/2,1/3,2/3,1/4... |
| COEFFICIENT OF FAST RESPONSE LIQUID CRYSTAL FILTER | 1.0,1.5,2.0... |
| GRAY-SCALE REFERENCE VOLTAGE GROUP | Vh[9:0],Vi[9:0] |
| ASPECT RATIO/WIDE RATIO | Enable, Disable |
| FOCUS | Enable, Disable |
| FOCUS POSITION | (0,0)-(640,480) |

FIG.19A
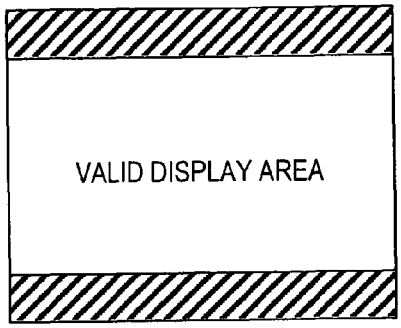
FIG.19B
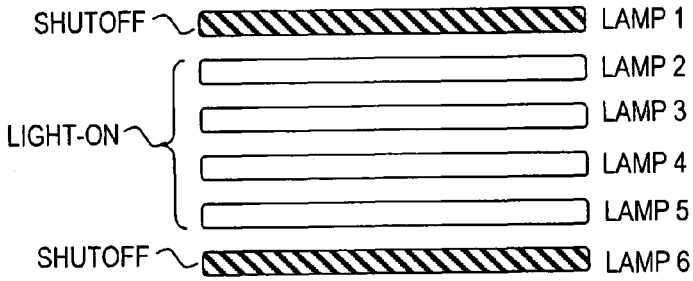
FIG.20
| CONTROL PARAMETERS | VALUES |
|---|---|
| TUBE CURRENT | x1,x2,x3,x4... |
| LIGHTING DUTY | 1/2,1/3,2/3... |
| LIGHTING PHASE | $\pi/2$, $\pi/3$... |
| SHUTOFF LAMP | No1,2,3,4... |

| CONTROL PARAMETERS | VALUES |
|---|---|
| TRANSFER CLOCK | Low,High... |
| FASTER FILTER ENABLE | On,Off... |
| DETERMINING THRESHOLD | LOW, MIDDLE, HIGH |
| WRITING POLARITY | EVERY LINE, EVERY FRAME |

| CONTROL PARAMETERS | VALUES |
|---|---|
| UPPER INVALID AREA | 0～96... |
| LOWER INVALID AREA | 672～768... |

| CONTROL PARAMETERS | VALUES |
|---|---|
| LEFT INVALID AREA | 0～128... |
| RIGHT INVALID AREA | 1156～1280... |
| DRIVER SCALING | Enable,Disable... |
| DRIVER FRAME BUFFER | Enable,Disable... |
| DRIVER TRANSFER BUS MODE | FULL, HALF |

FIG.61

| | |
|---|---|
| ANALOG BROADCASTING TELEVISION | NTSC |
| DIGITAL BROADCASTING TELEVISION | 480i, 480p, 720p, 1080i, |
| VIDEO PLAYER | NTSC |
| DVD PLAYER | NTSC |
| PERSONAL COMPUTER | VESA |
| GAME MACHINE | NTSC |
| CAR NAVIGATION SYSTEM | |

⋮

FIG.62

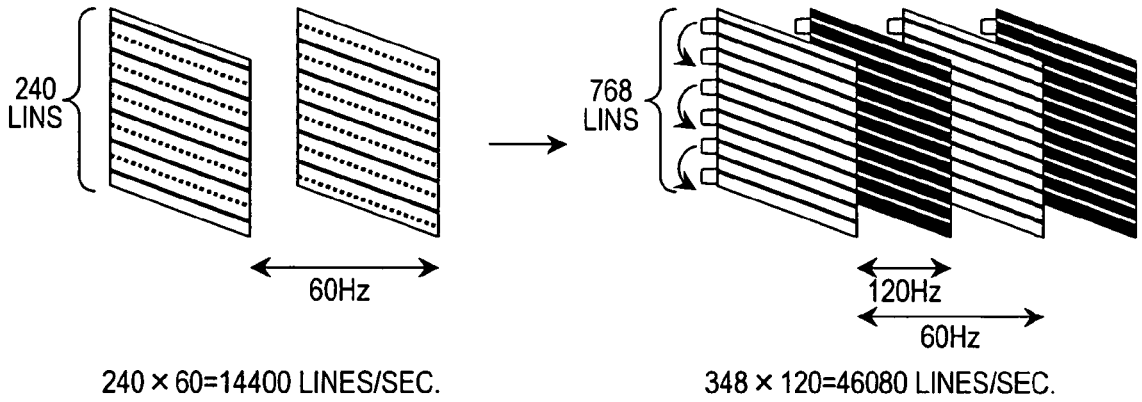

FIG.63

| HEADER SETTINGS | SETTING VALUES |
|---|---|
| NUMBER OS SCANS | 1,2,3,4,...,n etc |
| SYNCHRONOUS WRITING LINES | 1,2,3,4,...,n etc |
| INTERLACE LINES | 1,2,3,4,...,n etc |
| NUMBER OF TIMES OF BLACK DISPLAY | 1,2,3,4,...,n etc |
| BLACK DISPLAY PATTERN | FULL-SCREEN, VERTICAL, HORIZONTAL, CHECKER, etc. |

⋮

FIG.64

| HEADER SETTINGS | SETTING VALUES |
|---|---|
| NUMBER OS SCANS | 1,2,3,4,...,n etc |
| SYNCHRONOUS WRITING LINES | 1,2,3,4,...,n etc |
| INTERLACE LINES | 1,2,3,4,...,n etc |
| NUMBER OF TIMES OF BLACK DISPLAY | 1,2,3,4,...,n etc |
| BLACK DISPLAY PATTERN | FULL-SCREEN, VERTICAL, HORIZONTAL, CHECKER, etc. |
| POLARITY INVERSION PERIOD | 1, 2, 3, 4 LINES, etc. |
| DRIVING METHOD | DOT INVERSION, COMMON INVERSION, etc. |
| IMAGE PROCESSING FILTER | EDGE EMPHASIS, ANTI-ALIASING, etc. |
| FAST RESPONSE | On, Off etc |
| GAMMA | HIGH, LOW, etc. |

⋮

240 × 60=14400 LINES/SEC.

348 × 120=46080 LINES/SEC.

DISPLAY DEVICE INCLUDING A DATA GENERATING CIRCUIT TO DIVIDE IMAGE DATA FOR ONE FRAME INTO A PLURALITY OF PIECES OF SUB-FIELD IMAGE DATA

CROSS REFERENCE TO RELATED APPLICATION

This is a continuation of U.S. application Ser. No. 10/200,536, filed Jul. 23, 2002 now U.S. Pat. No. 7,161,576. This application relates to and claims priority from Japanese Patent Application No. 2001-220832, filed on Jul. 23, 2001 and No. 2001-257128, filed on Aug. 28, 2001. The entirety of the contents and subject matter of all of the above is incorporated herein by reference.

BACKGROUND OF THE INVENTION

1. Field of the Invention

The present invention relates to a matrix-type display device having display elements such as amorphous silicon liquid crystal, polysilicon liquid crystal, light emitting diode or organic EL, and particularly to a display device for performing blanking processing.

2. Description of the Related Art

Japanese Unexamined Patent Application Publication No. 11-109921 is a technology of the related art. According to the technology of the related art, one liquid crystal display panel is divided into tow upper and lower pixel arrays. Data line drive circuits are provided to the divided pixel arrays, respectively. One gate line for each of the upper and lower pixel arrays, that is, a total of two gate lines for the upper and the lower gate lines are selected. Two of the upper and lower divided display areas are dual-scanned by the respective drive circuits. During the dual scanning, a blanking image (black image) is inserted by changing the upper and lower phases within one frame period. In other words, the one frame period includes a video display period and the blanking period, which can reduce an image-holding period. Therefore, a liquid crystal display can obtain a moving image display performance similar to that of a cathode ray tube.

However, according to the technology of the related art, the liquid crystal display panel is divided into the upper and the lower portions, each of which has a data line drive circuit. Therefore, the costs for parts and manufacturing are increased. Furthermore, the construction becomes larger and more complicated. As a result, the costs on the larger screen and higher definition are more increased than those for the general panel. The liquid crystal display panel according to the technology of the related art has a dramatically improved moving picture display characteristic. However, the still picture display characteristic is the same for a still picture typified by a desktop movie by a personal computer, for example. In other words, the liquid crystal display panel according to the technology of the related art is overdesigned for a liquid crystal panel, which has been widely spread for the application for a monitor for a notebook personal computer, for example. Thus, the liquid crystal display panel is limited as a high-end type for the multimedia applications. Thus, the efficiency of the mass production is reduced when a variety of the products are produced in large quantities.

SUMMARY OF THE INVENTION

Accordingly, it is an object of the present invention to provide a display device, which can suppress the larger and more complicated construction and which can suppress the deterioration in image quality due to blurred moving images.

In order to achieve the object, according to an aspect of the present invention, blanking data is inserted to video data for one frame period and line scanning of a display panel is controlled such that the video data and the blanking data are displayed by an arbitrary display element in one frame period. Preferably, adjacent n lines are selected as a bundle at the same time, and gradation voltage in accordance with the data is applied thereto. Next, those n lines are skipped and the next adjacent n lines are selected at the same time, and gradation voltage in accordance with the data is applied thereto. Here, n is 2, 3, 4, 5, . . . (a natural number larger than 1). Here, according to the present invention, a number of adjacent multiple lines and a number of interlaced lines do not have to be the same. Also, adjacent n lines can be selected at the same time. However, it is also possible to change the select timing (in other words, the start timing for scanning) such that the scanning period of each line constituting n lines partially overlaps each other.

According to the present invention, there is an advantage that the deterioration in image quality due to blurred moving image can be suppressed by inserting blanking data to image data. Furthermore, according to the present invention, the increase in the number of drain drivers can be suppressed by selecting a line in which image data and blanking data are displayed in one frame period, which produces an advantage that the larger and more complicated construction can be suppressed.

BRIEF DESCRIPTION OF THE DRAWINGS

FIG. 9A is a conceptual diagram showing a video data generating process in a data generating circuit for multiple scans by four-line synchronous writing and four-line interlace scanning according to the first embodiment of the present invention;

FIG. 9B is a conceptual diagram showing a video data generating process in a data generating circuit for multiple scans by four-line synchronous writing and four-line interlace scanning according to the first embodiment of the present invention;

FIG. 10 is a diagram showing relationships between resolutions and aspect ratios of a display element array;

FIG. 11 is a relational diagram of video formats in digital broadcasting;

FIG. 12A is a schematic diagram for a case when a wide image is displayed in a non-wide type of display element array, wherein an aspect ratio of wide image is modified and displayed therein;

FIG. 12B is a schematic diagram when a wide image is displayed in a non-wide type of display element array, wherein the horizontal resolution of display element array is fully used to keep the aspect ratio of the wide image;

FIG. 12C is a schematic diagram when a wide image is displayed in a non-wide type of display element array, wherein the resolution of display element array and the resolution of a wide image are the same;

FIG. 12D is a schematic diagram when a wide image is displayed in a non-wide type of display element array, wherein the vertical resolution of display element array is fully used to keep the aspect ratio of the wide image;

FIG. 13A is a schematic diagram for a case when a wide image is displayed in a wide type of display element array, or a case when a non-wide image is stretched in the horizontal direction and displayed;

FIG. 13B is a schematic diagram for a case when a non-wide image is displayed in a wide type of display element array, wherein the vertical resolution of the display element array is fully used;

FIG. 13C is a schematic diagram for a case when a non-wide image is displayed in a wide type of display element array, wherein the resolution of the display element array and the resolution of non-wide image is the same;

FIG. 13D is a schematic diagram for a case when a non-wide image is displayed in a wide type of display element array, wherein the horizontal resolution of the display element array is fully used;

FIG. 14 is a relational diagram for combinations between display element arrays and digital broadcasting video formats;

FIG. 19A is a schematic diagram showing an invalid display area according to the second embodiment of the present invention;

FIG. 19B is a schematic diagram showing an arrangement of a lighting lamp according to the second embodiment of the present invention;

FIG. 20 is an explanatory diagram showing specific examples of control parameter and the values according to the second embodiment of the present invention;

FIG. 61 is an explanatory diagram showing different kinds of video formats according to the nineteenth example of the present invention;

FIG. 62 is an explanatory diagram showing changes in screen scanning when the resolution is changed from NTSC to XGA and black displays in the residual band are inserted;

FIG. 63 is an explanatory diagram showing header information according to the nineteenth first example and so on of the present invention;

FIG. 64 is an explanatory diagram showing header information according to the twenty third example and so on of the present invention;

DESCRIPTION OF THE PREFERRED EMBODIMENTS

First Embodiment

A first embodiment of the present invention will be described below.

Figure 1:
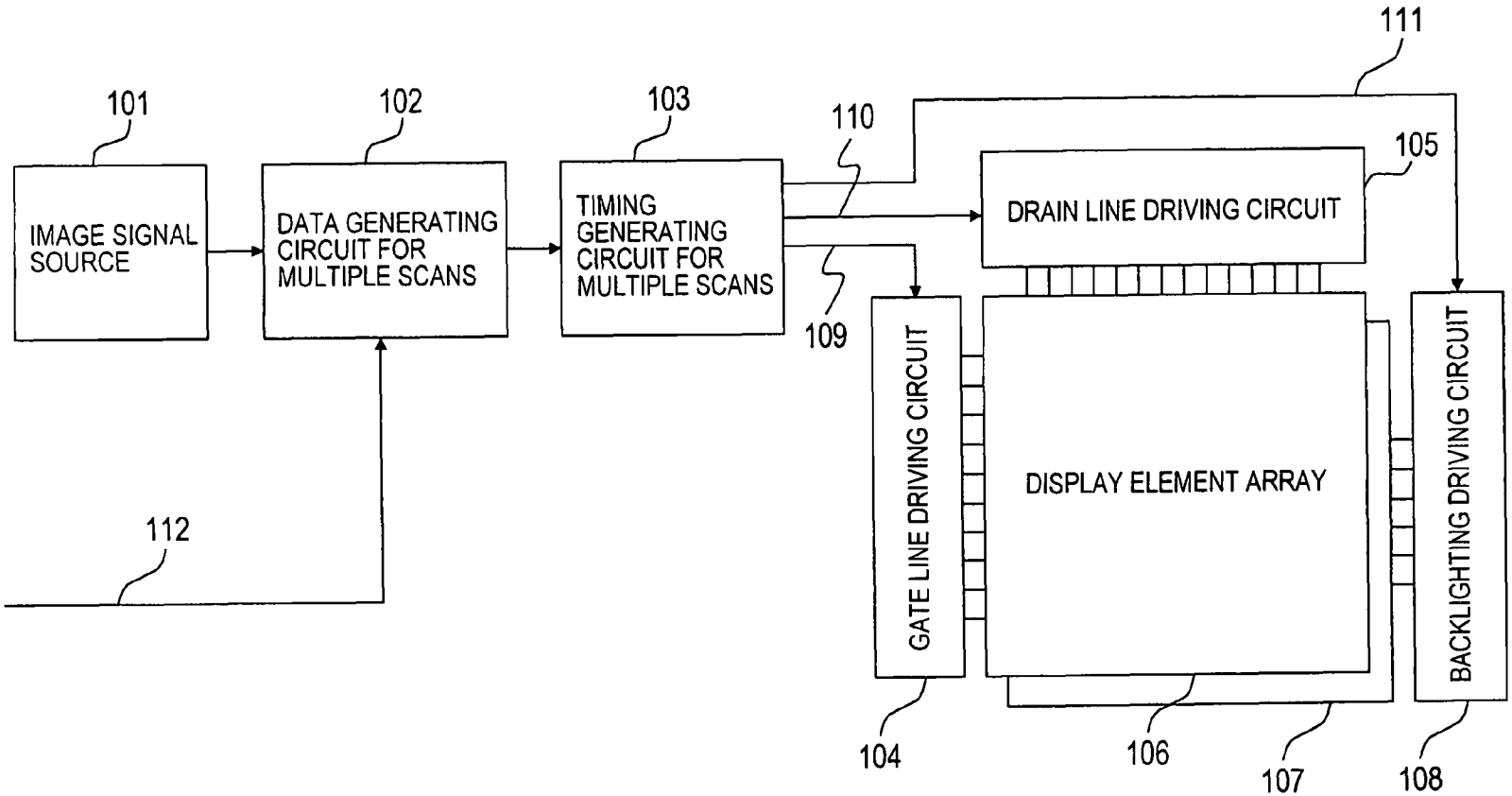
FIG. 1 is a diagram showing the configuration of a display device according to a first embodiment of the present invention.

FIG. 1 is a system block diagram of a liquid crystal display device, which will be described according to this embodiment. FIG. 1 includes an image signal source 101, data generating circuit 102 for multiple scans, and a timing generating circuit 103 for multiple scans. The image signal source 101 generates and reads image signals for personal computers and televisions. The data generating circuit 102 for multiple scans has an interface, which can receive video in different format from the image signal source 101, and generates data to be screen-scanned multiple times in one frame based on the video signals. The timing generating circuit 103 for multiple scans generates timing for scanning screens multiple times in one frame. Furthermore, FIG. 1 includes a liquid crystal display element array (display panel) 106, a gate line drive circuit 104, and a drain line drive circuit 105. In the liquid crystal display element array, gate lines and drain lines are arranged in a matrix form and a thin film transistor (TFT) is located at the inter section. The gate line drive circuit 104 drives the gate lines. The drain line drive circuit drives the drain lines. The gate line drive circuit 104 is controlled by the timing generating circuit 103 for multiple scans via a gate line control bus 109. The drain line drive circuit 105 is controlled by the timing generating circuit 103 for multiple scans via a drain line control bus 110. Furthermore, FIG. 1 includes a backlighting 107, a backlighting drive circuit 108, and a control bus 112. The backlighting 107 is located on the back surface of the liquid crystal elements. The backlighting drive circuit 108 drives the backlighting 107, and the lighting is controlled by the backlighting control bus 111. The control bus 112 is passed by control switching signals and so on, each of which indicates either moving picture mode or still picture mode.

Figure 2:
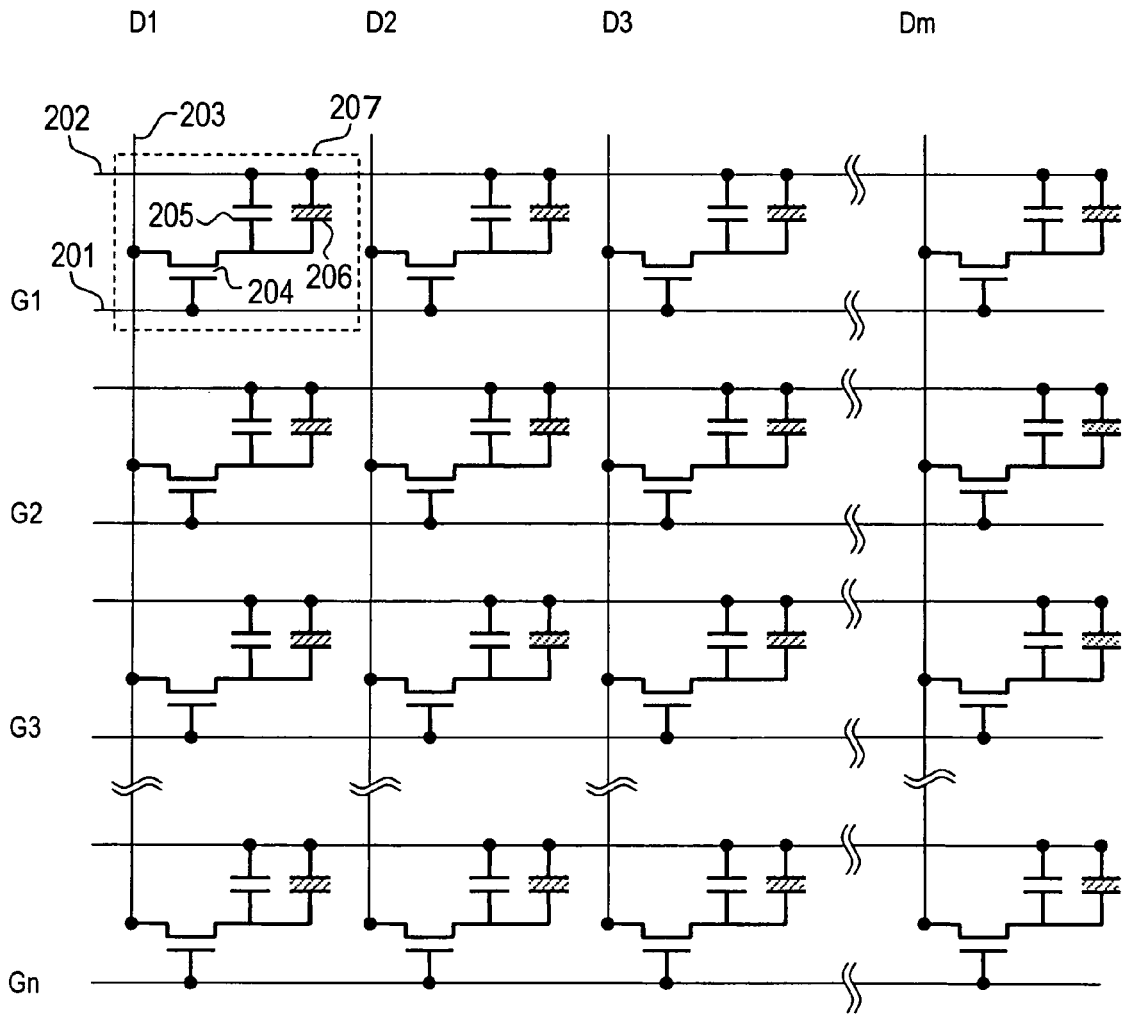
FIG. 2 is a diagram showing the configuration of a display element array according to the first embodiment of the present invention.

The display element array 106 has a m×n matrix structure including gate lines G1 to Gm and drain lines D1 to Dn, for example, as shown in FIG. 2. FIG. 2 includes a pixel 207 included in the display elements and a TFT 204 provided at the intersection of a gate line 201 and a drain line 203. A latching capacity 205 has a Cstg type of structure, which is formed between the source of the TFT 204 and a common signal line 202. FIG. 2 further includes a capacity 206 including liquid crystal and electrodes sandwiching and holding the liquid crystal. If the display element is of the self-light-emitting type such as an organic EL, it is equivalent to one in which the capacity portion is replaced by a diode element. The form having a switching mode such as IPS, TN, MVA, and OCB is known as the liquid crystal display element. The present invention includes any of them. According to the present invention, the TFT for driving the capacities 205 and 206 may be those using a-Si (amorphous silicon) or may be one using p-Si (polysilicon).

Figure 3:
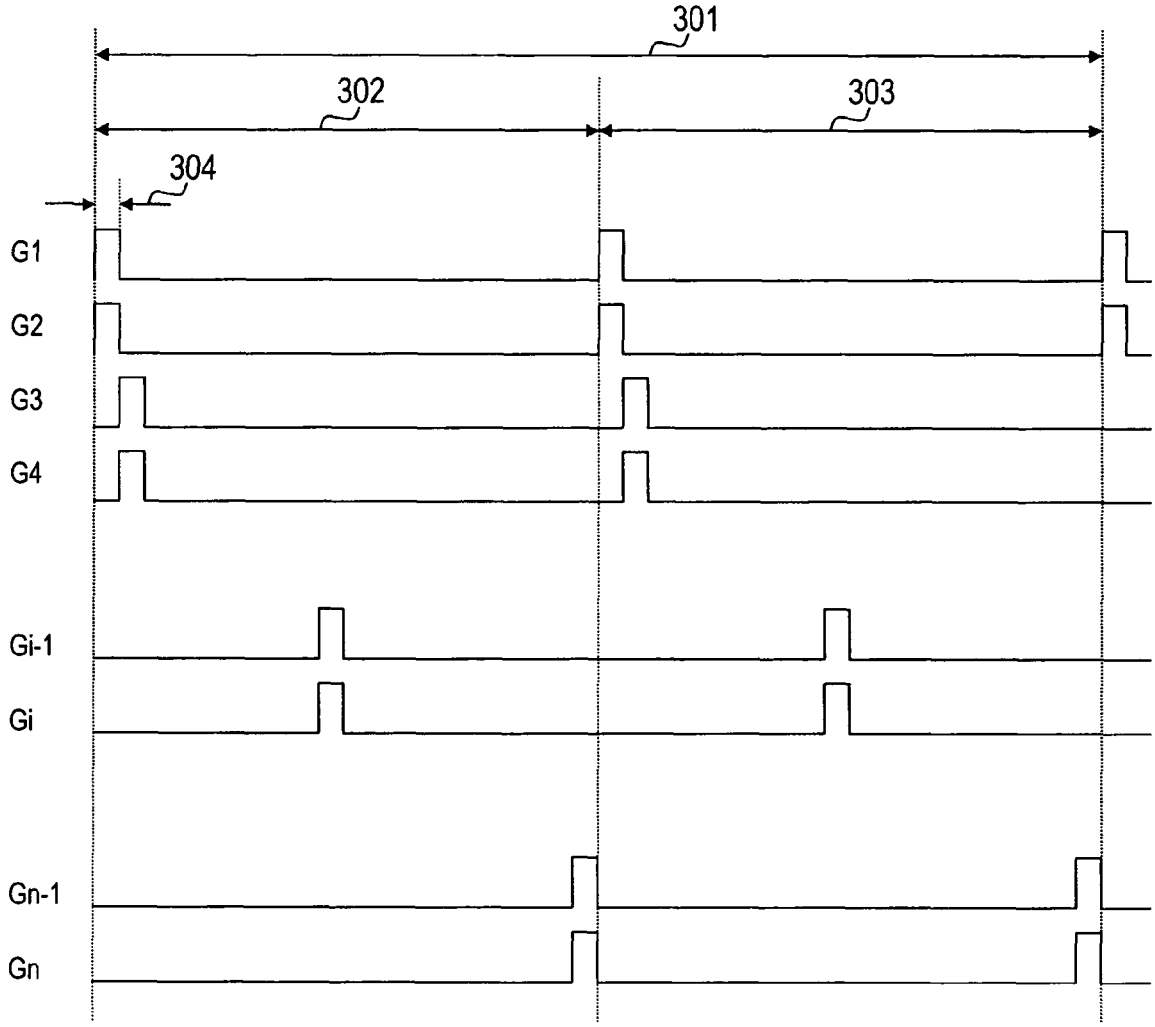
FIG. 3 is a waveform diagram of a gate line drive signal for two-line synchronous writing and two-line interlace scanning according to the first embodiment of the present invention.

FIG. 3 is an output pulse-timing chart of the gate line drive circuit 104 for driving gate lines of the liquid crystal display array 106. The gate line drive pulse is generated by a gate drive circuit control signal, which is supplied by the timing generating circuit 103 for multiple scans in FIG. 1. FIG. 3 includes a frame cycle 301, a image scanning period 302, a blanking scanning period 303, and a gate select period 304. The frame cycle 301 is generally 60 Hz and 16.7 ms. The video scanning period 302 is ½ of the frame cycle and about 8.4 ms. The blanking scanning period is also ½ of the frame cycle and amount 8.4 ms. The gate select period 304 matches with a period for writing images to multiple lines, respectively, which are selected synchronously. In this case, multiple lines are selected synchronously, and the same data are written therein. Therefore, the gate select period 304 is the same as the conventional one-line writing period. Two lines of gate lines in the display array 106 are selected at the same time (in parallel and by overlapping). Images are written in the selected two lines, and the two lines are skipped for scanning. In other words, during the image scanning period 302, the gate lines G1 and G2 are selected at the same time, and the same image is written in the two lines. Then, the gate lines G1 and G2 are skipped. Then, the gate lines G3 and G4 are selected and the next line image is written therein. Therefore, an image can be written completely in all of the scanned lines in half of one frame period. Thus, the half of the frame period remains and is used for writing scanning. During the remaining half of the scanning period, the two-line synchronous writing and two-line interlace scanning is performed such that blanking data (black data is desired) can be written therein. Thus, the image display and the blanking display are performed in one frame period. As a result, the impulse-type of display character such as that of a CRT can be achieved in a pseudo manner by using the hold-type of liquid crystal display array. Thus, the performance for displaying moving pictures can be improved.

In order to write blanking data, a method can be executed which is different from that for writing images. For example, the two-line synchronous writing and two-line interlace scanning may be used for image writing. On the other hand, the scanning by the four-line synchronous writing and four line interlacing may be used for blanking writing. By executing the scanning method, the entire period for scanning the images and the blanking can be reduced more than the above-described case. However, each of the written lines may differ in period for image writing. For example, the period for image writing is longer for the first line and shorter for the last line, resulting in degraded display. Thus, in this embodiment, the same scanning method is adopted for the blanking writing and the image writing.

Figure 4:
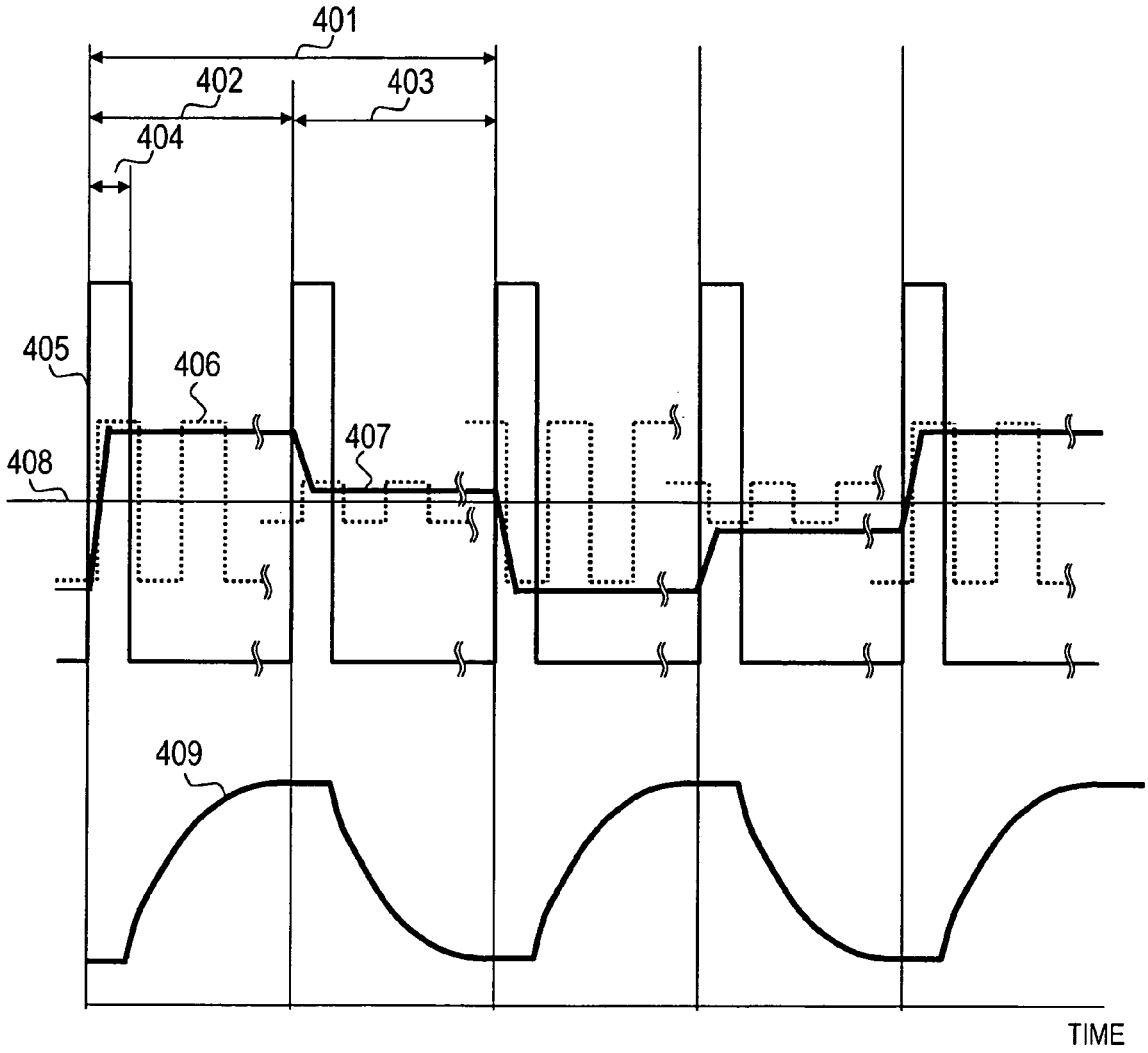
FIG. 4 is an optical response waveform diagram of each signal line drive waveform and a display element for two-line synchronous writing and two-line interlace scanning according to the first embodiment of the present invention.

FIG. 4 shows a waveform of each drive signal and an optical response waveform of the liquid crystal by focusing on one pixel of the display array. FIG. 4 includes one frame period 401, an image writing period 402 and a blanking writing period 403. The image writing period 402 is half of the frame cycle 401. The blanking writing period 403 is also half of the frame cycle 401. FIG. 4 further includes a gate selecting period 404 for one line, a waveform 405 for a gate line drive signal, and a wave form 406 for a drain line drive signal. In the waveform 405 for the gate line drive signal, a gate line is selected twice, one for image writing and the other for blanking writing, within the one frame period 401 by performing the scanning by synchronous two-line selecting and two-line interlacing at the timing shown in FIG. 3. In the waveform 406 for the drain line drive signal, the dot inversion driving in normal black mode is assumed. However, since two lines are written synchronously, two-line dot inversion is performed. As shown in FIG. 4, the alteration of the polarity for writing is not always necessary for every time of writing each line. The alteration of the polarity may be performed for every n writings or for each of the frame period 401. Alternatively, the polarity may be altered between the image writing period 402 and the blanking writing period 403.

According to this embodiment, the same data is written in multiple lines at the same time. Therefore, the same period as conventional technologies can be obtained for the writing period. However, the writing current is needed more than conventional technologies for writing multiple lines at the same time. In view of the supply ability of writing current of the drain line drive circuit 105, the polarity is preferably inverted for each of the frame period 401 so as to suppress the writing current, which can improve the writing characteristic. Furthermore, the waveform 406 for the drain line drive signal is altered so as to write the video signal and blanking data in the same polarity within one frame period. Thus, the persistence of image in direct current due to writing in the same polarity within a blanking period for always writing the same data can be suppressed. FIG. 4 further includes a source voltage waveform 407, a common level 408, an optical response waveform 409 of the liquid crystal. Here, the differential voltage between the source voltage and the common voltage is applied to the liquid crystal. After an image is written in the first writing period 402 of the one frame cycle 401, the response of the image display starts. After that, the waveform 409 shifts to the black level through the blanking data writing. In this way, by repeating the image response and the black response for every frame and by using the liquid crystal display element array having the hold-type of display characteristic, the impulse type of optical characteristic can be obtained. Thus, the performance of the moving picture display can be improved.

In FIG. 4, during the image writing period 402 of the first frame cycle 401, the drain line drive circuit 105 applies a gradation voltage gradation voltage having the positive polarity in accordance with the image data to display elements on a selected line. Then, during the blanking writing period 403, the gradation voltage in accordance with blanking data, that is, gradation voltage having the more negative polarity of the common level 408 than that for image data is applied to the display element on the selected line. During the image writing period 402 of the second frame cycle 401, the gradation voltage having the negative polarity in accordance with image data is applied to the display elements on the elected line. Then, during the blanking writing period 403, a gradation voltage having the negative polarity in accordance with blanking data, that is, gradation voltage having the more negative polarity of the common level 408 than that for image data is applied to the display elements on the selected line. When the gradation of the blanking data is black, the absolute value of the gradation voltage with respect to the common level 408 is minimum. The gradation voltage of the blanking data becomes closer to the common level 408 than the gradation voltage of the image. However, when the image is black, the gradation voltage of the blanking data and the gradation voltage of the image is equivalent.

The faster optical response of the liquid crystal is, the steeper the impulse is. Then, the convergence to the blanking becomes earlier so that the image becomes clearer. However, as the liquid crystal becomes faster, the latching characteristic of the liquid crystal tends to become worse. Therefore, when the display device is used together with the hold light-emitting type of monitor for a personal computer, the contrast and/or the screen uniformity will be deteriorated. In this embodiment, which considers the uses with a monitor, liquid crystal balancing the response and the latching characteristic may be used. However, when this embodiment is applied specifically for a television, more rapid liquid crystal is desired.

In this embodiment, the case is assumed where the display array in the normally black mode is driven by the bit inversion driving. However, the same effect can be obtained even when the display array in the normally white mode is driven by the common inversion driving. In order to improve the image quality more, a gradation control function as described below is added in this embodiment.

Since the responsive characteristic of the liquid crystal depends on a gradation, the hold-type scanning and the impulse type scanning like this embodiment differ in gradation data and the gamma characteristic, which is a brightness characteristic. In order to correct the gamma characteristic, this embodiment includes a means for applying another gradation voltage for the impulse type scanning. This unit can be achieved by using a drain driver IC, whereby the divided resistor of the gradation voltage within the drain line drive circuit 105 can be switched by using a switch to change the gamma curve. Alternatively, the unit can be achieved by holding, within the timing generating circuit 103 for multiple scans, two channels of gradation voltages V [9:0] (10 level for both of the positive and the negative voltages, for example) to be supplied to the drain line drive circuit 105 and switching them in accordance with either hold display or impulse display.

Figure 5:
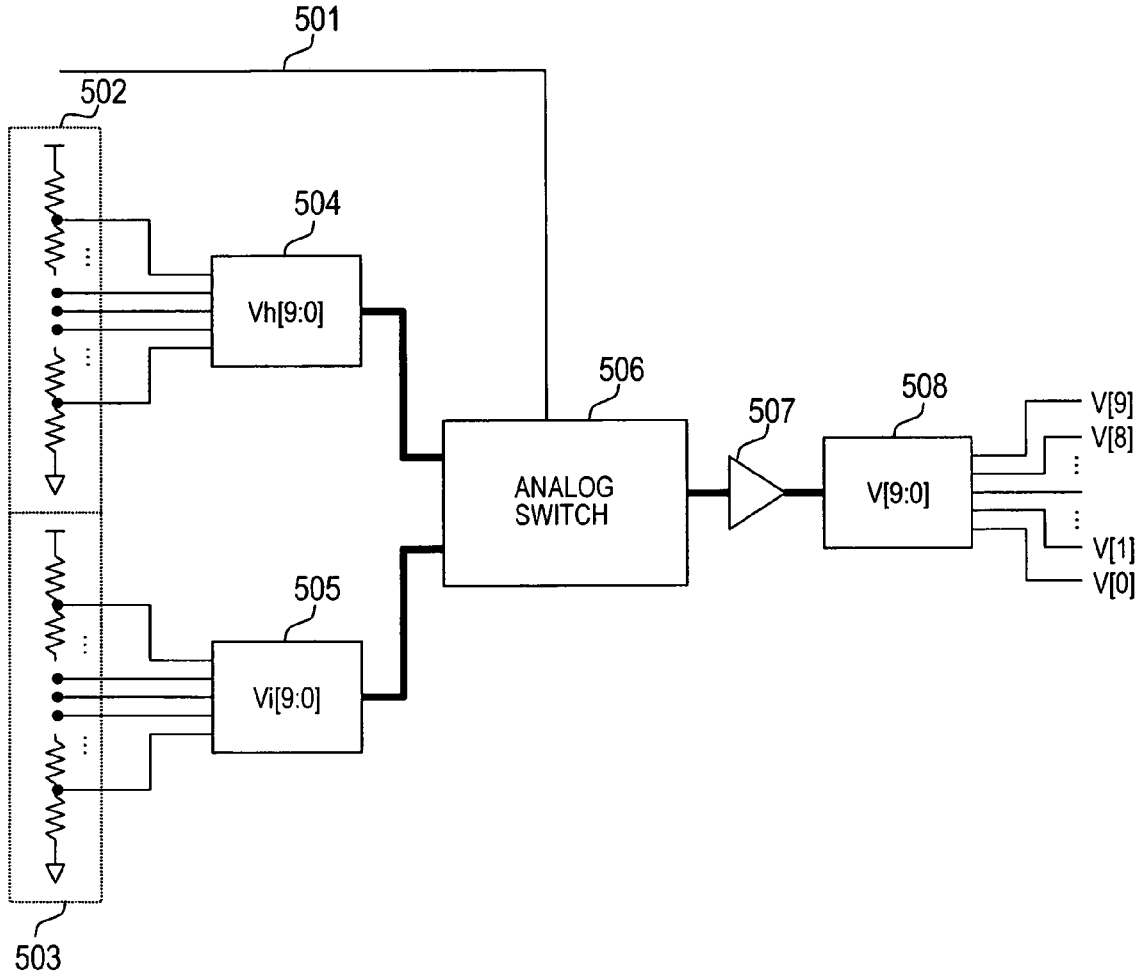
FIG. 5 is a diagram showing the configuration of a gradation voltage generating circuit according to the first embodiment of the present invention.

According to this embodiment, the latter is adopted because it can be arranged within the timing generating circuit 103 for multiple scans. FIG. 5 shows the configuration for achieving the latter. FIG. 5 includes a select signal line 501 for supplying signals indicating either the hold type scanning or the impulse type scanning, a ladder resistor 502 for the hold type scanning, a ladder resistor 503 for the impulse type scanning, gradation voltage busses 504 and 505 for generating different gamma curves, respectively, an analog switch 506, a buffer 507 and a selected gradation voltage group bus 508. The gradation voltage busses 504 transmit the hold type and the impulse type of gradation voltages, respectively, generated by the ladder resistor 502 and 503, respectively. In this case, it is assumed that the buses include 10 lines for the drain drive circuit for 64 gradation levels. Therefore, when the drain drive circuit for 256 gradation levels is used, the bus width is further increased. The analog switch 506 is used for selecting the gradation voltage buses 504 and 505 via the select signal line 501. The buffer 507 supplies gradation voltage to the drain line drive circuit 104 via the selected gradation voltage group bus 508. In this way, by differing the gradation voltage depending on either hold-type scanning or impulse-type scanning, the gamma characteristics can be set for both, respectively. Thus, the optical characteristic can be corrected by using the impulse type scanning. Furthermore, a steep gamma characteristic like that of the CRT can be generated. Then, the image quality can be improved.

The select signal line 501 is a part of the drain line control bus 110. Power is supplied from a display panel power source, which is not shown in the figure, to each of the ladder resistor 502 and 503.

Figure 6:
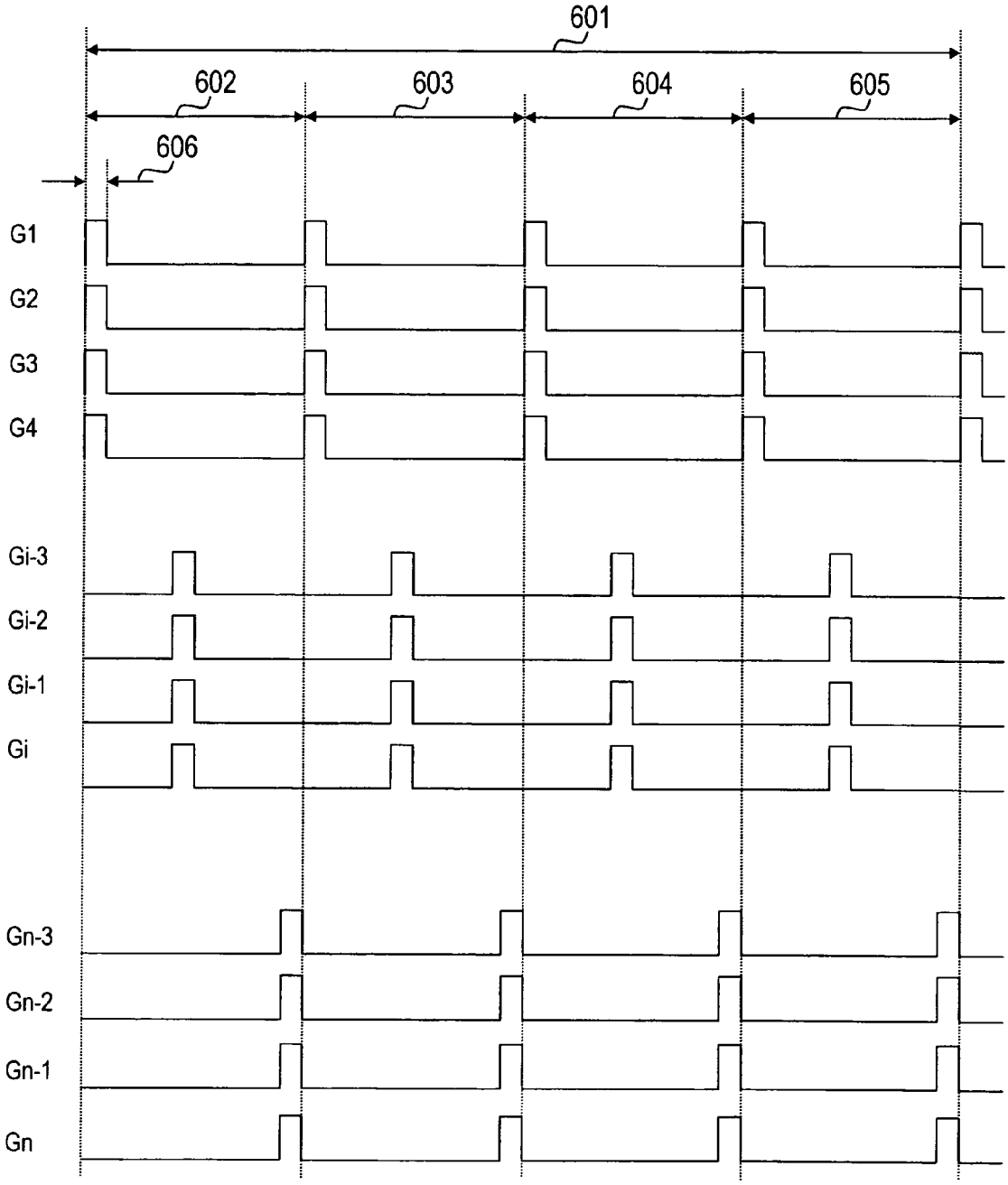
FIG. 6 is a waveform diagram of a gate line drive signal for scanning by four-line synchronous writing and four-line interlace scanning according to the first embodiment of the present invention.

The application of this embodiment can include the scanning as follows: FIG. 6 shows waveforms of gate drive signals when four lines are written at the same time. FIG. 6 includes a frame cycle 601, image scanning periods 602 and 603, and blanking scanning periods 604 and 605. Each of the image scanning periods 602 and 603 is ¼ of the frame cycle 601 and about 4.2 ms in this case. Each of the blanking scanning periods 604 and 605 is ¼ of the frame cycle 601. When four lines are written at the same time, scanning on one screen can be completed in ¼ period of one frame cycle. Therefore, the remaining ¾ frame period can be used for processing for blanking and/or the rapid responsive filter. As a result, the scanning band can be used effectively.

Figure 7:
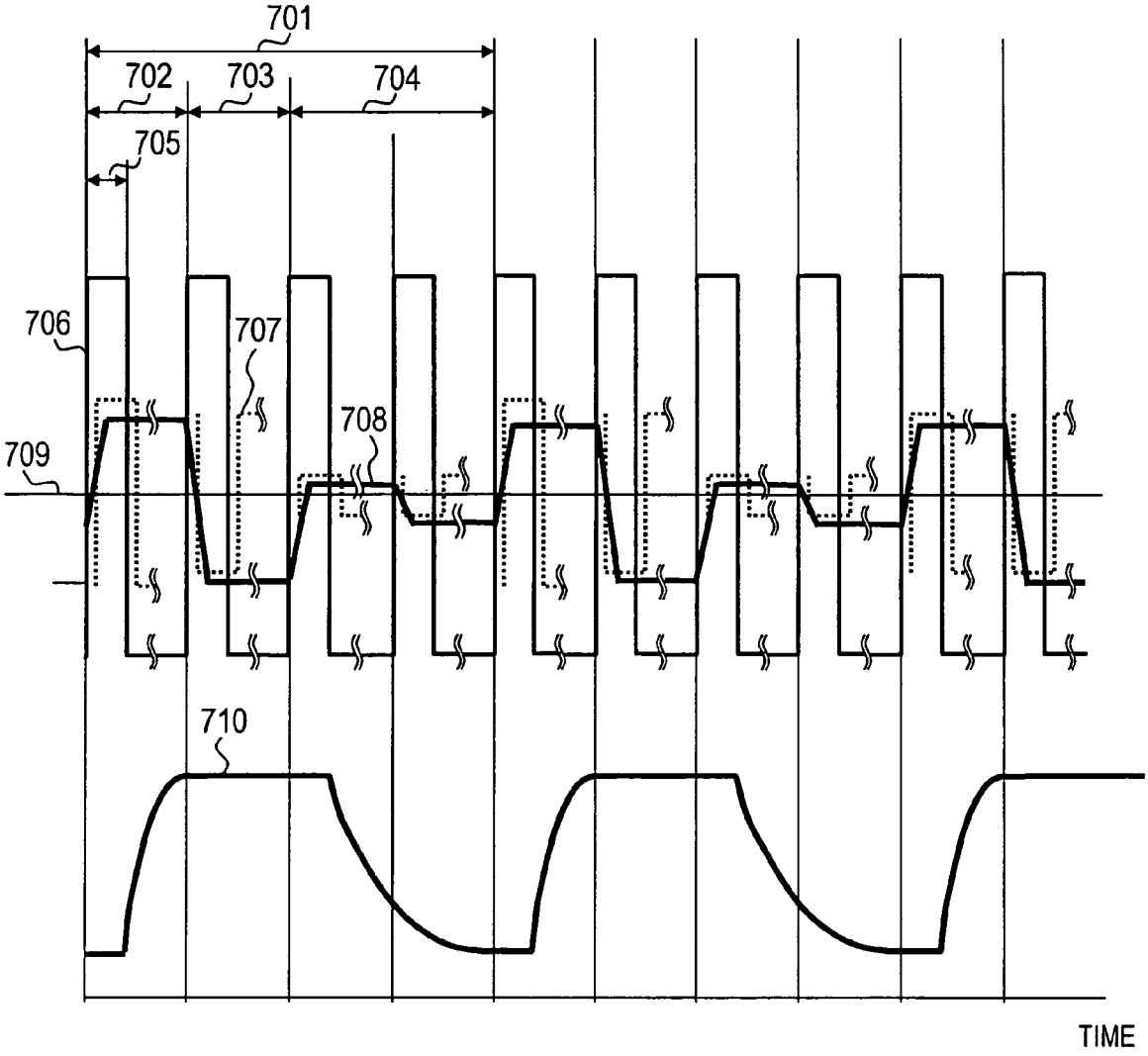
FIG. 7 is an optical response waveform diagram of each signal line drive waveform and a display element for scanning by four-line synchronous writing and four-line interlace scanning according to the first embodiment of the present invention.

FIG. 7 shows drive waveforms for pixels, which are driven to improve the response of image writing by applying a faster responsive liquid crystal filter in the first video writing period. In this embodiment, the faster liquid crystal filter is provided in the data generating circuit 102 for multiple scans.

FIG. 7 includes a frame cycle 701, a ¼ frame period 702 for image writing by using faster responsive liquid crystal filter, a ¼ frame period 703 for image writing, a ½ frame period 704 for blanking, a gate selecting period 705 for each line, a waveform 706 for a gate line drive signal, a waveform 707 for a drain line drive signal, a source voltage waveform 708 for a TFT, a common level 709, and an optical response waveform 710. The gate select period 705 for each line is equal to a writing period and is the same period for the general scanning line by line. The differential voltage between the voltage indicated by the source voltage waveform 708 and the common level 709 is applied to liquid crystal in order to obtain the optical response waveform 710. The optical response waveform is a ¼ frame period when the blanking display is switched to video display. An image to be supplied with a voltage for causing the liquid crystal to respond fast virtually is generated by the faster responsive liquid crystal filter, which improves the rising edge. In this case, only the rising edge from the black level may be always considered. The combination of filter coefficients of the faster responsive filter is simplified. Thus, there is an advantage of the lower circuit size. In addition, the cycle of inverting the writing polarity can be completed for each of the image and the blanking. That is, the alteration can be performed at a higher frequency. Therefore, the persistence of vision might not occur, and the deterioration of the liquid crystal can be prevented.

Figure 8A:
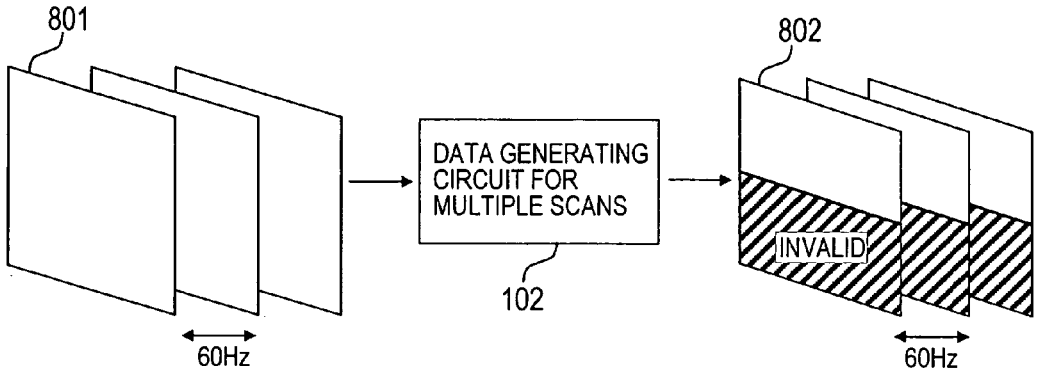
FIG. 8A is a conceptual diagram showing a video data generating process in a data generating circuit for multiple scans by two-line synchronous writing and two-line interlace scanning according to the first embodiment of the present invention.
Figure 8B:
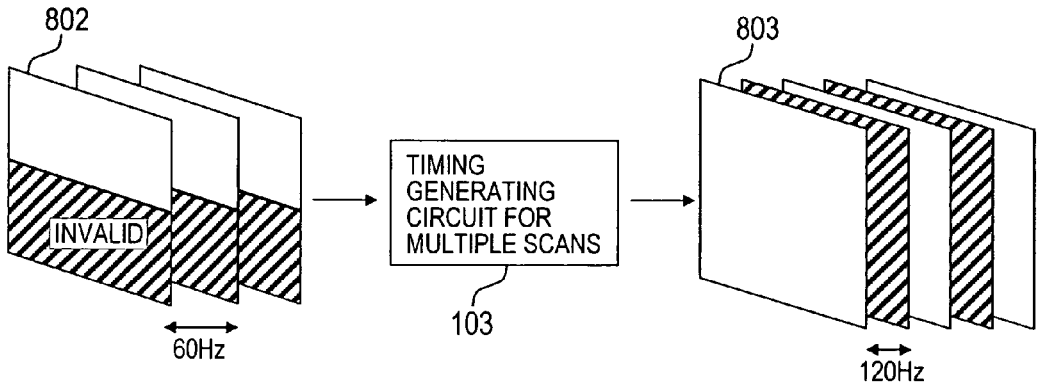
FIG. 8B is a conceptual diagram showing a video data generating process in a data generating circuit for multiple scans by two-line synchronous writing and two-line interlace scanning according to the first embodiment of the present invention.

The timing generating circuit 103 for multiple scans has been described which generates driving timing for a gate line. Next, an operation by the data generating circuit 102 for multiple scans which generates an image to be written in accordance with the timing will be described with respect to the timing generated by the above-described timing generating circuit 103 for multiple scans. FIGS. 8A and 8B are diagrams showing a process in which the data generating circuit 102 for multiple scans and the timing generating circuit 103 for multiple scans generates an image. This process may achieve the image display and the blanking display within one frame period by using the scanning through two-line synchronous writing and two-line interlacing. The image generated by the data generating circuit 102 for multiple scans is transferred to the timing generating circuit 103 for multiple scans. The image generated by the timing generating circuit 103 for multiple scans is generated by scanning on the display array 106. FIG. 8A is a process in which the data generating circuit 102 for multiple scans generates images. FIG. 8B is a process in which the timing generating circuit 103 for multiple scans generates images. Timing for controlling the gate line drive circuit 104 is generated by the timing generating circuit 103 for multiple scans. Then, gates for two lines are selected in the timing as shown in FIG. 3 at the same time. Then, the same data is written therein. Therefore, the number of scanning lines for vireo data supplied by the data generating circuit 102 for multiple scans may be half of the vertical resolution of the display array 106. Therefore, when the image 801 from the image signal source 101 has the same resolution as that of the display array 106, the data generating circuit 102 for multiple scans compresses the original image 801 vertical into the half. Then, the data generating circuit 102 for multiple scans adds the remaining half invalid image in order to generate a middle image 802. When the image from the image signal source 101 has the different resolution from that of the display array 106, image processing such as scaling, interlace progressive conversion and so on is performed in order to make their resolutions the same. Then, the image 802 having the half of the vertical resolution is generated.

The timing generating circuit 103 for multiple scans receives the image 802 and controls the gate line drive circuit 104 to drive the gate lines of the display array 106 in the timing shown in FIG. 3. Thus, a line doubler target image 803, which is obtained by writing the same data in two lines, is displayed on the display array 106. Here, the invalid image is image data, which is not used for the displaying. The invalid image may be generated by the data generating circuit 102 for multiple scans and be invalidated (for example, black data may be inserted). Alternatively, the image may be invalidated by the timing generating circuit 103 for multiple scans (for example, it may be masked).

The same is performed when the same data is written by selecting four lines at the same time. Select pulses may be supplied to gate lines of the display array 106 in timing shown in FIG. 6. Thus, the one screen scanning can be reduced to ¼ of one frame. In this case, the gate line drive circuit 104 supplies select pulses to four lines at the same time in the timing shown in FIG. 6 in order to scan by interlacing four lines under control of the timing generating circuit 103 for multiple scans. Since the same data is written in four lines, the image sent from the data generating circuit 102 for multiple scans to the timing generating circuit 103 for multiple scans may be obtained by compressing the original image data to ¼ in the vertical direction.

FIGS. 9A and 9B are a process in which the data generating circuit 102 for multiple scans and the timing generating circuit 103 for multiple scans generates images in order to achieve the image display processed by the faster responsive liquid crystal filter, the original image display and blanking in one frame period by using the scanning through the four-line synchronous writing and four line interlacing. The data generating circuit 102 for multiple scans compresses the vertical resolution of an original image 901 to ¼. In order to increase the response speed of the liquid crystal, an image 904 is generated which emphasizes the original image 901. Then, a middle image 902 is generated by combining the image 904 with the original image 905, which is vertical compressed to ¼ and an invalid image 906. Then, the middle image 902 is transferred to the timing generating circuit 103 for multiple scans. Thus, the timing generating circuit 103 for multiple scans receives the middle image 902 including the image, which has been compressed to ¼ and been subject to the fast response filter, the image, which has been vertically compressed to ¼, and the ¾ invalid image. Then, the timing generating circuit 103 for multiple scans supplies the gate line drive circuit 104 with timing for driving gate lines of the display array 106 as shown in FIG. 6, which indicates select timing for the scanning through the four-line synchronous writing and four line interlacing. Thus, the moving picture display can be achieved in which images are displayed in the first ¾ period and blanking is displayed in the remaining period. This moving picture display can improve the image quality, which implements the basic system of the present invention.

The configuration of the basic system and the operation of each of the elements, which illustrates the present invention, has been described above. Now, points to be especially considered for applying the basic system will be described, and a method will be described in detail for providing the solutions for improving the points by using the system configuration of the present invention.

First, the method according to the present invention may reduce the vertical resolution by applying the scanning in which the same scanned data is written in multiple lines. In this case, the number of lines to be written at the same time is desirably as small as possible. However, recently, the display arrays having higher resolution becomes the mainstream. In addition there are a variety of video formats in the current trend of the times because of the digitalization in broadcasting, the more implementation of the broad bands, a variety of video services and so on. Thus, several solutions can be found by considering the relationships between the resolution of the display arrays and video formats and how the present method suitable therefor can be applied. In order to consider the solutions, first of all, the combinations between display arrays and video formats will be described below.

FIG. 10 includes a list having typical, standardized display arrays each having a pixel arrangement of the aspect ratio of 4:3 in a matrix form and display arrays each having a standardized wider aspect ratio, both of which may be the liquid crystal display array shown in FIG. 2. Here, the pixel shown in FIG. 2 is assumed as a square pixel. Therefore, the aspect ratio is regarded as a ratio of the numbers of the horizontal and vertical pixels.

For example, the display array having Extended Graphics Array (XGA) resolution is an array having the aspect ratio of 4:3 in 1024×768. On the other hand, the display array having Wide Extended Graphics Array (WXGA) has the aspect ratio of 1280×768, which is horizontally wider. This trend is caused because the aspect ratio becomes wider to 16:9 in the video signal formats for the above-described digitalization in broadcasting. Furthermore, the trend is caused because the liquid crystal display devices becomes compliant with multimedia more and more.

FIG. 11 shows video formats, which are standardized in digital broadcasting. The subscripts "i" and "p" at the end of the numbers of valid scanning lines indicates interlace scanning and progressive scanning, respectively. The images for interlace scanning has only half of vertical resolution of the progressive scanned images. In order to maintain the compatibility to the wider video formats as shown in FIG. 11, to the trend of multimedia-compatible liquid crystal display devices and to the display standards for conventional personal computers and so on, interfaces for them are provided in the data generating circuit 102 for multiple scans in FIG. 1. Therefore, images in a different format, such as images for 1080i and images for personal computers may be displayed on the same display array, e.g. those having XGA resolution. However, while the vertical resolution of XGA is 768, 1080i has only 540 scanning lines a 60 Hz. Furthermore, while the aspect ratio of XGA is 4:3, the video format for 1080i has the aspect ratio of 16:9. Therefore, it is different from displaying images in personal computers. Thus, several display methods may be considered.

More specifically, several examples of the display methods for displaying images by using the different display arrays and formats are shown in FIGS. 12 and 13.

FIGS. 12A to 12D shows a typical display example for displaying, on a display array, images having the aspect ratio matching with the aspect ratio 4:3, which is typical in XGA, of the display array. FIG. 12A shows a case where an image having the aspect ratio matching with that of the display array is displayed. Alternatively, the aspect ratio of the image is adjusted and is displayed by using the entire screen as a valid display area. FIG. 12B shows a case where the horizontal resolution of the display array is totally used in order to maintain the wide aspect ratio of video signals. In this case, the excessive display area in the vertical direction is padded by blanking data. FIG. 12C shows a case where the resolution of the display array and the resolution of video signals are completely matched. In this case, the excessive display area in the horizontal and vertical directions is also padded by blanking data. FIG. 12D shows a case where the vertical resolution of the display array is entirely used in order to maintain the wide aspect ratio of the video signal. In this case, since the image in the horizontal direction cannot be displayed entirely, the display area can be selected to view a part of the entire area in this system configuration.

Conversely, FIGS. 13A to D show methods each for displaying a wide image or an image having non-wide aspect ratio on a display array having a wide aspect ratio, which is typified by WXGA. FIG. 13A is a case where an image having the aspect ratio matching with that of the display array is displayed on a full screen. Alternatively, if the aspect ratios are different, the image is stretched in the horizontal direction for display. FIG. 13B shows a case where an image is displayed by using the entire vertical resolution of the display array. In this case, the left and right areas are padded by blanking data. FIG. 13C shows a case where an image is displayed by matching the resolutions. In this case, the excessive display area is padded by blanking data. FIG. 13D shows a case where a part of an image is displayed by using the entire horizontal resolution of the display array.

FIG. 14 shows examples of typical combinations for displaying images each having different aspect ratio on different display arrays. A table (A) in FIG. 14 shows the results of calculating how many lines of scanning lines can be used for the valid display area and how many lines of scanning lines are needed for the blanking area. Here, images having the aspect ratios 4:3 and 16:9, respectively, are displayed on each of the display array. When an image having the wide aspect ratio is displayed on the non-wide display, the display method shown in FIG. 12B for maintaining the aspect ratio is adopted for the display. When a non-wide image is displayed on the wide display array, the display method shown in FIG. 13B is adopted for the display. A table (B) in FIG. 14 shows numbers of excessive or lacking scanning lines for adjusting aspect ratios and for padding blanking data when each of images in different formats is displayed on the valid display areas, which are calculated from the table (A). By using the cases of XGA and WXGA are used for explaining the excessive and lacking numbers specifically.

When an image having the aspect ratio 4:3 is displayed on the XGA display array, the aspect ratios are the same. Therefore, the horizontal resolution, 768 lines, may be used entirely as the valid display area. Therefore, the number of blanking lines is 0. However, when an image having the aspect ratio 16:9, the valid display area is 1024×9÷16=576 lines. The blanking area is 768−576=192 lines. In other words, in order to display the image of 480i having the aspect ratio 4:3, 528 lines are supplemented to the interlaced 240 valid scanning lines, resulting in 768 lines. Then blanking data is not used for padding. Furthermore, the image can be displayed in the entire screen of the XGA display array. On the other hand, an image of 1080i having the aspect ratio 16:9 is displayed, 36 lines are supplemented to the interlaced 540 valid scanning lines, resulting in 576 lines. The remaining 192 lines are padded by blanking data. Thus, the image of 1080i can be displayed on the XGA display array by maintaining the aspect ratio of 1080i. Therefore, the number of scanning lines to be supplemented is 528 for the 480i display and 36 for the 1080i display.

Similarly, when an image having the aspect ratio 4:3 is displayed on the WXGA display array, the display area having the vertical resolution 768 lines, which is same as that of XGA, can be obtained. In this case, the aspect ratio can be maintained by padding blanking data having 1280−1024=256 dot wide horizontally. Alternatively, the image can be stretched horizontally and be displayed instead of the blanking data. For the image having the aspect ratio 16:9, the number of the vertical valid lines is 1280×9÷16=720 lines, and the number of blanking lines is 768−720=48 lines. Therefore, when the 1080i image is displayed, 720−540=180 lines are required to supplement. However, since the number of blanking lines is 48 lines, which is small, the display area can be used efficiently.

Here, the vertical resolution when this embodiment is applied to the XGA and WXGA examples will be described below. First of all, a case where a 480i image is displayed, which has the same aspect ratio of that of the XGA display array. For the 480i video signals, there are only 240 valid scanning lines at 60 Hz. Therefore, the vertical resolutions of the XGA display array is three times or more as large as that of the 480i image. Thus, even when the scanning by two-line synchronous writing and two-line interlacing is performed and scanning lines are supplemented, the information for the original image is not lost. As a result, the deterioration in image quality is hardly and relatively less likely to occur. In other words, the improvement in moving picture display characteristic directly contributes to the improvement in image quality by applying this embodiment and the blanking effect by using the black data scanning.

Next, a case where the 1080i image having higher resolution is displayed on the XGA display array, whose aspect ratio is different from that of the 1080i image. In this case, based on the table (A) in FIG. 14, the valid display area has only 576 lines. Thus, when the scanning by simultaneous two-line writing and two-line interlacing is performed, 288 scanning lines, which is half of them, can be displayed. In other words, the 1080i image has 540 scanning lines at 60 Hz. As a result, image information for the remaining 540−288=252 lines is lost. Therefore, in this combination, the method for assigning a part of the vertical resolution to blanking may contribute to the improvement in the quality of moving pictures, whereas the image quality is not always enough.

Figure 15:
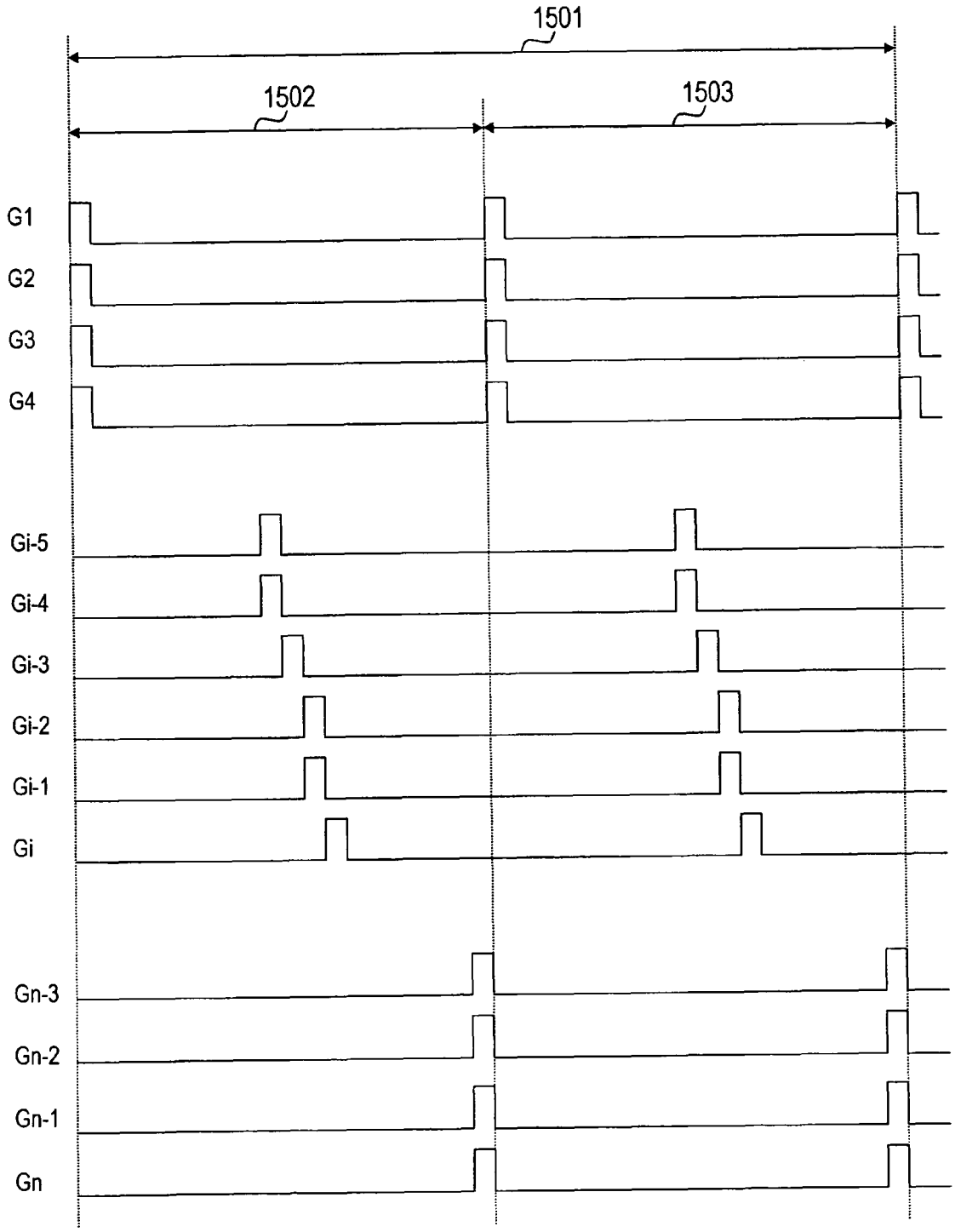
FIG. 15 is a waveform diagram of a gate line drive signal, which simplifies invalid area scanning according to the first embodiment of the present invention.

Then, several options can be considered for the application of the present method. FIG. 15 is a diagram showing a scanning method, which is one of options for improving the basic system of the present invention by using the same. FIG. 15 includes a frame cycle 1501, a ½ frame cycle 1502 for image writing, and a ½ frame cycle 1503 for blanking. As described above, when an image having the different aspect ratio from that of the display array is displayed, for example, when an image of 16:9 is displayed on the display array of 4:3, the valid display area is only a part of the entire display area. The remaining area requires blanking. Therefore, the vertical resolution of the original image needs to be reduced significantly. Accordingly, in FIG. 15, the scanning by the four-line synchronous writing and four-line interlacing is performed on blanking scanning area G1 to G96 (FIG. 15 only has G1 to G4) and G672 to G768 (FIG. 15 only has Gn-3 to Gn) in order to adjust the aspect ratios. It is apparent that the number of lines subject to the synchronous writing and the interlacing is not limited to four lines. More lines may be set. Especially, as the blanking writing is with the same data, the scanning lines of the original image can be read effectively when the same data can be written in lines as many as possible at the same time. When four lines are written at the same time, the total of 48 scans is required for completing the blanking invalid display area having 192 lines. As a result, the scanning period for the remaining 336 lines can be obtained. Thus, 336 lines of the original image can be read. The scanning period for the 336 lines needs to be assigned for the scanning period of the 576 lines of valid display area. Therefore, 240 scans by the two-line synchronous writing and two-line interlacing are needed, and 96 one-line scans are needed.

FIG. 15 shows an example where the one-line scan and the two-line scan are performed on a certain area alternately. For example, the same data is written in the Gi−5 and Gi−4. Only one-line is scanned for Gi−3. Then, the same data is written in the next Gi−2 and Gi−1. Then, only one-line is scanned for the next Gi. In this way, the number of synchronously written lines is differentiated. In this case, the number of one-line scan is small as 96 times. Therefore, the one-line scans are distributed and each of them is inserted in a manner that once after several of the two-line scans, for example. Naturally, the data and the timing for the one-line and the two-line scans require to be generated by the data generating circuit 102 for multiple scans and the timing generating circuit 103 for multiple scans in order to obtain a desired image. Thus, in a system according to this embodiment in FIG. 1, the lack of scanning lines can be minimized even for the original image, which has an aspect ratio different from that of the display array.

Alternatively, the vertical resolution can be used to the maximum in the finder display as shown in FIG. 12D. In this case, the vertical resolution can be increased double by the two-line synchronous writing. Therefore, an original image having 384 lines can be displayed therein. However, since the horizontal resolution is not enough, the entire original image cannot be displayed once. However, a select unit is provided such that a user can select a displayed area. The select unit will be described in detail later. In this way, by providing several options to the present invention and by allowing to select any of them, the decrease in vertical resolution can be suppressed.

Next, another case where the 1080i image is displayed on the WXGA array will be described as an example. As shown in table (A) in FIG. 14, 720 line of valid display area can be obtained with WXGA. Therefore, 360 scanning lines of an original image can be reproduced by the two-line synchronous writing and two-line interlace scanning. In other words, a large valid display area can be obtained in a wider display array. Thus, the quality of moving images can be improved by applying this embodiment, and the vertical resolution can be also maintained as much as possible at the same time. Therefore, the effect of improving the image quality is large.

While the effects of this embodiment has been described in view of moving pictures, the contents for broadcasting are not limited to moving pictures but may include many still pictures. Some user may give priority to the vertical resolution even for moving pictures. The vertical resolution may always have a priority in a case if a function for playing the images shot by a digital camera or the like is provided. Furthermore, several display modes may be provided as shown in FIGS. 12A to 13D such that the display method can be switched in accordance with the contents. Thus, the usage of and the way of enjoying contents can match with user's preference.

More specifically, when broadcasting of sports game in 1080i is received and is displayed on the 4:3 display array, entire images are displayed in the moving picture display mode shown in FIG. 12B. After that, a specific person or area is focused, and the display mode is switched to the moving picture display mode shown in FIG. 12D. Thus, the only part which the user desires to view can be extracted. In this case, in order to improve the image quality for displaying moving pictures, the option function involved in the switching of the still image mode and the moving image mode can be applied. The same is possible for recording digital broadcasting and playing the recorded images. In this case, however, when a still image is displayed by using a pause function, for example, the display mode is switched to the line-by-line non-blanking scan. Thus, the scanning lines of the original image can be used to the maximum by using interlace/progressive conversion, for example. As a result, a clearer image can be enjoyed.

In view of the above-described points, the system of this embodiment is provided with a switching unit for switching a moving picture mode by using the blanking effect through multiple-line synchronous writing as described above and a still image mode by using vertical resolution to the maximum through the one-line scan. As shown in FIGS. 12 A to 13D, several display modes are provided thereto, and functions therefor, such as mode switching, specific area focusing, zooming, and finder movement, are also provided thereto.

FIG. 1 includes the switching signal 109. When a user sends a control signal from an external controller such as a remote controller to the data generating circuit 102 for multiple scans, the above-described modes can be switched. The data generating circuit 102 for multiple scans performs scaling and/or interlace/progressive conversion on the one-line scan image in the still-picture mode to form the images so as to fit to the display array 106, which displays the image, as necessary. Alternatively, the data generating circuit 102 for multiple scans forms the images as shown in FIGS. 8A to 9B in the moving-picture mode so as to undergo the multiple-line synchronous writing and interlace scanning. In accordance with the display mode, blanking data is used for padding to adjust the aspect ratios. Then, the data is transferred to the timing generating circuit 103 for multiple scans. The images generated by the data generating circuit 102 for multiple scans and the timing generated by the timing generating circuit 103 for multiple scans correspond to each other. Therefore, when the generated images are changed in switching moving picture/still picture modes, or in switching display modes as shown in FIGS. 12A to 13D, the timing must be switched also. Therefore, the control switching signal line 109 must be supplied not only to the data generating circuit 102 for multiple scans but also to the timing generating circuit 103 for multiple scans. However, in the configuration for supplying the signal line to both of them, an increase in a number of wires and the complexity may occur due to the variation in the still-picture/moving-picture modes and/or display modes or to the display in different display arrays. Furthermore, the extensibility is low. Accordingly, in this embodiment, as shown in FIG. 16, video data to which image control information based on the mode setting is added is sent to the timing generating circuit 103 for multiple scans during the retrace time in order to solve the problems.

Figures 16, 17:
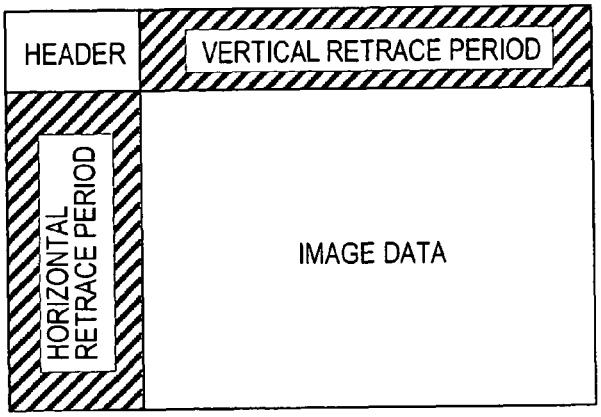
FIG. 16 is a schematic diagram of a video format having control information according to the first embodiment of the present invention.
FIG. 17 is an explanatory diagram showing a specific example of control parameters and the values according to the first embodiment of the present invention.

Examples of the control information to be added and the typical setting values are listed in FIG. 17. Some of them may be set interoperablly or may be controlled individually. When the data is transferred in a format in which the control information is added to the video data in this way, a parameter unique to the user can be set easily as an extension in addition to the basic parameters without adding extra wires. Therefore, according to the system configuration of this embodiment as shown in FIG. 1, the display characteristics for moving pictures and still pictures can be controlled in accordance with the combination of the display array and the video resolution. Furthermore, the select unit to be used by the user for the selection is provided. Thus, the liquid crystal display device can be implemented which has higher moving picture display performance and excellent flexibility, general versatility and extensibility.

Next, variation examples and so on relating to blanking data inserting formats in the above-described first embodiment will be described.

First Example

Figure 37:
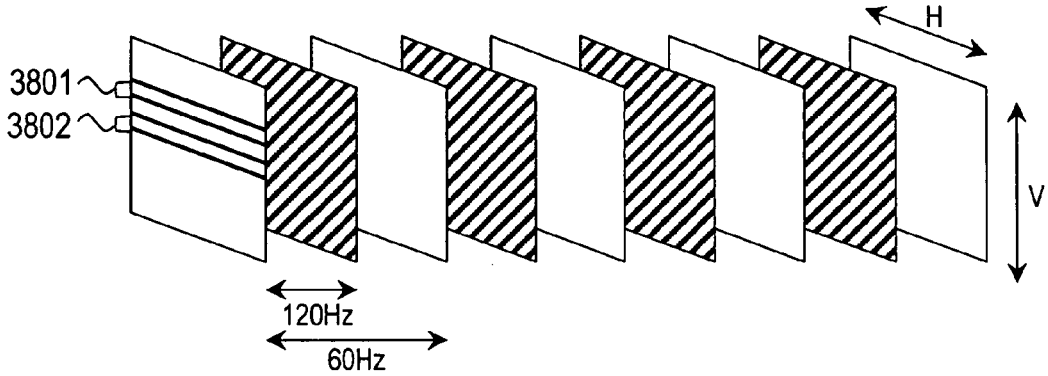
FIG. 37 is an explanatory diagram showing the configuration of scanning screens, into which a black display is inserted alternately in screen scanning at frame rate 120 Hz for two-line synchronous writing and two-line interlace scanning according to a first example of the present invention.
Figure 38:
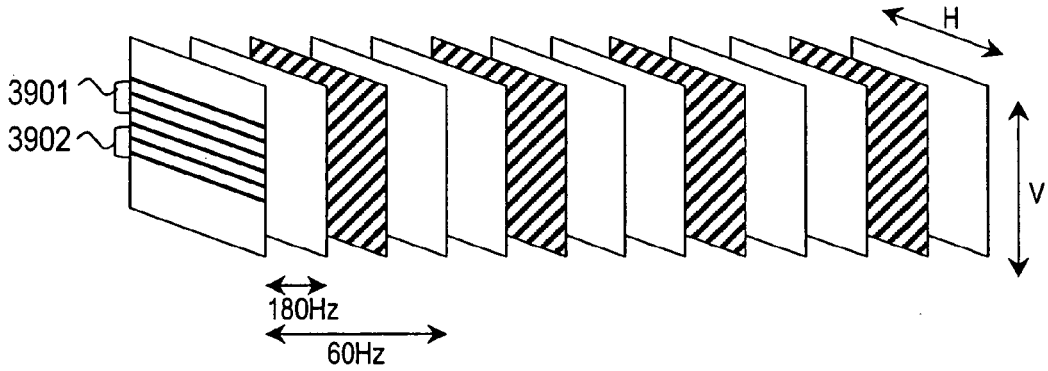
FIG. 38 is an explanatory diagram showing the configuration of scanning screens, into which a black display is inserted once in screen scanning at frame rate 180 Hz for scanning by three-line synchronous writing and three-line interlace scanning according to the second example of the present invention.

FIG. 37 shows an example where two-line synchronous writing and two-line interlace scanning are performed by using the same liquid crystal display element array. In this case, the frame rate 60 Hz of 120 Hz, obtained by the scan is assigned to the blanking data display (black display). FIG. 38 includes a current scanning line group 3801 including two lines which writes images in the current scanning period and a next scanning line group 3802 including two lines which writes the images in the next scanning period. Both scanning line groups are adjacent to each other. Here, an image is written in two lines synchronously, and scanning is performed by interlacing two lines. Therefore, the time for scanning one frame is half of that in the case in FIG. 37. For example, the vertical resolution is reduced to 320 lines for VGA and to 384 lines for XGA. However, the frame rate 120 Hz can be obtained, which is double. It should be noted that one frame period (cycle) is a period (cycle) for displaying image data for one screen of the liquid crystal display panel.

The remaining time of the time for scanning one frame is assigned to the time for scanning blanking data. The blanking data display is implemented by the two-line synchronous writing and two-line interlace scanning. In this way, the blanking data display period is provided within one frame period such that the hold period for the liquid crystal transmissivity can be reduced. Therefore, the same effect can be obtained as that described as the conventional technology. Thus, displaying less-blurred moving pictures can be achieved by using an existing liquid crystal display device. It is apparent that the moving picture display performance can be improved by using fast responsive liquid crystal. Here, a number of synchronously written lines and a number of interlaced lines are the same. However, the number of interlaced lines can be more than that of synchronously written lines. For example, 3, 4, 5 . . . -line interlacing can be performed with two-line synchronous writing.

Second Example

Figure 39:
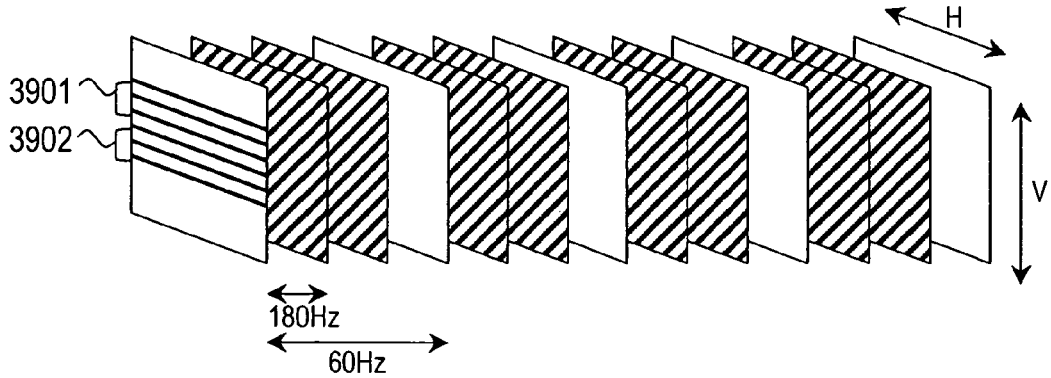
FIG. 39 is an explanatory diagram showing the configuration of scanning screens, into which a black display is inserted twice in screen scanning at frame rate 180 Hz for scanning by three-line synchronous writing and three-line interlace scanning according to the second example of the present invention.

FIGS. 38 and 39 shows how the three-line synchronous writing and three-line interlace scanning are performed during a certain line scanning period. FIG. 39 includes a current scanning line group 3901 including three lines, and a next scanning line group 3902 including three lines. Both of the scanning groups 3901 and 3902 are adjacent to each other. Since an image is written in three lines at the same time and is scanned by interlacing three lines, the time for scanning one frame is ⅓ of that of the case in FIG. 37. For example, with the VGA resolution, the vertical resolution is reduced to 213 lines. With the XGA resolution, the vertical resolution is reduced to 256 lines. However, three times of the frame rate as many as 180 Hz can be obtained.

FIG. 38 shows an example where 60 Hz of the frame rate 180 Hz, which is obtained by the three-line synchronous writing and three-line interlacing scan, is assigned to the blanking data display. The blanking data display is also implemented by using the three-line synchronous writing and three-line interlacing scan. When the liquid crystal has an unbalanced characteristic that the response of the liquid crystal is slow to the white display and is fast to the black display, the frame rate is increased by three. Then, the black display period is reduced, and the white display period is increased. Thus, the difference of response characteristics can be corrected.

FIG. 39 shows an example where 120 Hz of the frame rate 180 Hz, which is obtained by the three-line synchronous writing and three-line interlacing scan, is assigned to the blanking data display. This example is valid when the liquid crystal response is fast to the white display and is slow to the black display.

Third Example

Figure 40:
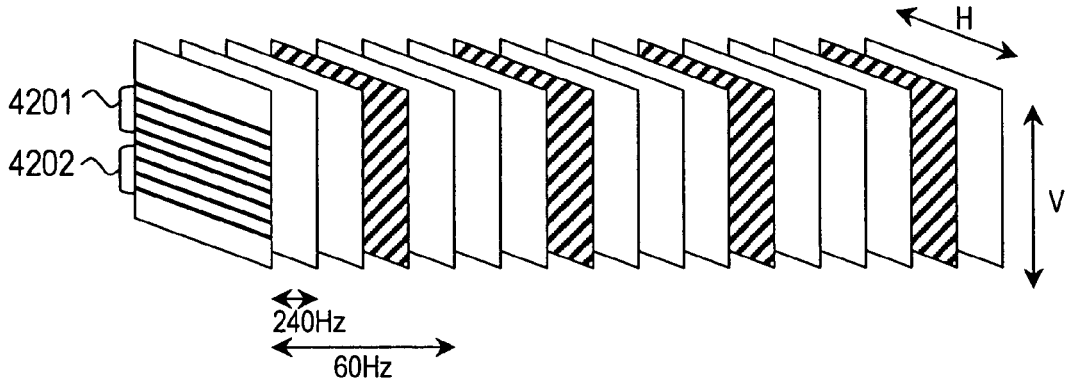
FIG. 40 is an explanatory diagram showing the configuration of scanning screens, into which a black display is inserted once in screen scanning at frame rate 180 Hz for scanning by four-line synchronous writing and four-line interlace scanning according to the third example of the present invention.
Figure 42:
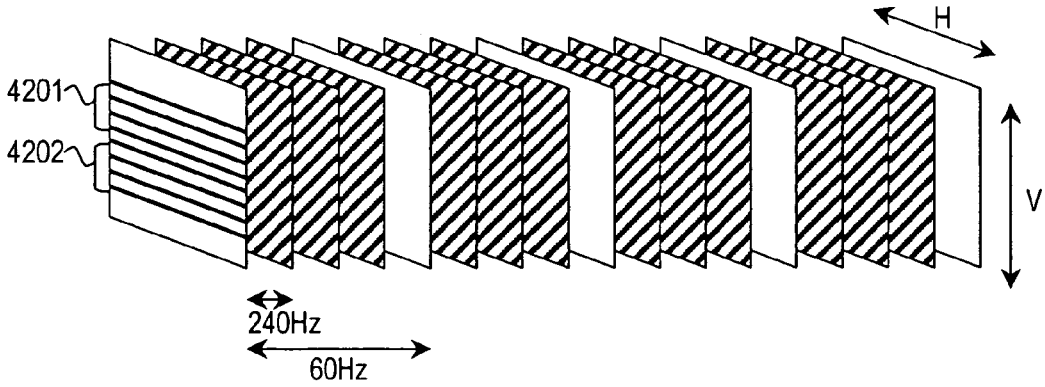
FIG. 42 is an explanatory diagram showing the configuration of scanning screens, into which a black display is inserted three times in screen scanning at frame rate 240 Hz for scanning by four-line synchronous writing and four-line interlace scanning according to the third example of the present invention.

FIG. 40 shows how the four-line synchronous writing and four-line interlace scanning are performed during a certain line scanning period. FIG. 42 includes a current scanning line group 4201 including four lines, and a next scanning line group 4202 including four lines. Both of the scanning line groups 4201 and 4202 are adjacent to each other. Since an image is written in four lines at the same time and is scanned by interlacing four lines, the time for scanning one frame is ¼ of that of the case in FIG. 37. For example, with the VGA resolution, the vertical resolution is reduced to 160 lines. With the XGA resolution, the vertical resolution is reduced to 192 lines. However, four times of the frame rate as many as 240 Hz can be obtained.

This FIG. 40 shows an example where 60 Hz of the frame rate 240 Hz, which is obtained by the four-line synchronous writing and four-line interlacing scan, is assigned to the blanking data display. The blanking data display is also implemented by using the four-line synchronous writing and four-line interlacing scan. When the liquid crystal has an unbalanced characteristic that the response of the liquid crystal is slow to the white display and is fast to the black display, the frame rate is increased by four. Then, the black display period is reduced, and the white display period is increased. Thus, the difference of response characteristics can be corrected.

Figure 41:
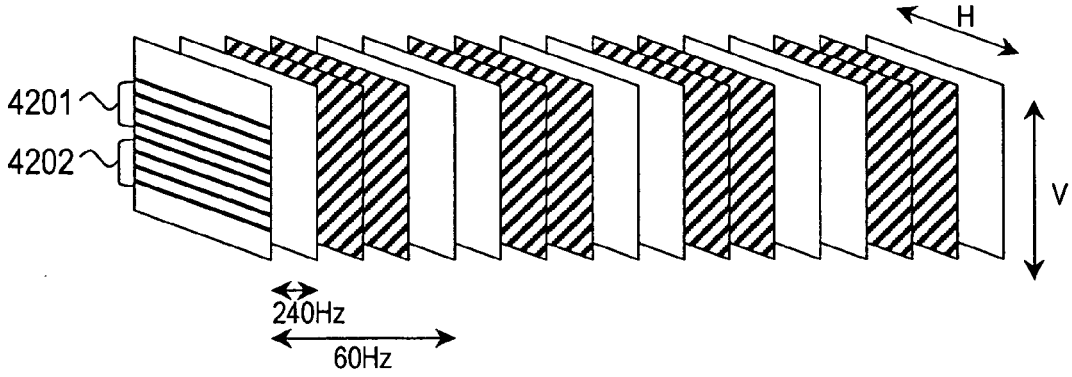
FIG. 41 is an explanatory diagram showing the configuration of scanning screens, into which a black display is inserted twice in screen scanning at frame rate 240 Hz for scanning by four-line synchronous writing and four-line interlace scanning according to the third example of the present invention.

FIG. 41 shows an example where 120 Hz is assigned to the blanking data display such that the ratio can be 2/4. The blanking display may be performed alternately.

FIG. 42 shows an example where 180 Hz is assigned to the blanking data display such that the ratio can be 3/4. This is valid when the response of the liquid crystal is fast to the white display and is slow to the black display.

Fourth Example

Figure 43:
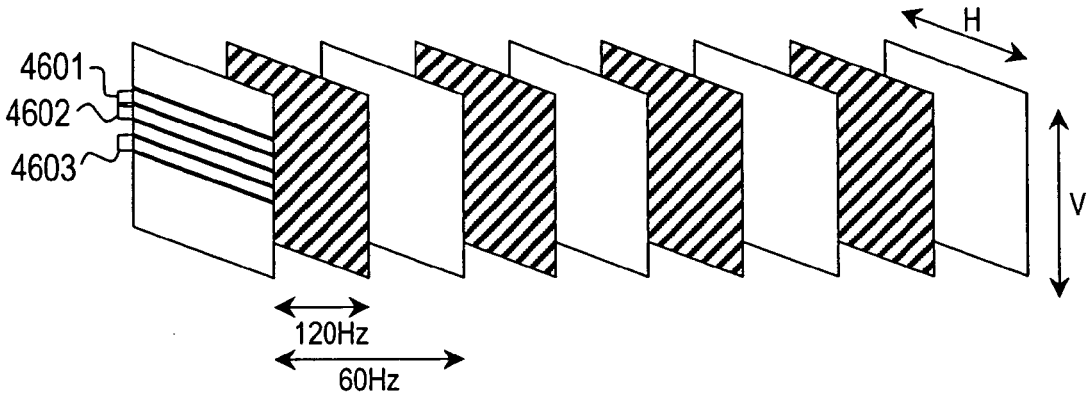
FIG. 43 is an explanatory diagram showing the configuration of scanning screens, into which a black display is inserted once in screen scanning at frame rate 120 Hz for scanning by two-line synchronous writing and one-line or two-line interlace scanning according to the fourth example of the present invention.
Figure 46:
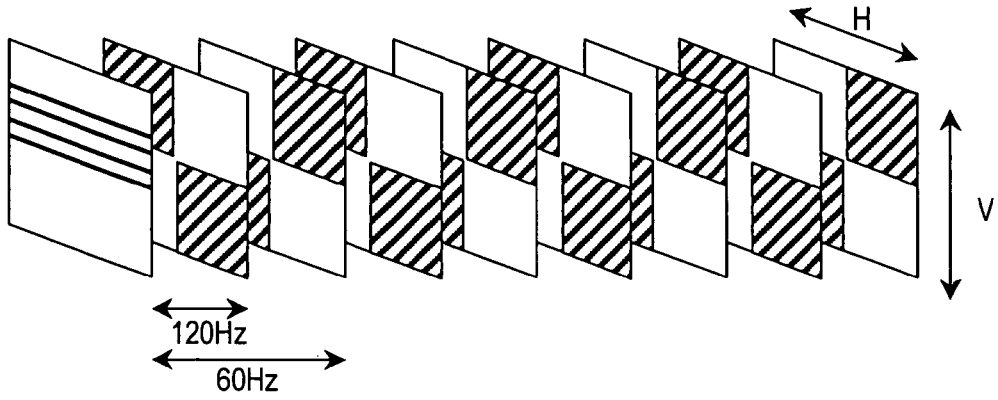
FIG. 46 is an explanatory diagram showing the configuration of scanning screens, into which a ¼ checker black display is inserted in screen scanning at frame rate 120 Hz for two-line synchronous writing and two-line interlace scanning according to the seventh example of the present invention.

FIG. 43 shows how the two-line synchronous writing and one or two-line interlace scanning are performed during a certain line scanning period. FIG. 46 includes a current scanning-line group 4601 including two lines, a next scanning-line group 4602 including two lines and a scanning-line-group-after-next 4603 including two lines. The number of synchronously written lines and the number of interlaced lines are not always necessary to be the same. In this case, a typical example is shown where the number of interlaced lines is equal or smaller than the number of synchronously written lines.

In this scan, first, the current scanning-line group 4601 including two lines is synchronously written. Then, one line is interlaced, and two lines of the next scanning-line group 4602 are written synchronously. After that, two lines are interlaced and two lines of the scanning-line-group-after-next 4603 are written synchronously. Then, the second line of the current scanning line group 4601 is overwritten by the first line of the next scanning line group 4602. As a result, five lines are scanned by three line scans. Thus, the image having any number of scanning lines can be adjusted to the scanning lines of the liquid crystal display element. For example, a case where a VGA image is displayed by the XGA liquid crystal display element. When 288 two-line interlace scanning and 192 one-line interlace scanning are performed by using 480 VGA scanning lines and two-line synchronous writing, 768 scanning lines can be formed at 60 Hz. Alternatively, when 48 four-line synchronous writings and 192 three-line synchronous writings by using 240 VGA scanning lines, which is half of the 480 VGA scanning lines, the 768 scanning lines can be formed at 120 Hz.

FIG. 43 shows an example where 60 Hz of the frame rate 120 Hz obtained by the above-described scanning is assigned to the blanking data display. In this case, the scanning is performed in the same manner as that in the first embodiment, which is effective for improving the quality in moving pictures. The scanning can be more flexible if a scanning circuit can be obtained whereby the number of synchronous writing scanning lines and the number of interlace scanning lines can be set randomly for each horizontal scanning period.

Fifth Example

Figure 44:
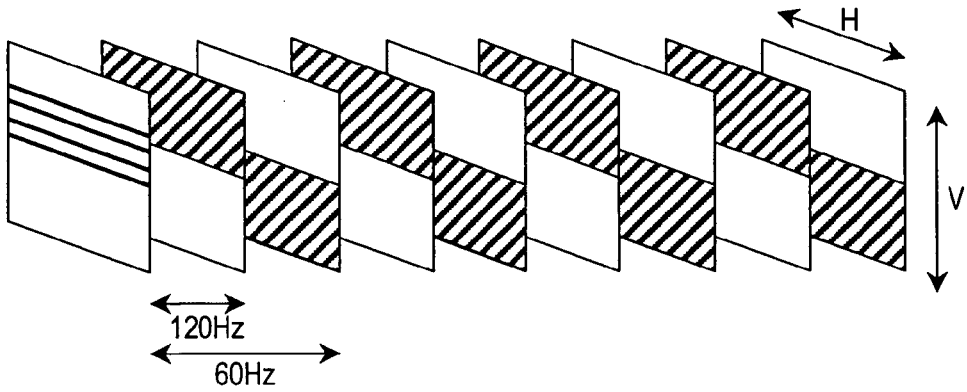
FIG. 44 is an explanatory diagram showing the configuration of scanning screens, into the upper and the lower half of which a black display is inserted alternately in screen scanning at frame rate 120 Hz for two-line synchronous writing and two-line interlace scanning according to the sixth example of the present invention.

FIG. 44 shows an example of scanning at the double frame frequency 120 Hz, which is obtained by the two-line synchronous writing and the two-line interlace scanning. In this example, each of screens is divided into the upper half and lower half portions. One of the portions is used for image writing, and the other half portion is used for blanking data writing. The image writing and the blanking data writing are performed at 120 Hz alternately. Unlike the black display on the entire screen in the first example, the spatial modulation is performed on the black display. Thus, the performance for moving image display is maintained while the flicker can be reduced.

Incidentally, the spatial modulation may be performed for the black horizontal stripe display having vertical four divisions and vertical six divisions, respectively, in one screen. Also in this case, the black horizontal stripe display is switched at 120 Hz. Thus, the flicker can be reduced more than the case of the entire screen black display in the first example.

Six Example

Figure 45:
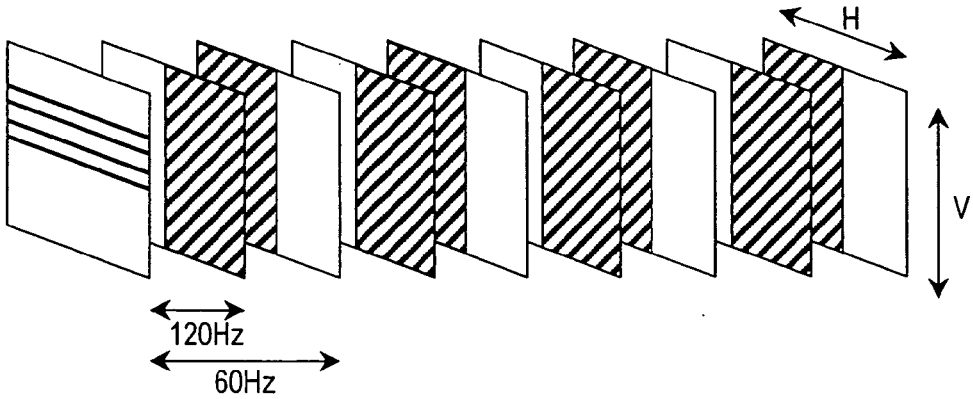
FIG. 45 is an explanatory diagram showing the configuration of scanning screens, into the right and left of which a black display is inserted alternately in screen scanning at frame rate 120 Hz for two-line synchronous writing and two-line interlace scanning according to the sixth example of the present invention.

FIG. 45 shows an example of scanning at the double frame frequency 120 Hz, which is obtained by the two-line synchronous writing and the two-line interlace scanning. In this example, each of screens is divided into the right half and left half portions. One of the portions is used for image writing, and the other half portion is used for blanking data writing. The image writing and the blanking data writing are performed at 120 Hz alternately. Unlike the black display on the entire screen in the first example, the spatial modulation is performed on the black display in the sixth example. Thus, the performance for moving image display is maintained while the flicker can be reduced.

Incidentally, the spatial modulation may be performed for the black vertical stripe display having horizontal four divisions and horizontal six divisions, respectively, in one screen. Also in this case, the black vertical stripe display is switched at 120 Hz. Thus, the flicker can be reduced more than the case of the entire screen black display in the first example.

Seventh Example

FIG. 46 shows an example of scanning at the double frame frequency 120 Hz, which is obtained by the two-line synchronous writing and the two-line interlace scanning. In this example, each of screens is divided into vertical and horizontal four portions. A pair of the diagonal portions is used for image writing, and the other pair of the diagonal portions is used for blanking data writing. The image writing and the blanking data writing are performed at 120 Hz alternately. Unlike the black display on the entire screen in the first example, the spatial modulation is performed on the black display. Thus, the performance for moving image display is maintained while the flicker can be reduced.

Incidentally, the spatial modulation may be performed for the black checker pattern display having total of sixteen divisions each having vertical and horizontal four divisions or the black checker pattern display having total of thirty-six divisions each having vertical and horizontal six divisions, respectively, in one screen. Also in this case, the black vertical stripe display is switched at 120 Hz so that the flicker can be reduced more than the case of the entire screen black display in the first example. The pattern for inserting black data is not always necessary to be the checker pattern but may be a random pattern.

Eighth Example

Figure 47:
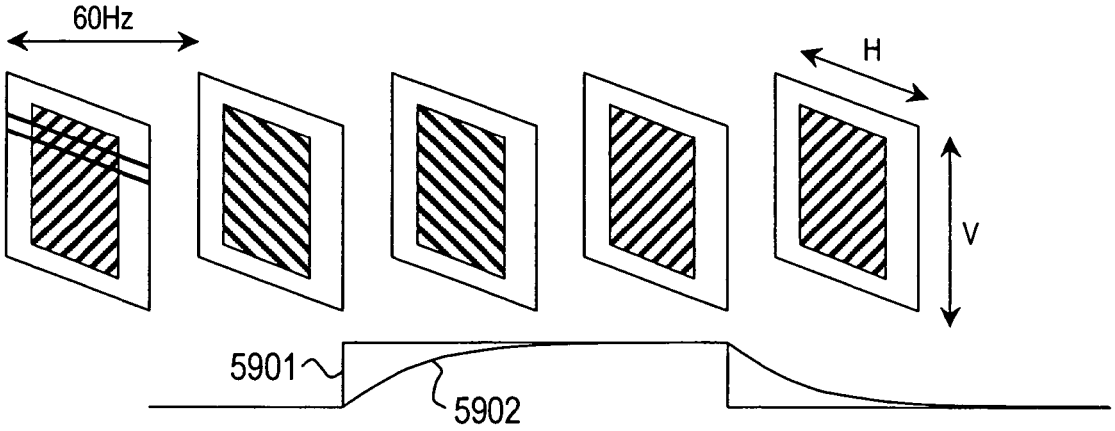
FIG. 47 is an explanatory diagram showing image changes and liquid crystal transmissivity response waveform in scanning at 60 Hz according to the eighth example of the present invention.
Figure 59:
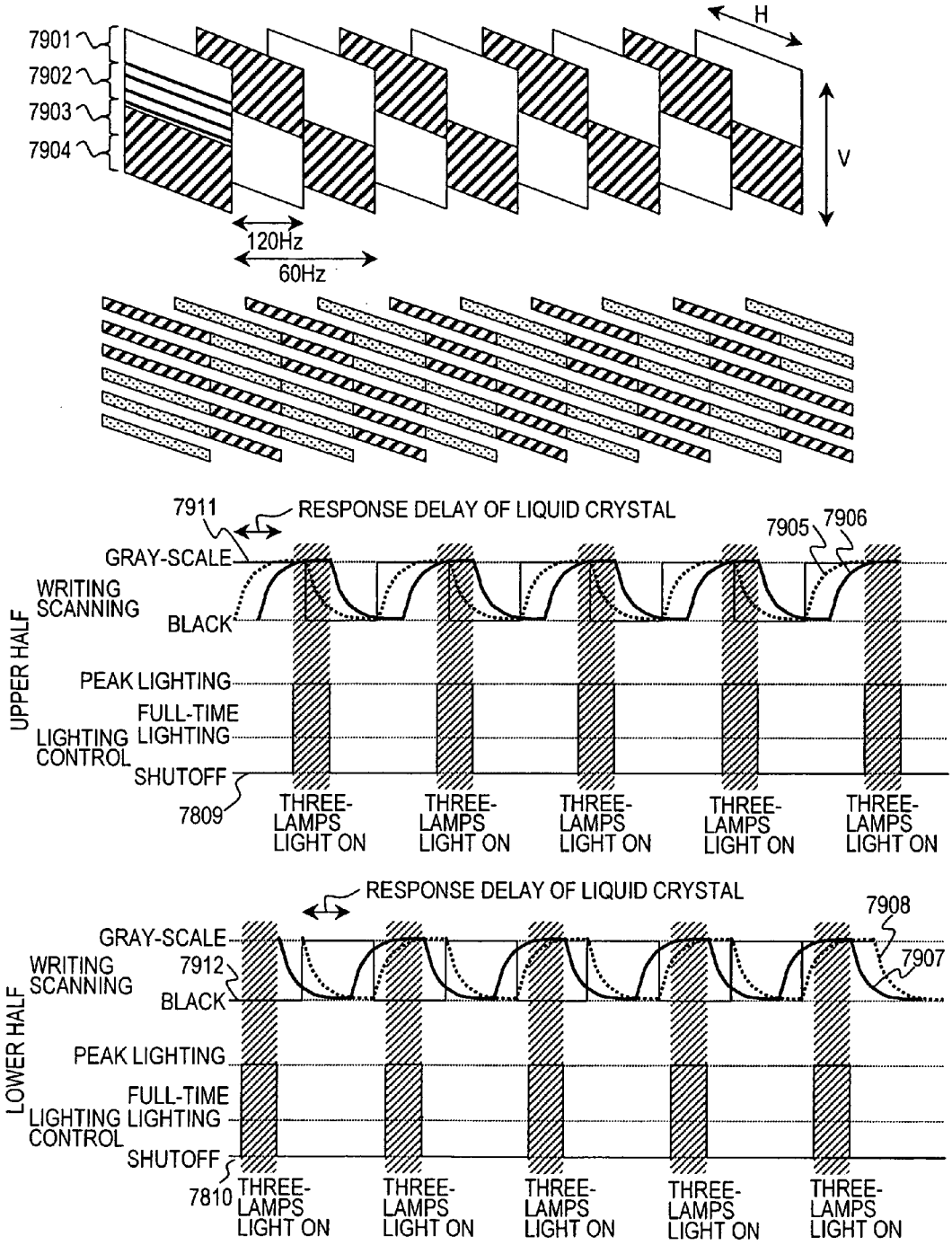
FIG. 59 is an explanatory diagram showing a relationship between the arrangement of scanned screens into which upper and lower black displays are inserted and the control over backlighting lighting when scanned at 120 Hz according to a seventeenth example of the present invention.
Figure 60A:
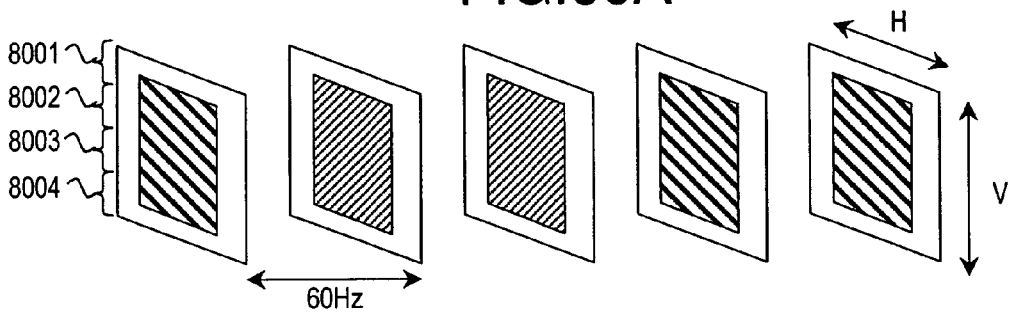
FIG. 60A is an explanatory diagram showing image changes when scanned at 120 Hz according to the twentieth example.
Figure 60B:
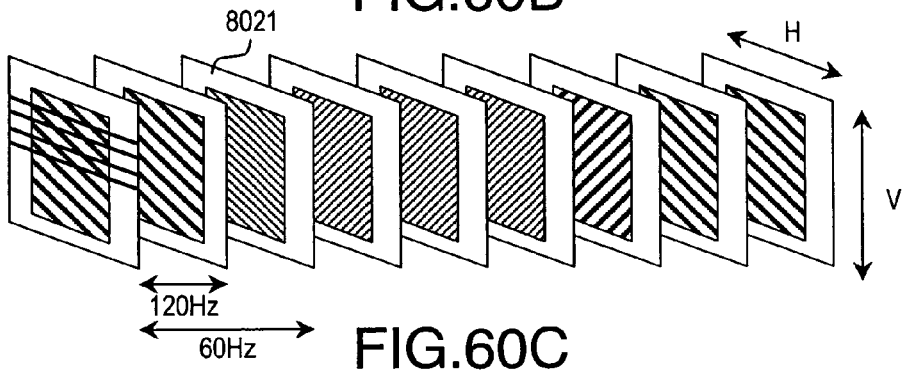
FIG. 60B is an explanatory diagram showing image changes in a case where data derived by using the rapid responsive filter is inserted when scanned at 120 Hz according to the twentieth example of the present invention.
Figure 60C:
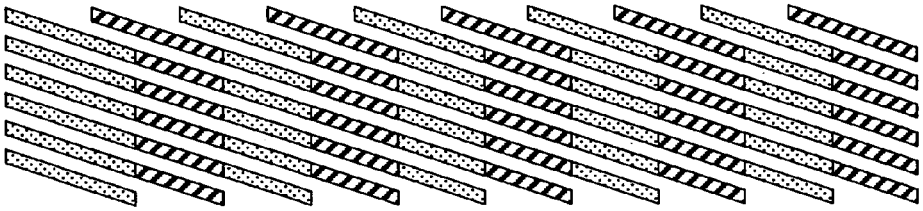
FIG. 60C is an explanatory diagram showing image changes when the rapid responsive filter is applied when scanned at 120 Hz according to the twentieth example of the present invention.
Figure 60D:
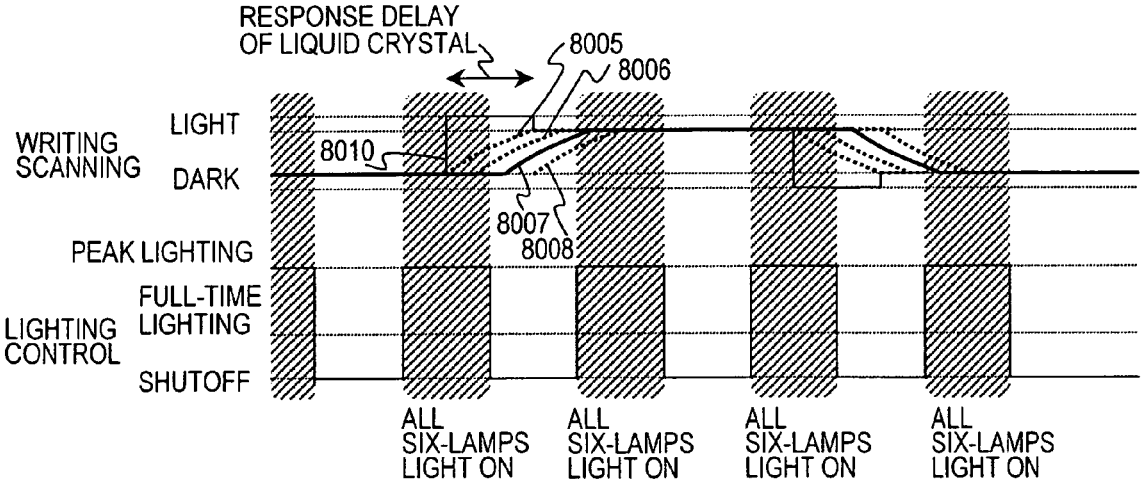
FIG. 60D is an explanatory diagram showing a relationship between liquid crystal responses and lighting control when the rapid responsive filter is applied when scanned at 120 Hz according to the twentieth example of the present invention.

FIG. 47 shows how general scanning at 60 Hz is performed when images are varied from a darker halftone to a brighter halftone. FIG. 59 includes an ideal optical response waveform 5901 of liquid crystal to a video signal and a real optical response waveform 5902 of liquid crystal. As shown in the figure, a response of a liquid crystal material for generally available liquid crystal displays is slow. Many of responses do not complete within one frame period. Accordingly, when images as shown in FIG. 47 are sent, the scanning at the double frame frequency 120 Hz, which is obtained by the two-line synchronous writing and the two-line interlace scanning is performed thereon. Each of frames is divided into two sub-fields. Scanning one of the sub-fields can accelerate the response of the liquid crystal by using a faster responsive liquid crystal filter. In this case, the response completes in the order of 8 ms. The detail on the faster responsive filter is found in SID92 DIGEST p. 601-604. The sub-field is multiple images within one screen. For example, sub-fields may be even number fields and odd number fields of interlace signals in the NTSC format. For the interlaced display, the even-number fields are processed first, and then the even number fields are processed. That is, one screen is formed by even-number fields and odd-number fields. On the other hand, for the noninterlaced (or progressive) display, each scanning line is rendered, and one image is formed at a time.

Figure 48:
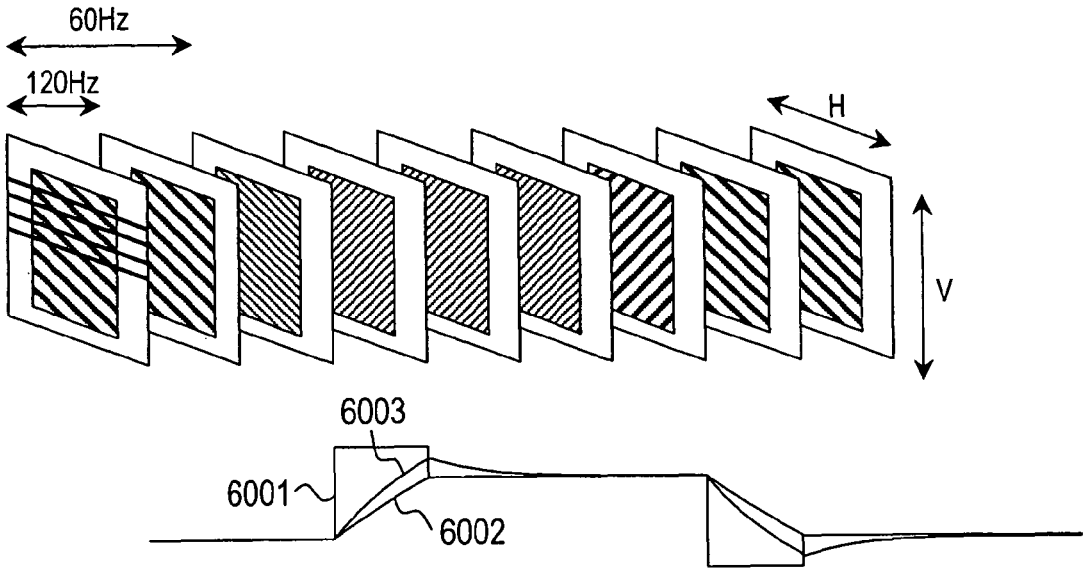
FIG. 48 is an explanatory diagram showing image changes and liquid crystal transmissivity response waveform in scanning at 120 Hz according to the eighth example of the present invention.

FIG. 48 includes an ideal optical response waveform 6001 of liquid crystal to a video signal and a real optical response waveform 6002 of liquid crystal. When images are varied from the darker halftone to the brighter halftone, much brighter halftone data is obtained as a result of the faster responsive filter processing. Then, the much brighter data is inserted to the series of images. Then, in the subsequent sub-field scanning, the original brighter halftone data returns. The ideal optical response waveform 6001 is obtained in that way. Furthermore, FIG. 60 includes a liquid crystal response waveform resulting from the brightness compensating filter processing. The detail description therefor may be found in SID01 DIGEST p. 998-1001. In both of the processing, one frame period is divided into two sub-fields. Then, one of the sub-fields can be assigned to the filter processing, which is effective for video correction on the liquid crystal displays such as television games.

Ninth Example

Figure 49:
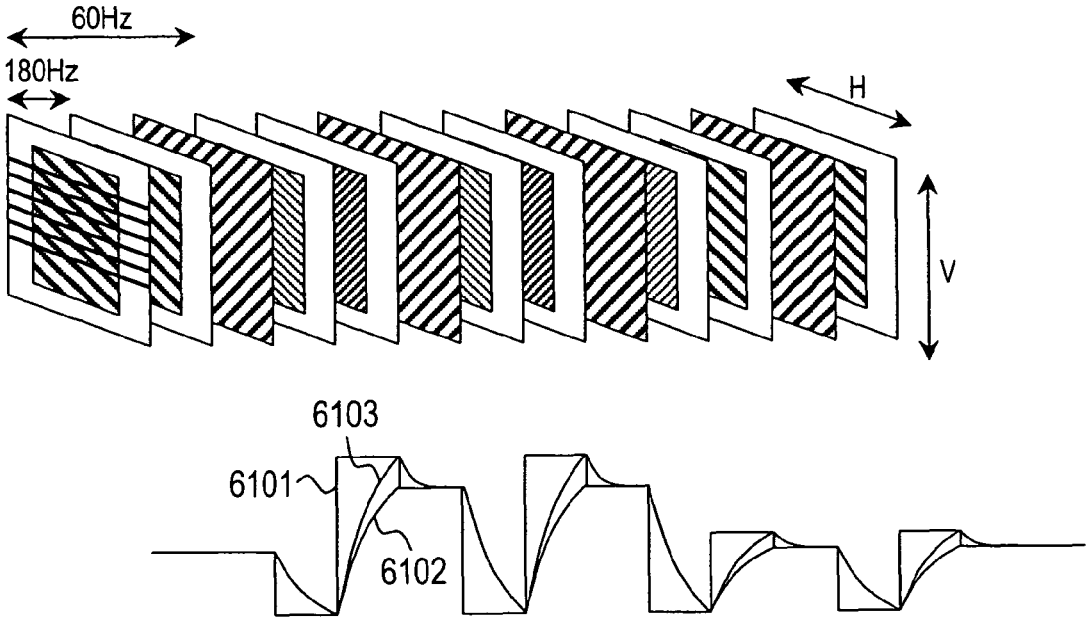
FIG. 49 is an explanatory diagram showing image changes and liquid crystal transmissivity response waveform in scanning at 180 Hz according to the ninth example of the present invention.

FIG. 49 shows how different images are displayed in sub-fields, respectively, when images as shown in FIG. 48 are sent. In this case, the frame rate is increased by three as 180 Hz, which is obtained by the three-line synchronous writing and the three-line interlace scanning. One frame is divided into three sub-fields. A first sub-field is assigned to the filter processing described in the eighth example. A second sub-field is assigned to the transmitted images. A third sub-field is assigned to the blanking data display. The fast response of the liquid crystal and higher quality in moving picture can be obtained at the same time.

FIG. 49 includes an ideal optical response waveform 6101 of liquid crystal by filter processing, a real fast response waveform 6102 of liquid crystal and a real optical response waveform 6103 of liquid crystal by the processing by using the brightness compensating filter. According to this example, one frame is divided into three sub-fields. They are used for correcting the response characteristic of the liquid crystal and for the black display. Thus, the reduction in brightness due to the improvement in moving picture quality and response delays can be compensated.

Tenth Example

Figure 50:
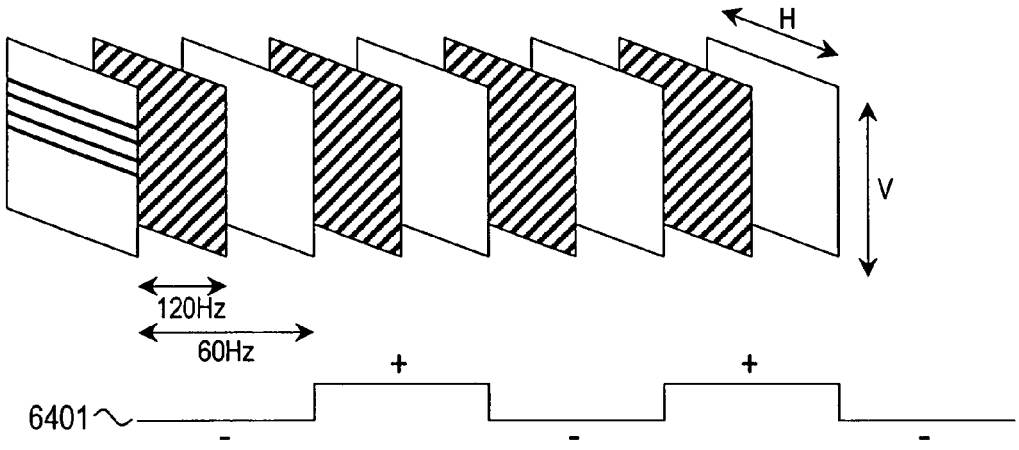
FIG. 50 is an explanatory diagram showing the arrangement of scanned screens to which ½ black display are inserted and the polarities in writing when scanned at 120 Hz according to the tenth example of the present invention.

FIG. 50 shows scanning by the two-line synchronous writing and two-line interlace scanning. In this case, one frame is divided into two sub-fields. An image is written in a first sub-field. Blanking data is written in a second sub-field. FIG. 50 includes a polarity inversion waveform 6401 of a signal input to the drain line drive circuit. In consideration of the black writing frequency 60 Hz, the polarity is inverted at the polarity inversion frequency 30 Hz. Thus, the voltage having always the same polarity is prevented from being applied during the black display. Therefore, direct current voltage is not applied to the liquid crystal, which can achieve higher quality in moving pictures.

Figure 51:
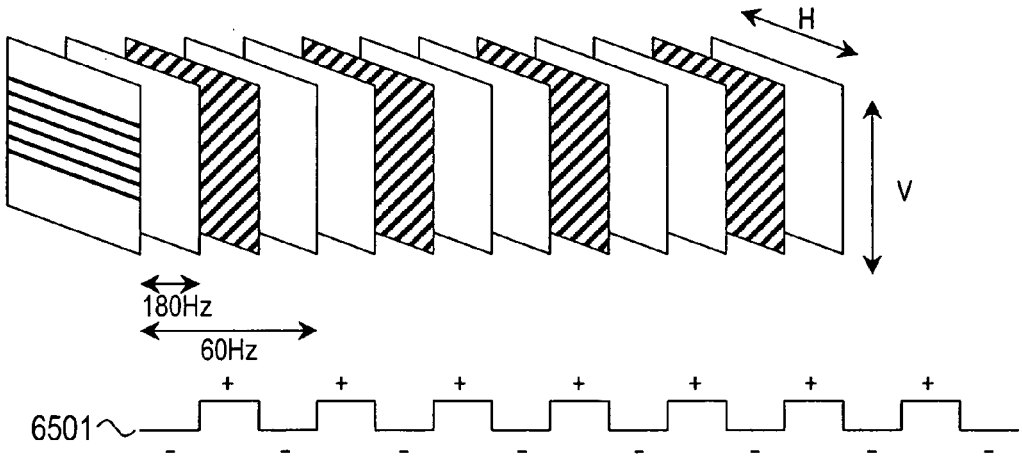
FIG. 51 is an explanatory diagram showing the arrangement of scanned screens to which ⅓ black display are inserted and the polarities in writing when scanned at 180 Hz according to the tenth example of the present invention.
Figure 65:
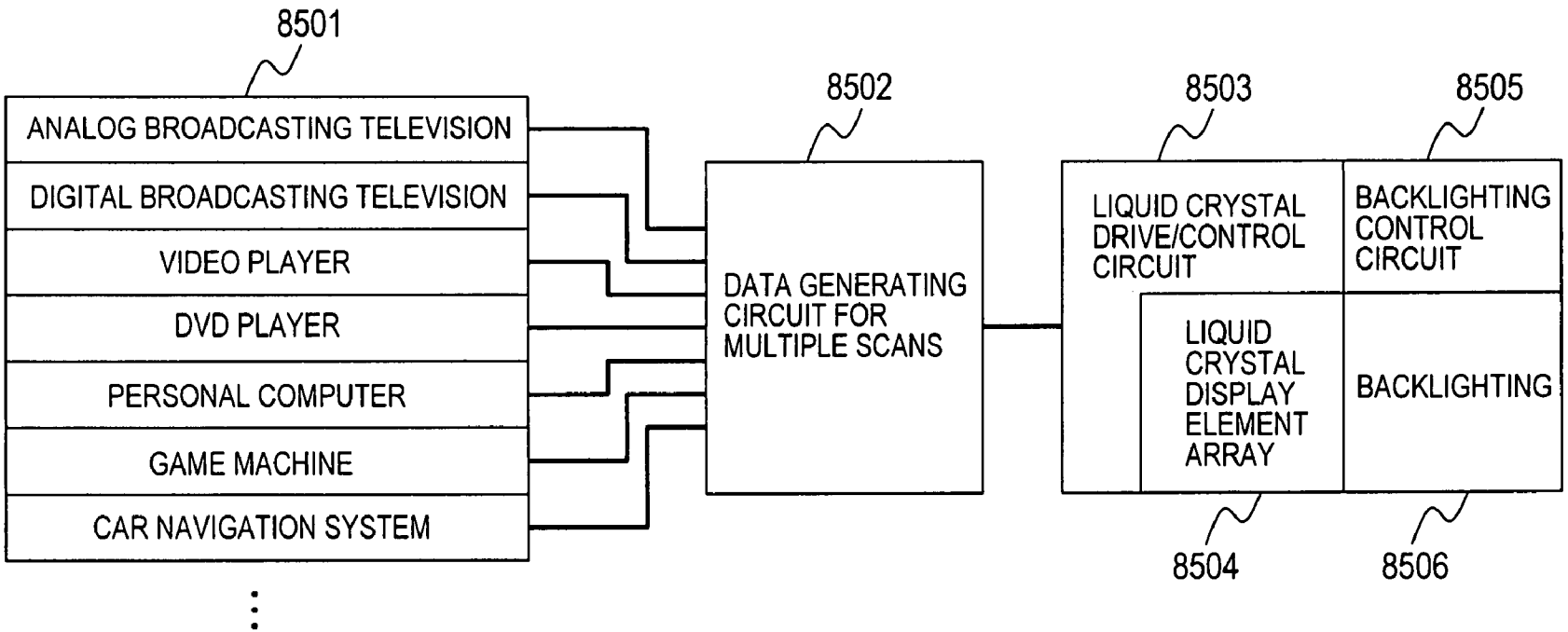
FIG. 65 is a diagram showing the configuration of a display device compliant with a video multi-format according to the nineteenth example of the present invention.

FIG. 51 shows scanning by the three-line synchronous writing and three-line interlace scanning. In this case, one frame is divided into three sub-fields. An image is written in two sub-fields. Blanking data is written in a remaining sub-field. FIG. 65 includes a polarity inversion waveform 6501 of a signal input to the drain line drive circuit, which is 90 Hz in this case. Since the black display frequency is 60 Hz, the direct current voltage is not applied to the liquid crystal during the black display, which can also achieve the display having less flicker. Here, it goes without saying that display having less flicker can be achieved even without blanking data inserted in the examples shown in FIG. 50 and FIG. 51.

Figure 52:
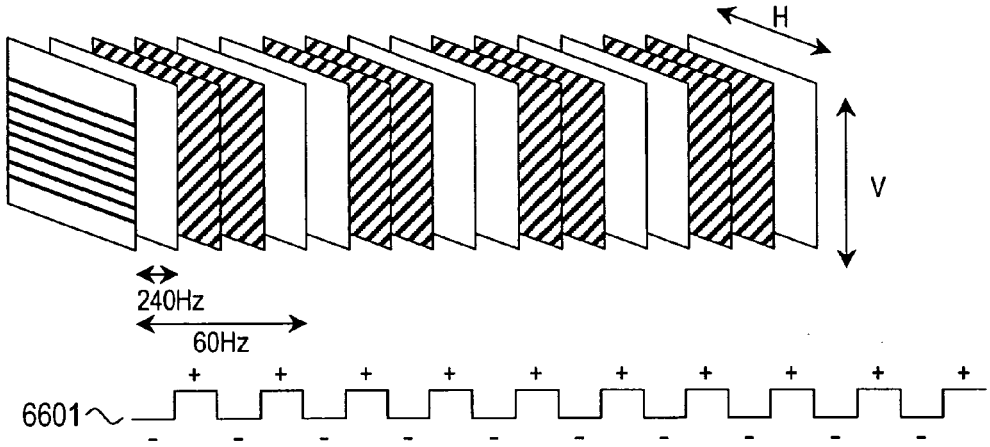
FIG. 52 is an explanatory diagram showing the arrangement of scanned screens to which ¾ black display are inserted and the polarities in writing when scanned at 240 Hz according to the tenth example of the present invention.

FIG. 52 shows scanning by the four-line synchronous writing and four-line interlace scanning. In this case, one frame is divided into four sub-fields. An image display scanning is performed in two sub-fields. Blanking data display scanning is performed in the remaining two sub-fields. FIG. 65 includes a polarity inversion waveform 6601 of a signal input to the drain line drive circuit, which is 120 Hz in this case. Both of the image and black writing frequencies are 60 Hz, and the polarity inversion frequency is double of them. Then, the image and black display writing and the polarity inversion are completed in one frame period. There, high quality moving picture display having no flicker is realized.

Eleventh Example

Figure 53:
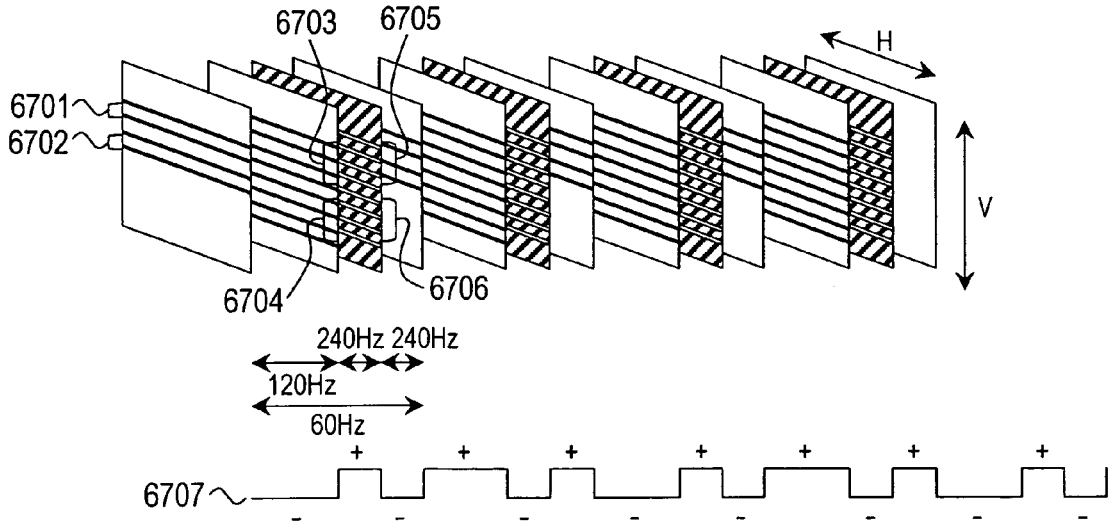
FIG. 53 is an explanatory diagram showing the arrangement of scanned screens and the polarities in writing when different types of scanning are performed between two subfields according to the eleventh example of the present invention.

In scanning shown in FIG. 53, one frame is divided into three sub-fields. An image is written in a first sub-field by the two-line synchronous writing and the two-line interlace scanning. An image is written in a second sub-field by the four-line synchronous writing and the four-line interlace scanning. Black data is written in a third sub-field by the four-line synchronous writing and the four-line interlace scanning.

Figure 67:
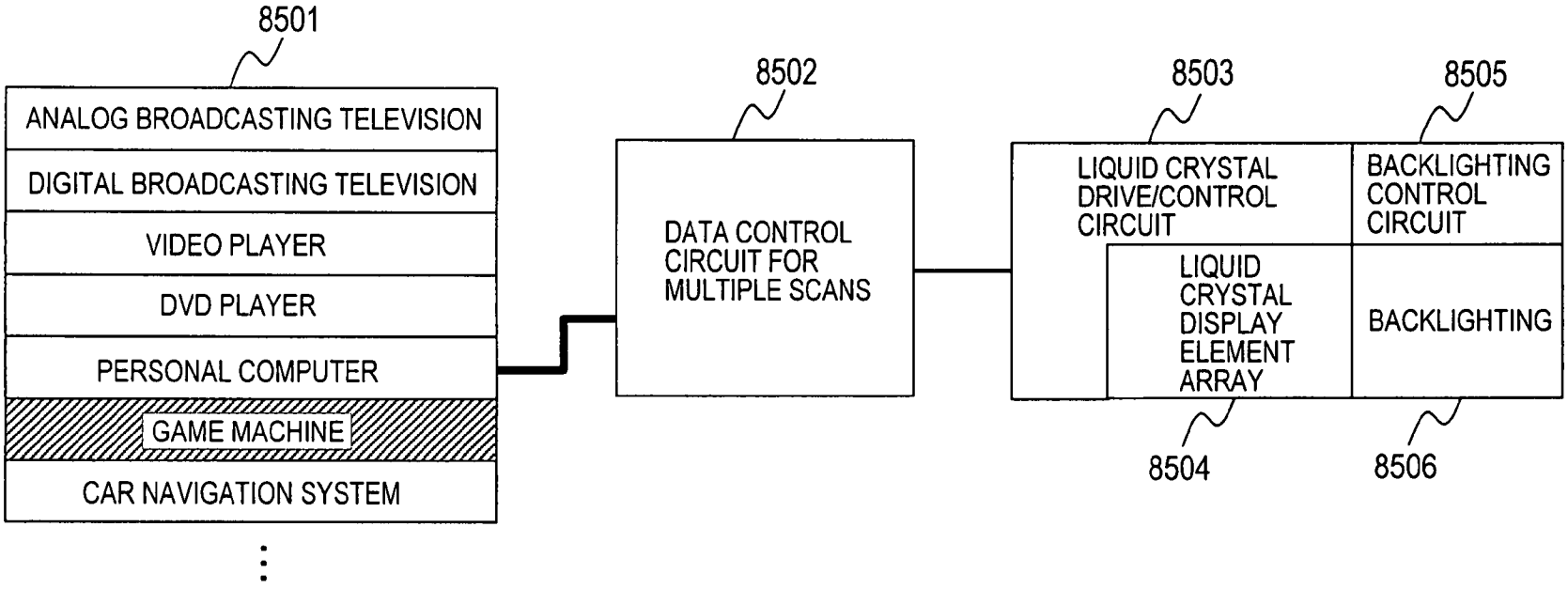
FIG. 67 is a diagram showing the configuration of a display device compliant with a video multi-format according to the twenty first example of the present invention.

FIG. 67 includes a current scanning line group 6701 including two lines, and a next scanning line group 6702 including two-lines, both of which are in the first sub-field and are adjacent to each other. FIG. 67 further includes a current scanning line groups 6703 including four lines and a next scanning line group 6704 including four lines, both of which are in the second sub-field. FIG. 67 further includes a current scanning line group 6705 including four lines and a next scanning line group 6706 including four lines, both of which are in the third sub-fields. Furthermore, FIG. 67 includes a polarity inversion waveform 6707 of a signal input to the drain line drive circuit. The polarity is inverted such that images are written in the first and the second sub-fields by always having the opposite polarity against each other. This can prevent flicker occurring during the moving picture display. For example, in order to increase the transmissivity of a liquid display element in the normally white mode by using higher effective value voltage, the difference in writing polarities may occur easily. As a result, the flicker may occur during the moving picture display. Also, in this case, the frequency for black writing is 60 Hz, and the polarity inversion frequency is 30 Hz. Thus, the current voltage is not applied during the black writing. Therefore, the moving picture display can be performed with fewer direct current afterimages and less flicker.

Twelfth Example

Figure 54:
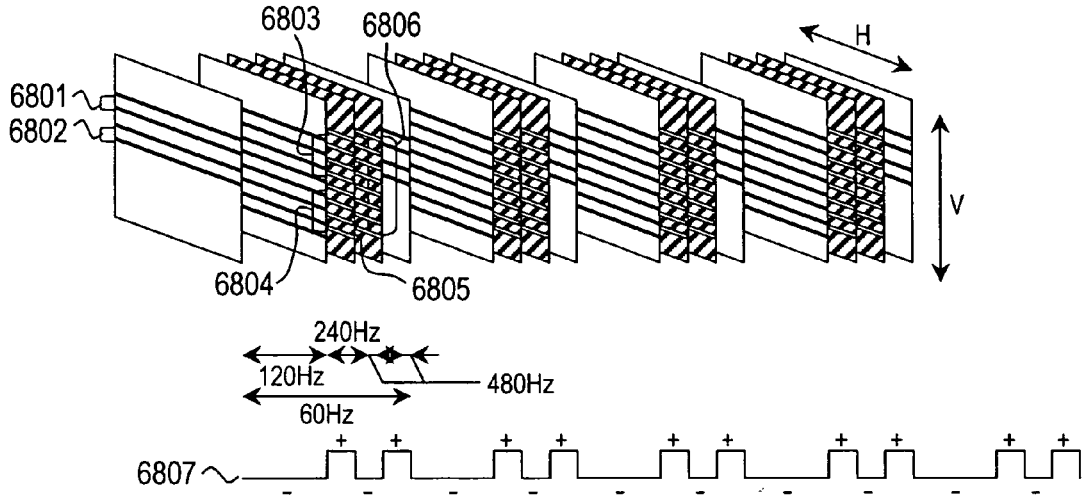
FIG. 54 is an explanatory diagram showing the arrangement of scanned screens and the polarities in writing when different types of scanning are performed between two subfields according to the twelfth example of the present invention.
Figure 68:
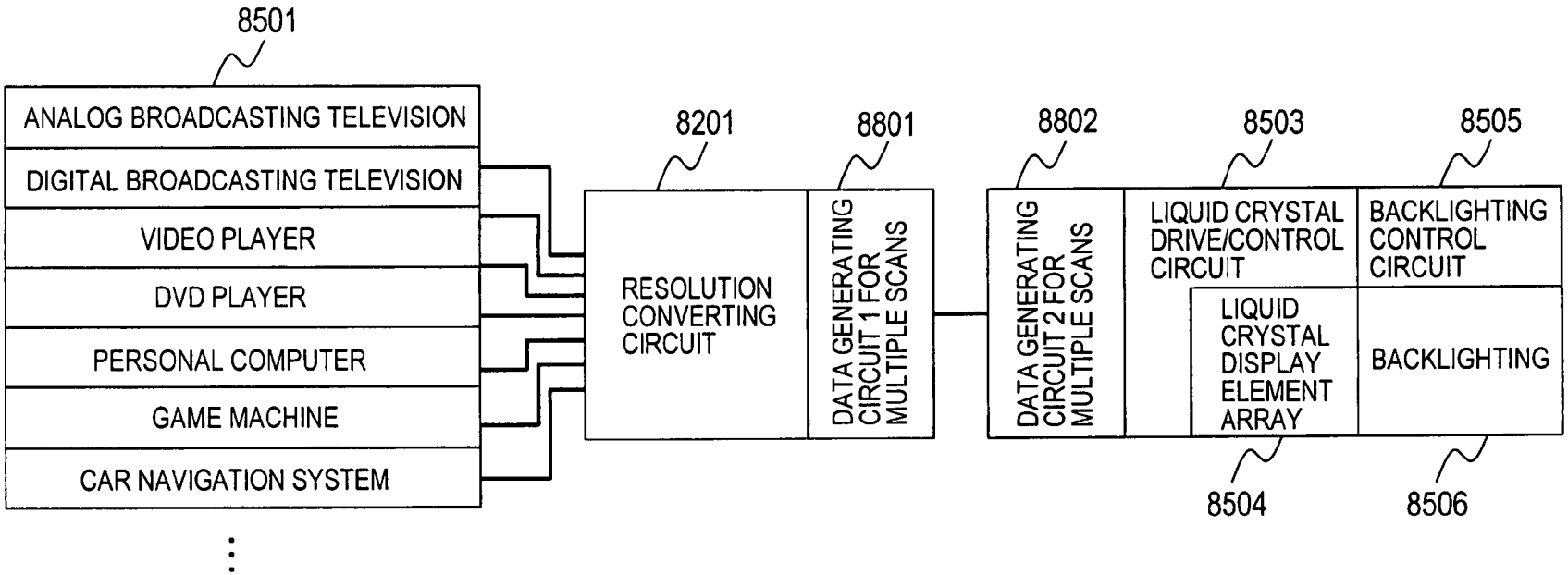
FIG. 68 is a diagram showing the configuration of a display device compliant with a video multi-format according to the twenty second example of the present invention.

FIG. 54 shows an example where one frame is divided into four sub-fields subject to different scanning methods, respectively. FIG. 68 includes a current scanning line group 6801 including two lines, and a next scanning line group 6802 including two-lines, both of which are in the first sub-field. FIG. 68 further includes a current scanning line group 6803 including four lines and a next scanning line group 6804 including four lines, both of which are in the second sub-field. FIG. 68 further includes a current scanning line group 6805 including eight lines in the third sub-field and a next scanning line group 6806 including eight lines and in the fourth sub-field.

Video data is written in the first sub-field by the two-line synchronous writing and the two-line interlace scanning from the current scanning line group 6801 to the next scanning line group 6802. Thus, the scanning completes ½ of the frame cycle. Video data is written in the second sub-field by the four-line synchronous writing and the four-line interlace scanning from the current scanning line group 6803 to the next scanning line group 6804. Thus, the scanning completes ¼ of the frame cycle. In each of the third and fourth sub-fields, the blanking data display scanning completes by the eight-line synchronous writing and the eight-line interlace scanning in ⅛ of the frame cycle.

FIG. 68 includes a polarity inversion waveform 6807 of a signal input to the drain line drive circuit. The first and the second sub-fields are scanned with the polarity, which is opposite against each other. This is because, like the case in the thirteenth example, the difference in writing polarity may occur easily when the transmissivity of the liquid crystal is increased by using the higher effective value voltage. Since the black data writing polarity completes in one frame, the application of the direct current voltage does not occur. Thus, moving pictures can be displayed with fewer direct current afterimages and less flicker.

Thirteenth Example

Figure 55:
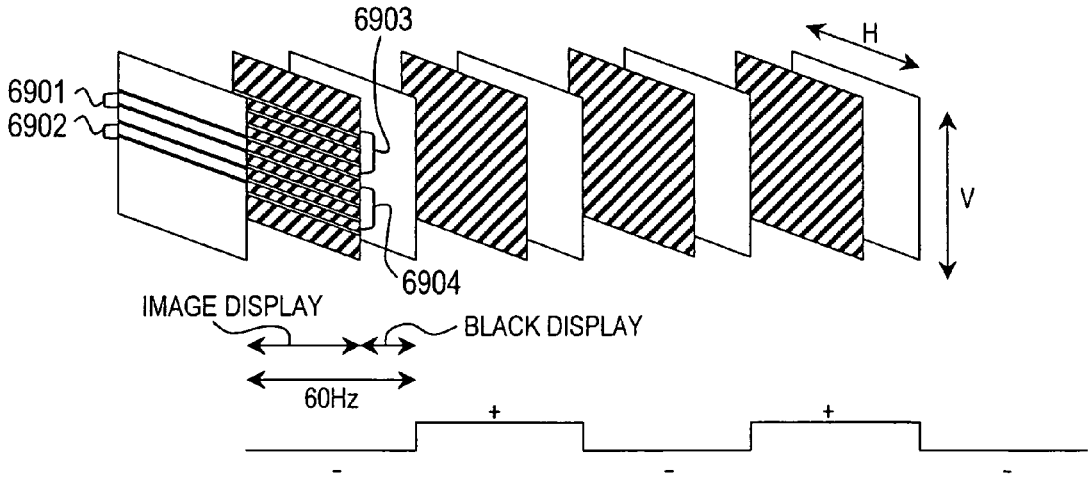
FIG. 55 is an explanatory diagram showing the arrangement of scanned screens and the polarities in writing when different types of scanning are performed between two subfields according to the thirteenth example of the present invention.

FIG. 55 shows another case of image and black display. In this case, one frame is divided into tow sub-fields. An image is displayed in a first sub-field by the two-line synchronous writing and two-line interlace scanning. Black display is performed on a second sub-field by the four-line synchronous writing and four-line interlace scanning. FIG. 55 includes a current scanning line group 6901 including two lines and a next scanning line group 6902 including two-lines, both of which are in the first sub-field. FIG. 55 further includes a current scanning line group 6903 including four lines and a next scanning line group 6904 including four lines, both of which are in the second sub-field. Thus, the scanning of the first sub-field completes in half of one frame, and the scanning of the second sub-field completes in ¼ of one frame. Therefore, ¼ frame scanning period remains.

This embodiment has a feature that the remained ¼ frame scanning period is assigned to the liquid crystal response time rather than assigning to the scanning period as in the above described examples. This embodiment is an example of liquid crystal, which is fast to respond to black but slow to halftones. In this case, when the blanking data in the second sub-field is scanned after the image is written in the first sub-field, the liquid crystal can hardly respond thereto, resulting in insufficient display. Therefore, the ¼ frame period scanning is interrupted after scanning the first sub-field, which provides a response time. Then, the sub-field scanning is performed on the second blanking data display in the ¼ frame period. By doing this, ½ of the vertical resolution can be maintained, and also the difference between the black response and the halftone response of the liquid crystal can be reduced. Therefore, the characteristic of the moving picture display can be improved.

Fourteenth Example

Here, scanning can be performed with dot inversion driving where one frame is divided into two sub-fields by the two-line synchronous writing and the two-line interlace scanning. The writing polarity is always inverted between sub-fields, between lines and between adjacent pixels. In this case, the sub-field frequency is 120 Hz, which is double so that the polarity inversion frequency is 60 Hz. Thus, the voltage difference in writing effective values between polarities can be hardly recognized as flicker.

Figure 56:
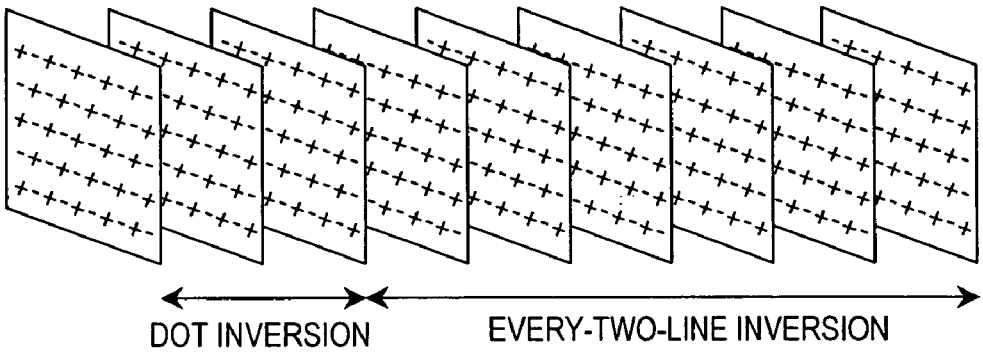
FIG. 56 is an explanatory diagram showing the arrangement of scanned screens when full-time dot inversion driving is switched to every-two-line inversion driving according to the fourteenth example of the present invention.

FIG. 56 shows scanning where the dot inversion driving described above is switched to every-two-line inversion driving at certain timing. The inversion frequency of each pixel is 60 Hz because the sub-field frequency is 120 Hz. Therefore, even when the polarity is inverted for every two lines, the voltage difference in writing effective values between polarities can be hardly recognized as flicker. As a result, the line alternating current frequency can be decreased, which can reduce the power consumption.

Alternatively, the dot inversion driving can be switched to every-three-line inversion driving at certain timing. Also, the dot inversion driving can be switched to every-column inversion driving at certain timing. Also in these cases, the polarity inversion frequency is 60 Hz. Thus, even when the line alternating current frequency is decreased as above, the voltage difference in writing effective values between the polarities can be hardly recognized as flicker. Therefore, the power consumption can be reduced.

Fifteenth Example

Alternatively, scanning can be performed with common inversion driving. In this case, one frame is divided into two sub-fields by the two-line synchronous writing and the two-line interlace scanning. The writing polarity is always inverted between sub-fields and between lines. The sub-field frequency is 120 Hz, which is double. Then, the polarity inversion frequency is 60 Hz. Thus, the voltage difference in writing effective values between polarities can be hardly recognized as flicker.

Figure 57:
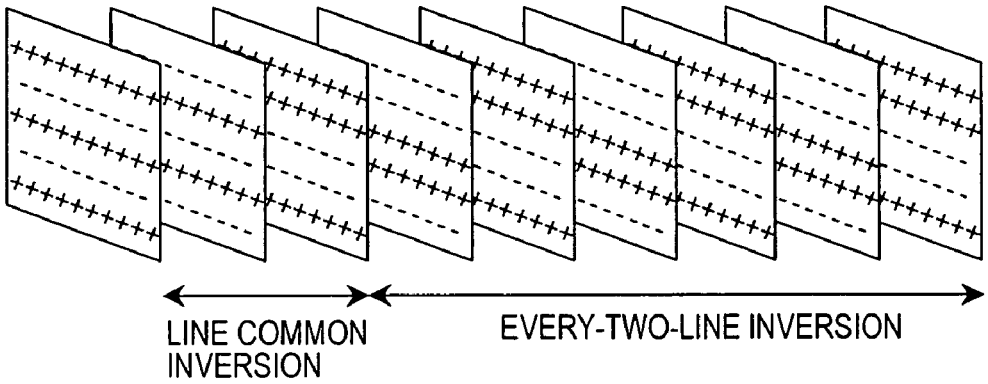
FIG. 57 is an explanatory diagram showing the arrangement of scanned images when the full-time line common inversion drive is switched to every-two-line common inversion drive according to the fifteenth example of the present invention.

FIG. 57 shows scanning where the above common inversion driving is switched to every-two-line common inversion driving at certain timing. The inversion frequency of each pixel is 60 Hz because the sub-field frequency is 120 Hz. Therefore, even when the polarity is inverted for every two lines, the voltage difference in writing effective values between polarities can be hardly recognized as flicker. As a result, the line alternating current frequency can be decreased, which can reduce the power consumption.

Alternatively, scanning where the common inversion driving can be switched to every-three-line inversion driving at certain timing. Or, the common inversion driving can be switched to every-frame inversion driving at certain timing. Also in these cases, the polarity inversion frequency is 60 Hz. Thus, even when the line alternating current frequency is decreased as above, the voltage difference in writing effective values between the polarities can be hardly recognized as flicker. Therefore, the power consumption can be reduced.

In addition, a drain driver having lower pressure-resistance can be used because of the common inversion driving. Thus, a liquid crystal display can be constructed at the lower costs.

Second Embodiment

A second embodiment of the present invention will be described below.

According to the system described in the first embodiment, blanking is performed in one frame period, the brightness of the image is reduced. Furthermore, the backlighting is maintained ON during the blanking by black writing, the efficiency of light-emitting is decreased. Accordingly, in this embodiment, the lighting of the backlighting is controlled in order to improve the problem, in addition to the first embodiment.

Figure 18:
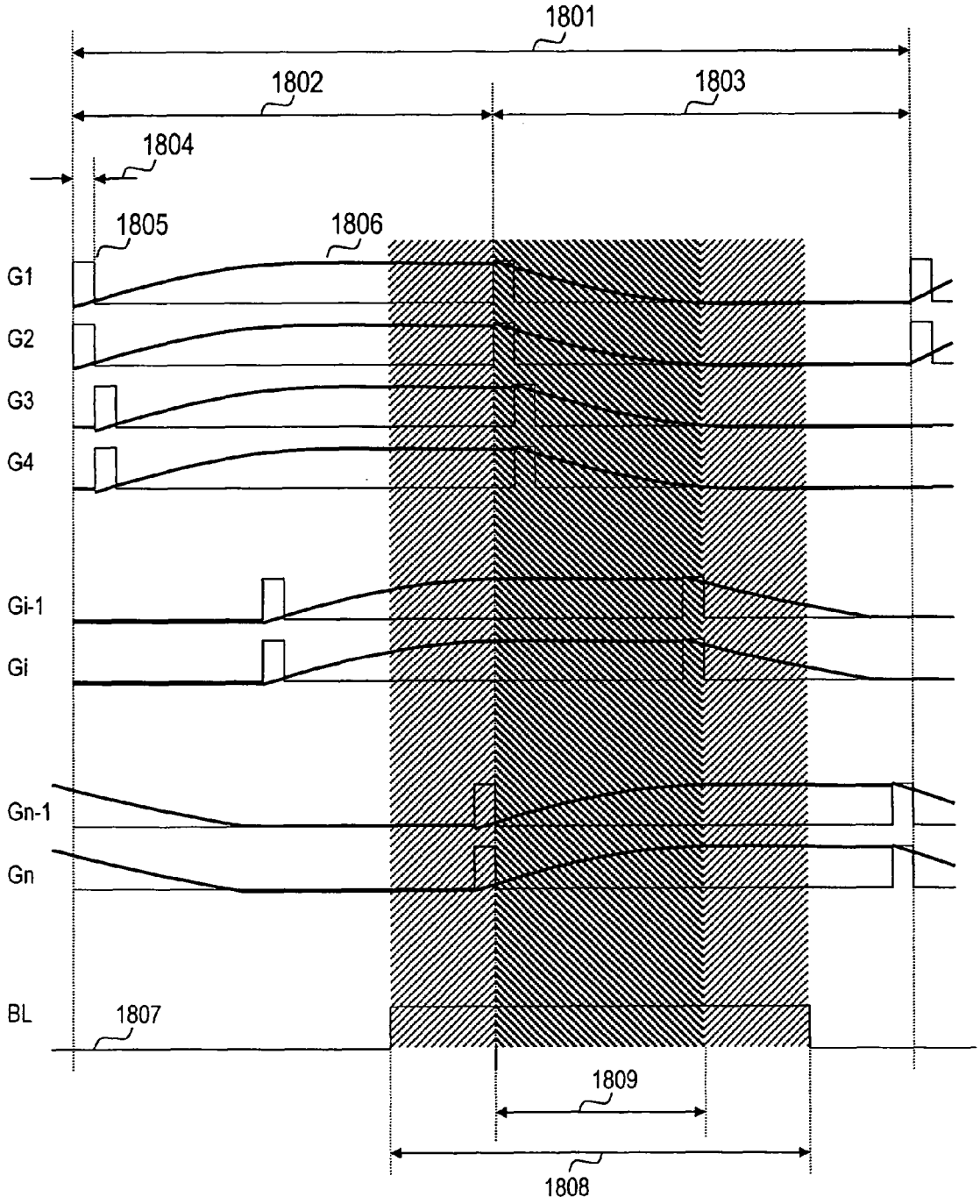
FIG. 18 is a timing chart for gate select pulses (gate line drive signals) and backlighting blinking for two-line synchronous writing and two-line interlace scanning according to the second embodiment of the present invention.

FIG. 18 shows waveforms of gate drive signal lines of the display array and lighting timing for the backlighting during the two-line synchronous writing and the two-line interlace scanning. FIG. 18 includes a frame cycle 1801, an image writing period 1802 for half of the frame cycle 1801, a blanking writing period 1803 for half of the frame cycle 1801, a one-line select period 1804, a pulse 1805 of a gate drive signal, an optical response 1806 of liquid crystal, and lighting timing 1807 for the backlighting. Also in this embodiment, the liquid crystal is assumed to be in normally black mode. The lighting timing 1807 for the backlighting is turned ON at the High level and OFF at the Low level.

The arrangement of a lamp included in the backlighting may be of the side light type that the lamp is located at the above and the bottom or at the side of the cabinet. Alternatively, the lamp may be located directly at the back of the display array, which is called directly-under type. In the former case, the cabinet can be designed thinner, which is often used for notebook personal computers. The latter facilitates the higher brightness, which is suitable for the liquid crystal display array having a lower aperture ratio. In this embodiment, the underneath type will be described in view of the higher brightness.

As shown in FIG. 18, the gate lines are selected sequentially from the adjacent gate lines G1 and G2. Then, when an image is written, the liquid crystal responds to the lines in which writing has been completed sequentially through several ms to several tens of ms.

In this embodiment, flashing of the backlighting is controlled. However, when the backlighting is turned off, the brightness is naturally reduced more. Then, in view of an amount of the brightness, which is reduced due to the black data scanning and the backlighting shutoff, the tube current in the lamp is increased in order to improve the brightness. Desirably, the light-emitting characteristic of the lamp reaches the desired brightness in a short period of time and has short persistence. In reality, the tube current in the lamp is limited, and a large amount of tube current cannot be flown so much in view of the life. The light emitting and the persistence take the order of several ms. Thus, in this embodiment, the lighting period when the lamp tube current is increased is reduced to half of one frame period. Then, the lamp flashes once in one frame period. Alternatively, the directly-under type of multiple lamps may be controlled to flash at timing shifted sequentially with respect to each other. However, as described above, it is difficult for the lamp to emit light instantly. Then, the effect of timing shift cannot be expected. Thus, all of the multiple lamps are flashed at the same timing. More specifically, all of the multiple lamps are lighted during the period when there are the optical responses in all of the lines.

FIG. 18 further includes a lighting period 1808. When the lighting-on and the shutoff are repeated at such timing, the period when the responses have been just completed becomes longer. Then, clear and bright images are displayed at the center of the screen.

When more brightness can be obtained by flowing more tube current in the lamp, the shorter lighting period 1809 may be obtained. Thus, the lamp is shut off completely during the black display. In addition, the lamp is lighted on after the completion of the responses. As a result, the center of the screen has more clearness, which can improves the efficiency of the light emitting by the lamp.

Also, in view of the temperature characteristic of the lamp, the lamp is cooled down because the back light is shut off. Thus, there is an advantage of preventing the brightness from being reduced due to the temperature increase.

FIGS. 19A and 19B show an example where the backlighting is controlled to light on when an image having a different aspect ratio from that of a display array is displayed in the display array. FIG. 19A is an example where an image having an aspect ratio from that of the display array is displayed by using the method in FIG. 12B. The invalid display area is padded by blanking data. FIG. 19B is the directly-under type of backlighting provided on the back of the display array. Six lamps are provided, which can be controlled independently. In FIGS. 19A and 19B, the invalid display area padded by black is not lighted because the backlighting does not need to be lighted on. In other words, the upper and the lower two lamps are shutoff, while only the center four lamps needs to be lighted on. During this period, the power consumption by the backlighting can be reduced, which improves the light-emitting efficiency.

The backlighting controls in this embodiment can be switched easily by attaching the control information to the image as shown in FIG. 16 described in the first embodiment. In this case, parameters as shown in FIG. 20 may be provided in advance. In other words, the timing generating circuit 103 for multiple scans in FIG. 1 receives image data to which backlighting control information is attached from the data generating circuit 102 for multiple scans in order to switch the controls over each of the lamps through the backlighting control bus 111. In this case, the control information may be that the first and the sixth lamps are always shutoff while the second to the fifth lamps are controlled to flash at timing in FIG. 18.

Such controls may not function in the side-light type of display device for achieving thinner designs such as notebook personal computers. However, the flashing control is possible at the timing in FIG. 18 collectively. Therefore, the application of the flashing control for backlighting is possible.

In this way, the backlighting may be controlled to light on in consideration of the blanking display period or the display area. Thus, the display device having the better moving picture display characteristic and the better light emitting efficiency can be obtained.

Next, variation examples according to the above-described second embodiment will be described.

Sixteenth Example

Figure 58:
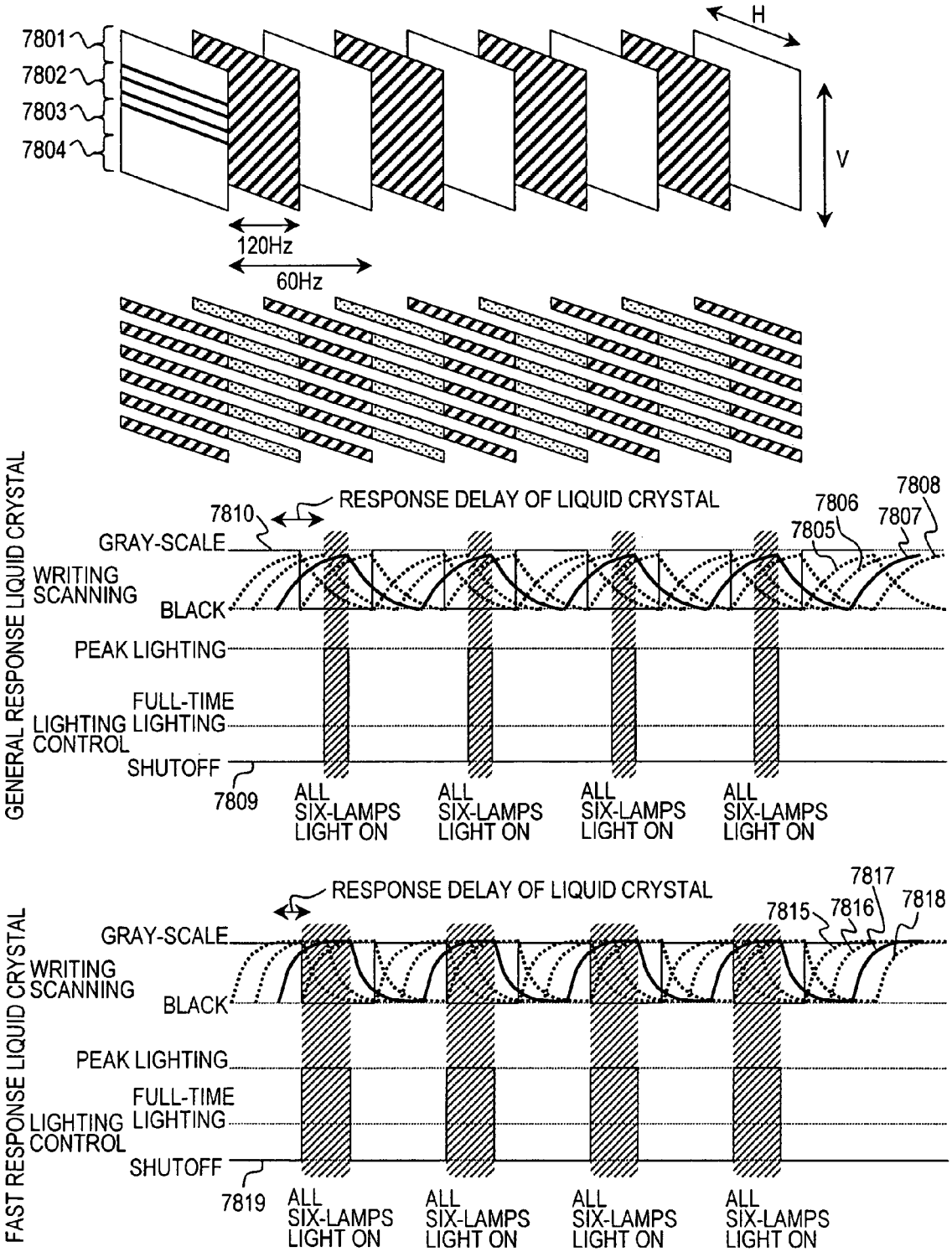
FIG. 58 is an explanatory diagram showing a relationship between the arrangement of scanned screens into which ½ black displays are inserted and the control over backlighting lighting when scanned at 120 Hz according to the sixteenth example of the present invention.

FIG. 58 shows an example of the control over the backlighting flashing. In this case, one frame is divided into two sub-fields by the two-line synchronous writing and two-line interlace scanning, and scanning for blanking display is performed on one of the sub-fields at the same time. The detail of the control over the backlighting flashing is described in the SID01 DIGEST p. 990-993. FIG. 58 includes areas 7801 to 7804, which are obtained by dividing the display area. When an image is written in a first sub-field and black data is written in a second sub-field, the display areas 7801 to 7804 respond in order of scanning by using the response characteristic 7805 to 7808, respectively. In this case, when the display area 7803 is focused as an example, the transmissivity response by the liquid crystal is substantially completed at the middle point of time of the black writing in the next sub-field after scanning the display area 7803. Thus, the backlighting is lighted on at the timing or at the point of time when the second sub-field writing is started and the center is being scanned. It should be noted that the backlighting in FIG. 58 is assumed to have the directly-under type of six lamps. Therefore, all of the six lamps are lighted on at the same time.

Next, when black data is written in the second sub-field, black data is written in the focused display area 7803 after the scanning on the display areas 7801 and 7802. The black display does not have to wait until the responses complete. The backlighting may be shutoff immediately after the black data is written so as to obtain the same effect. However, this process is possible when flashing the backlighting is sufficiently faster than the transmissivity response of the liquid crystal.

Accordingly, by controlling the waveform of flashing the backlighting to be as the waveform 7809, an image in the middle of the responding step is not displayed in the display area 7803. Then, the black response become equal to the shutoff speed, which can provide sharper moving pictures.

Next, the other display areas 7801, 7802 and 7804 are focused. First of all, the display areas 7801 and 7802 shift to the level substantially near black even during the lighting period. Thus, the blanking effect can be obtained. The display area 7803 also has substantially the desired transmissivity. Therefore, sharpness of the image is maintained.

In the example in FIG. 58, the timing of lighting backlighting may be waited until the responses complete so as to reduce the lighting period as much as possible. Then, the sharpness of the images may be further improved. However, since the brightness cannot be obtained, the backlighting is controlled based on the point compromised by both of them in reality. In addition, when fast responsive liquid crystal is used, the timing for backlighting control is as follows:

The display areas 7801, 7802, 7803 and 7804 have the transmissivity response waveforms 7815, 7816, 7817 and 7818, respectively, of the fast responsive liquid crystal. Similarly, when the display area 7803 is focused, the response to the image written in the first sub-field substantially completes in the first half of the second sub-field based on the corresponding response waveform 7817. Therefore, the backlighting is lighted on at the timing. The backlighting is shut off in timing when black writing is started in the second field of the display area 7803. In other words, the lighting is controlled based on the control timing waveform 7819 for the backlighting.

Now, the display areas 7801, 7802 and 7804 other than the display area 7803 are focused. During the backlighting lighting period of the transmissivity responses waveforms 7815 and 7816 corresponding to the display areas 7801 and 7802, the liquid crystal responses at a level near the black. The response of the liquid crystal is fast in the display area 7804 based on the corresponding transmissivity response wave form 7818. The transmissivity is substantially near the desired transmissivity. This means that the moving images can be displayed more clearly as the response is faster.

The backlighting is desirably shut off when the black writing sub-field scanning starts in order to obtain the black level response faster. Thus, when the faster responsive liquid crystal is used, the backlighting can be lighted earlier. Thus, the lighting period can be longer. In other words, the lighting duty can be longer. Therefore, the peak lighting level can be kept lower.

Seventeenth Example

FIG. 59 shows an example of the control over the backlighting flashing. At the same time, one frame is divided into sub-fields by the two-line synchronous writing and the two-line interlace scanning, and black display scanning is performed on the upper and the lower halves of the sub-field screen alternately.

In this example, the backlighting has six lamps. The peak brightness and the lighting period of each lamp can be controlled independently.

FIG. 59 includes areas 7901 to 7904, which are obtained by dividing the display area into four. Here, it is assumed that an image is written in the upper half and black data is written in the lower half of the first sub-field, respectively. On the other hand, black data is written in the upper half and an image is written in the lower half of the second sub-field, respectively. FIG. 59 further includes ideal response waveforms 7911 for writing in the upper half and 7912 for writing in the lower half of the screen, respectively. Here, the display area 7901 responds by using the response characteristic 7905. The display area 7902 responds by using the response characteristic 7906. The display area 7903 responds by using the response characteristic 7907. The display area 7904 responds by using the response characteristic 7908. They respond in order of scanning. In this case, focusing on the display area 7902, when image data is displayed on the upper half of the screen by the first sub-field scanning, the transmissivity response 7906 of the liquid crystal is substantially completed at the second half point of time of the current sub-field after scanning the display area 7902. Therefore, the upper three lamps of the backlighting are lighted on at the timing. Black data is written in the display area 7903 in the current sub-field scanning.

In the second sub-field scanning, black data is written in the upper half and the image data is written in the lower half. Therefore, the upper three lamps of backlighting are synchronously shut off in the display area 7902 immediately after writing black data therein. Now, the display area 7903 is image written area. After scanning the display area 7903 by image data, the response is completed substantially at the middle point of the next black data writing sub-field based on the liquid crystal response waveform 7907 of the display area 7903. Thus, the lower three lamps of the backlighting are synchronously lighted on at the timing. Then, the lower three lamps of the backlighting are controlled to synchronously shut off when the scanning on the black writing sub-field of the display area 7903 is started. Lighting control waveforms 7909 is of the upper three lamps and lighting control waveforms 7910 is of the lower three lamps, respectively, of the backlighting which is just stated above.

The feature of this example is that the upper display area formed by the upper half of the screen and the upper three lamps of backlighting and the lower display area formed by the lower half of the screen and the lower three lamps of backlighting are controlled independently at different timing from each other. In the case of all lighting as shown in FIG. 58, the lighting cannot be synchronized for only one display area in the entire screen. However, in this example, the lighting can be synchronized for each of the upper and the lower display areas. Therefore, wider areas having the same lighting timing can be obtained. In other words, the image reconstructed on the upper display area becomes sharper after the responses because of the liquid crystal transmissivity response waveforms 7905 and 7906 and the backlighting lighting waveform 7909 of the display areas 7901 and 7902. In the same manner, the sharper image can be obtained on the lower display area because of the liquid crystal transmissivity response waveforms 7907 and 7908 and the backlighting lighting waveform 7910 of the display areas 7903 and 7904.

The number of lamps to be lighted on at a time is half of that in FIG. 16. Therefore, more peak current can be flown. Thus, it is advantageous to improve the lighting efficiency of the backlighting.

Eighteenth Example

FIGS. 60A to 60D show an example where one frame is divided into two sub-fields by the two-line synchronous writing and the two-line interlace scanning, and a liquid crystal faster responsive filter or a brightness compensating filter is applied to one of the sub-fields. In this case, the lighting of the backlighting is also controlled at the same time.

The backlighting in this example has six lamps, and the lighting of those lamps is controlled at the same time.

In FIG. 60, 8001 to 8004 are areas obtained by dividing the display area into four, each of which indicates those areas from top to bottom. As shown in the figure, when the halftone is varied from dark to bright, an image derived by the liquid crystal fast responsive filter is inserted to the first sub-field 8021 of the frame in which the image is varied. As a result, an ideal transmissivity response 8010 of the liquid crystal can be obtained. In reality, response waveforms 8005 to 8008 can be obtained in the display areas 8001 to 8004, respectively, which increase the speed.

Third Embodiment

A third embodiment of the present invention will be described below.

As described in the first embodiment, the display by the two-line synchronous writing and the two-line interlace scanning cannot reconstruct half of the vertical scanning lines of an original image. It is apparent from FIG. 14 that the image can be reconstructed on the display array without any lack of the original image information even by the two-line synchronous writing and interlace scanning when the image has sufficiently low, more specifically, half of the resolution or below than that of the display array. On the other hand, when the image signal has more resolution than the half of the resolution of the display array, the image information has to be reduced. Alternatively, in that case, the scanning and the display mode have to be switched back to the conventional every line scanning and the hold type of display mode. The former may produce higher image quality in the moving picture display but the vertical resolution of a still image may be reduced. In the latter case, the opposite may occur. In this embodiment, a method is provided for improving the performance of displaying moving images by using the blanking effect and for displaying loss-less image information at the same time.

The data transfer band of currently available drain line drive circuits (drain driver IC) is as low as about 50 MHz. When an XGA display array is driven by using the drain driver IC, at least 60×768×1024 □ 47 MHz is required. Thus, there is no margin for the band for transferring driver data. Then, currently, products are manufactured which have a construction having data buses for two pixels so as to reduce the transfer rate to half. Especially, for the monitor application, the XGA standard of VESA is required for supporting the dot clock, the order of 80 MHz. However, there are different monitor standards for the digital broadcasting and NTSC. In addition, images are displayed on a liquid crystal display array by using a unique signal processing circuit. As a result, it is not limited by a transfer method. The inventor focused on that point and proposed a method for using the data transfer band of the drain driver IC to be used to the maximum.

As described above, the drain driver IC has data transfer buses for two pixels. Thus, when data is transferred at 47 MHz, two screens can be scanned at 60 Hz. By using this, the scanning for another one screen can be assigned to blanking. As a result, the moving picture display performance can be improved without losing the vertical resolution.

Figure 21:
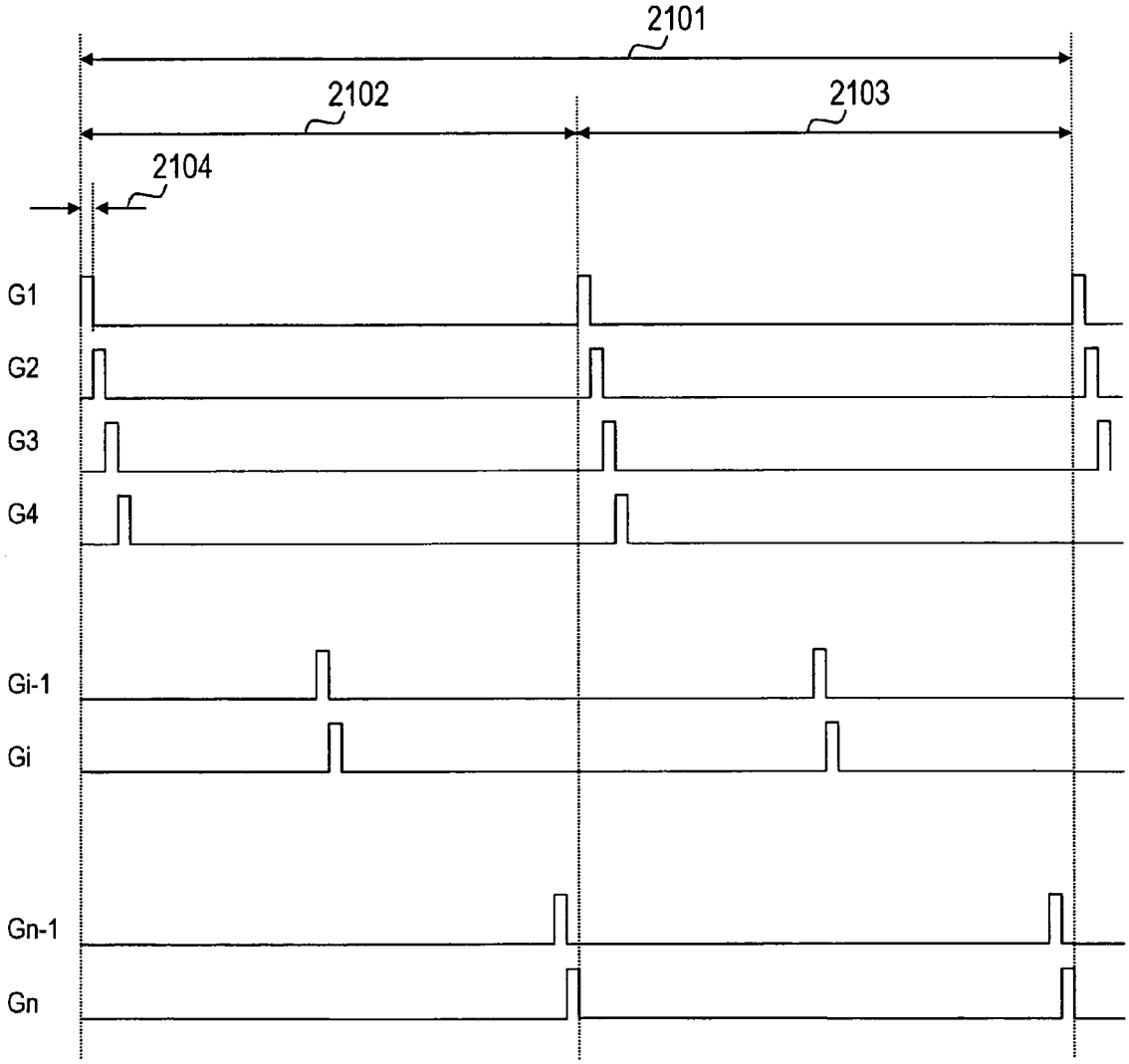
FIG. 21 is a waveform diagram for a gate line drive signal when scanning is performed line by line according to a third embodiment of the present invention.
Figure 22:
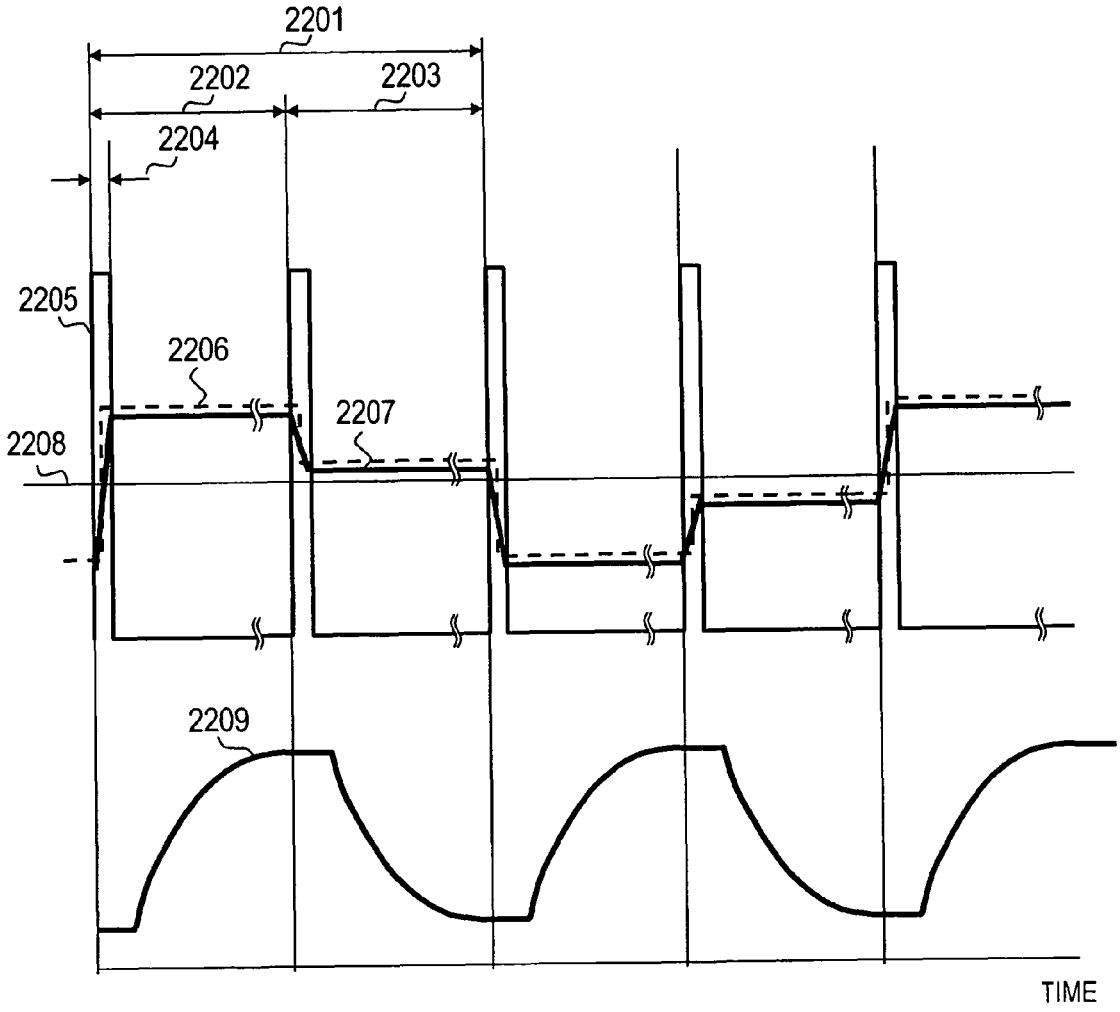
FIG. 22 is a diagram showing a signal line drive waveform and a liquid crystal optical response waveform when scanning is performed line by line according to the third embodiment of the present invention.

FIG. 21 shows waveforms of gate line drive signals, that is, a timing chart of gate select pulses according to this embodiment. FIG. 21 includes a frame cycle 2101, an image writing period 2102, which is half of the frame cycle 2101, a blanking period 2103, which is half of the frame cycle 2101, and one line writing period 2104. In this case, two screens are scanned by the scanning for one line in one frame period. As a result, the one line writing period is reduced to about half. Thus, in this embodiment, as shown in FIG. 22, the frame cycle is used as the polarity inversion cycle. In other words, the polarity is inverted when the image scanning and the blanking scanning are completed, which can improve the writing efficiency. FIG. 21 includes a frame cycle 2201, an image writing period 2202, which is half of the frame cycle 2201, a blanking data writing period 2203, which is half of the frame cycle 2201, a gate select period 2204 for one line, a waveform 2205 for a gate line drive signal, a waveform 2206 for drain line drive signal, a source voltage waveform 2207, a common level 2208, and an optical response waveform 2209 of liquid crystal. The difference voltage between the common level 2208 and the source voltage 2207 is applied to the liquid crystal, the polarity is inverted in one frame cycle. In this case, the optical response waveform 2209 is in normally black mode. Because of the driving, the optical response waveform 2209 exposes the impulse type in which the image display and a response to blanking are performed in one frame period. Therefore, the moving picture display characteristic can be improved.

When this embodiment is combined with the backlighting system according to the second embodiment, the moving picture display can be clearer. Then, the performance can be improved in addition to the improvement in the light-emitting efficiency.

Unlike the first embodiment, data is not written in multiple lines synchronously, the image information of an original image does not have to be lost. Therefore, the vertical resolution is not reduced. In this point of view, the image quality can be more improved.

When this embodiment and the first embodiment are combined, the moving picture performance can be more improved. This is because four screen scans can be performed within one frame period by performing the two-line synchronous writing and the two-line interlace scanning. In the case of a still image, a detail of the image is reconstructed with higher vertical resolution. In the case of images having fast movement, the resolution is obtained in the time direction and the control for improving image quality through the processing using the fast response liquid crystal filter becomes possible. Especially, the holding characteristic tends to be deteriorated when the response speed of a liquid crystal material itself is increased from several ms to several tens of ms. Thus, the response speed cannot be increased significantly. In addition, in the case of personal computers and so on, the better holding characteristic is preferred because flicker is hardly occur.

When four-screen scanning is possible in one frame period, the first two screens may be assigned to image writing and the next two screens may be assigned to blanking. Furthermore, the first screen scanning for image writing may be assigned to the processing by the fast response filter and the processing may be returned at the next image scanning. Thus, the impulse type of driving having virtually faster response can be achieved. Since the faster response filter can be implemented by using smaller circuit since the image next to the blanking always comes after black data. Furthermore, if images are written with different polarities in the above-described image-writing period, the polarity inversion can be completed in each of the image writing and blanking. Therefore, target voltage can be always applied to liquid crystal, which can suppress the deterioration of liquid crystal.

Figure 23:
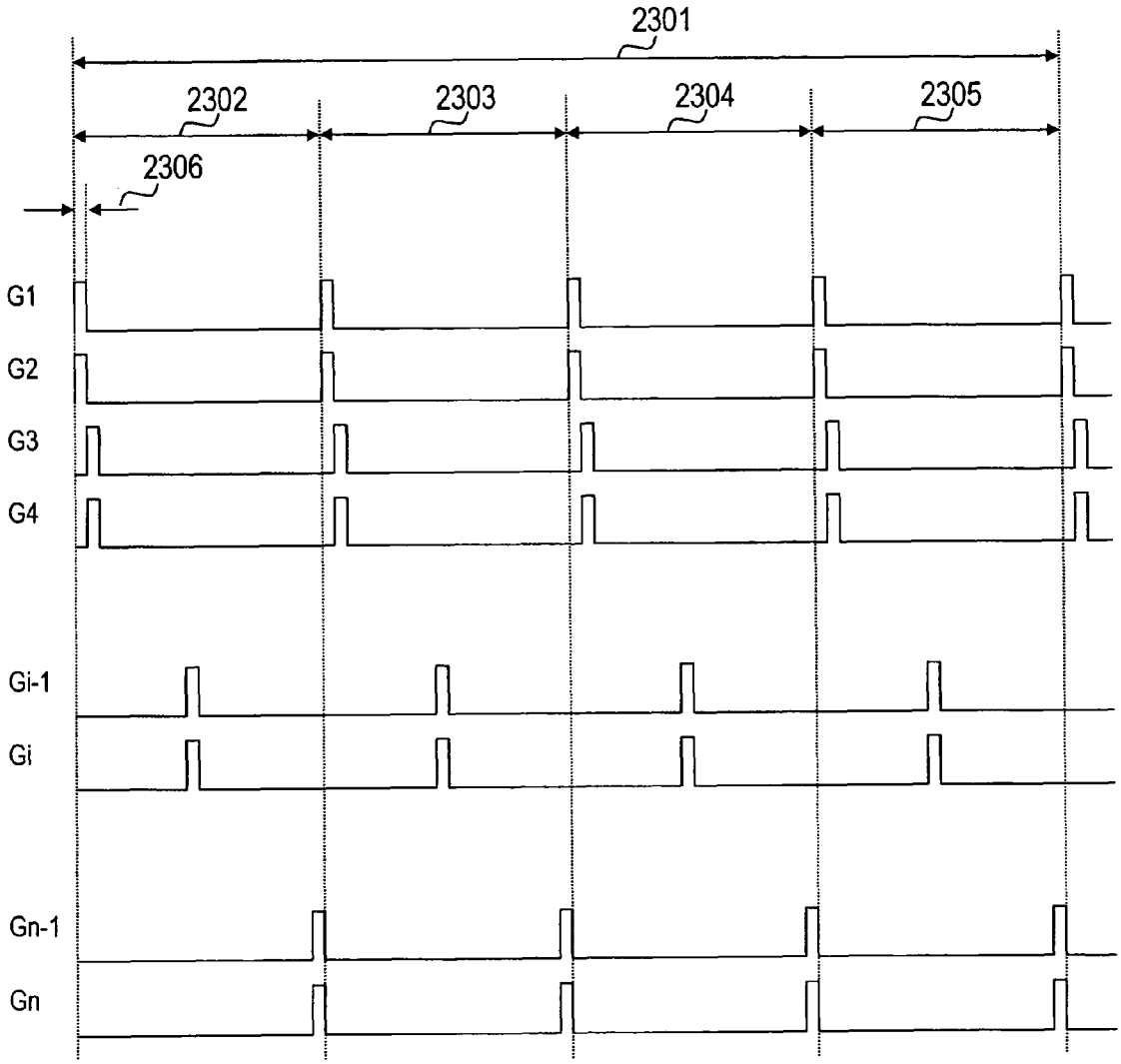
FIG. 23 is a waveform diagram of a gate line drive signal for two-line synchronous writing and two-line interlace scanning according to the third embodiment of the present invention.

FIG. 23 shows waveforms of gate line drive signals, that is, a timing chart of gate select pulses according to this embodiment. FIG. 23 includes a frame cycle 2301, an image writing period 2302, which is quarter of the frame cycle 2301 and in which the response speed of the liquid crystal is increased, an image writing period 2303, a first blanking writing period 2304, a second blanking writing period 2305, and a gate selecting period 2306, which is about half of the normal writing period.

Figures 24, 25:
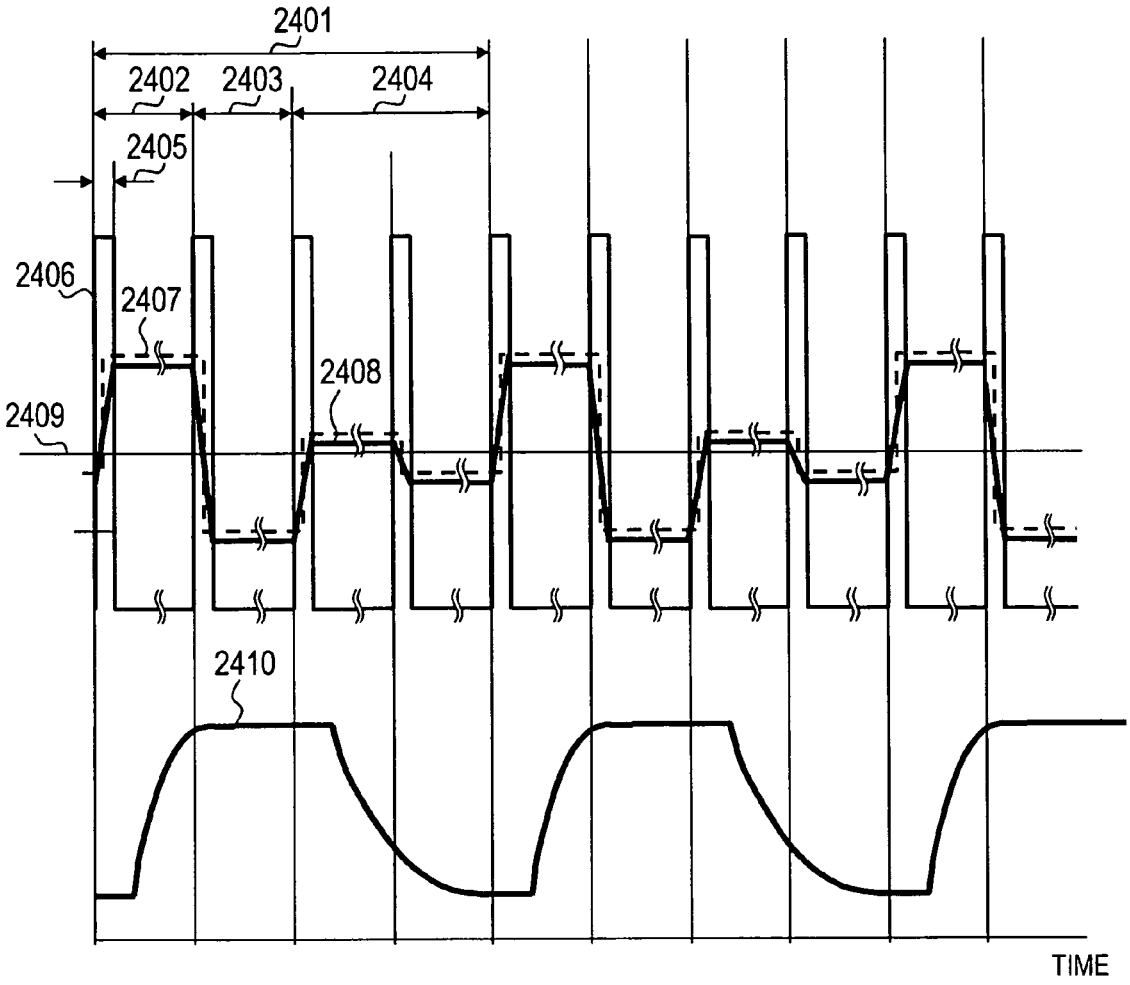
FIG. 24 is a diagram showing a signal line drive waveform and a liquid crystal optical response waveform for two-line synchronous writing and two-line interlace scanning according to the third embodiment of the present invention.
FIG. 25 is an explanatory diagram showing specific examples of control parameter and the values according to the third embodiment of the present invention.

FIG. 24 shows waveforms of driving signal lines. FIG. 24 includes a frame cycle 2401, a fast response period 2402, a settling period 2403, a blanking period 2404, a gate selecting period 2405, which is the same as the writing period, a waveform 2406 of a gate line driving signal, a waveform 2407 of a drain line drive signal, a source voltage waveform 2408, and common level 2409. The difference voltage between the voltage indicated by the source voltage waveform 2408 and the common level 2409 is applied to the liquid crystal. Furthermore, FIG. 24 includes a waveform 2410, which shifts to the transmissivity corresponding to the applied voltage. In this case, the normally black mode is assumed. Responses are always from the black revel in the liquid crystal fast response period 2402. Thus, the filter coefficient is set such that the voltage is higher than the liquid crystal voltage applied during the settling period 2403. As a result, the rising edge of the liquid crystal response waveform 2410 becomes faster, which can be improved to 4.2 ms to the fastest. On the other hand, the responses to the black blanking level cannot apply the voltage equal to or lower than that. Thus, using the liquid crystal, which responds to the black level fast but responds to the white level slowly, such as TN mode liquid crystal is more effective. The polarity of the waveform 2407 of the drain line drive signal is inverted for each ¼ frame in order to improve the writing efficiency by the reduced written period 2405 and in order to complete the polarity inversion cycle.

However, like the first embodiment, the vertical resolution is reduced according to this method. Therefore, a means is provided for switching between every line scanning for a still image and scanning according to this method for moving pictures. In the system block in FIG. 1, the data generating circuit 102 for multiple scans calculates a motion vector of images based on the pattern matching method or the gradient method. When a certain or more amount of motion is detected, the images are determined as moving images. Then, video data is generated for the two-line synchronous writing and interlace scanning and is transmitted to the timing generating circuit 103 for multiple scans.

Here, control information like that of the first embodiment is attached to the video data. Thus, the timing generating circuit 103 for multiple scans is controlled to generate gate pulses as shown in FIG. 23. Parameters as shown in FIG. 17 described in the first embodiment and parameters in FIG. 25 are provided for the control information. When the timing generating circuit 103 for multiple scans receives the vide data with the control information and generates timing for driving the display array by the fast transfer and the two-line synchronous writing. Then, as shown in FIG. 24, the moving images are displayed more clearly through the impulse driving, whose speed of the rising edge is increased.

When the data generating circuit 102 for multiple scans determines that the images have no motion, the data generating circuit 102 for multiple scans generates image data subject to every line scanning. Then, the data generating circuit 102 for multiple scans attaches, to the image data, control information to generate a gate pulse for the every line scanning shown in FIG. 21. The timing generating circuit 103 for multiple scans receives the image data and generates timing shown in FIG. 21 for driving display array in the fast transfer and in the still image mode. Then, the images are reconstructed and impulse-displayed by leaving the vertical resolution of the images as it is.

When the user always gives the priority for the vertical resolution, the scanning does not have to be switched to the two-line synchronous writing and interlace scanning even if the data generating circuit 102 for multiple scans determines that the images have motion. The types of scanning may be selected by using the control bus 109 in FIG. 1.

In addition, when this embodiment is combined with the backlighting control in the second embodiment, moving pictures may be displayed more clearly because of the blanking effect through the backlighting flashing. At the same time, the light-emitting efficiency can be improved. Thus, a liquid crystal display device having higher performance can be constructed.

Fourth Embodiment

A fourth embodiment of the present invention will be described below.

Figure 26:
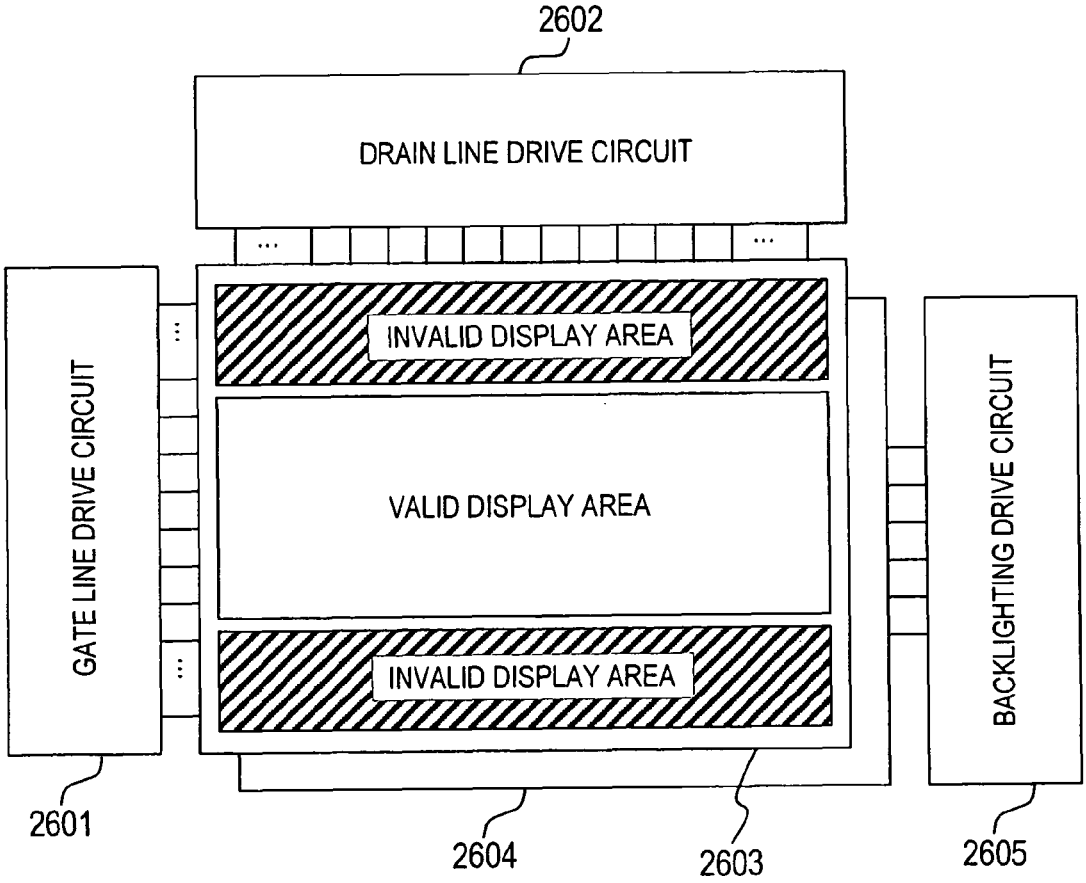
FIG. 26 is a diagram showing the configuration of a display device according to the fourth embodiment of the present invention.

FIG. 26 shows a liquid crystal display device in which a gate driver IC is installed, which allows the selection of scanning start and end positions. FIG. 26 includes a gate line drive circuit 2601 having the driver IC, a drain line drive circuit 2602, a display array 2603, backlighting 2604, and backlighting drive circuit 2605. The display device according to this embodiment has the timing control circuit for multiple-scans and so on, which is not shown, like in FIG. 1.

It is assumed for the explanation here that the display array has the construction shown in FIG. 2 and operates in the normally black mode.

The scanning start and end positions can be set by the gate line drive circuit 2601. Therefore, the general scanning is naturally possible whereby writing is performed on the display array from the first line to the last line. In addition, the partial display is possible in which writing is started and ended in the middle of the display array.

This application may includes the case where images having a different aspect ratio from that of the display array is displayed as shown in FIG. 14. In this case, the scanning area, which is not used for the display, needs to be padded by blanking data as shown in FIG. 12B. Thus, a dummy image, namely, blanking data is written by the conventional gate line drive circuit. On the other hand, by using the gate line drive circuit 2601 according to this embodiment, the blanking display is performed independently from the image writing period. Therefore, there is a sufficient band to be used for the multiple scans by the multiple-line synchronous writing and interlace scanning and/or the rapid data transfer which was described in the first embodiment and the third embodiment.

Figure 27:
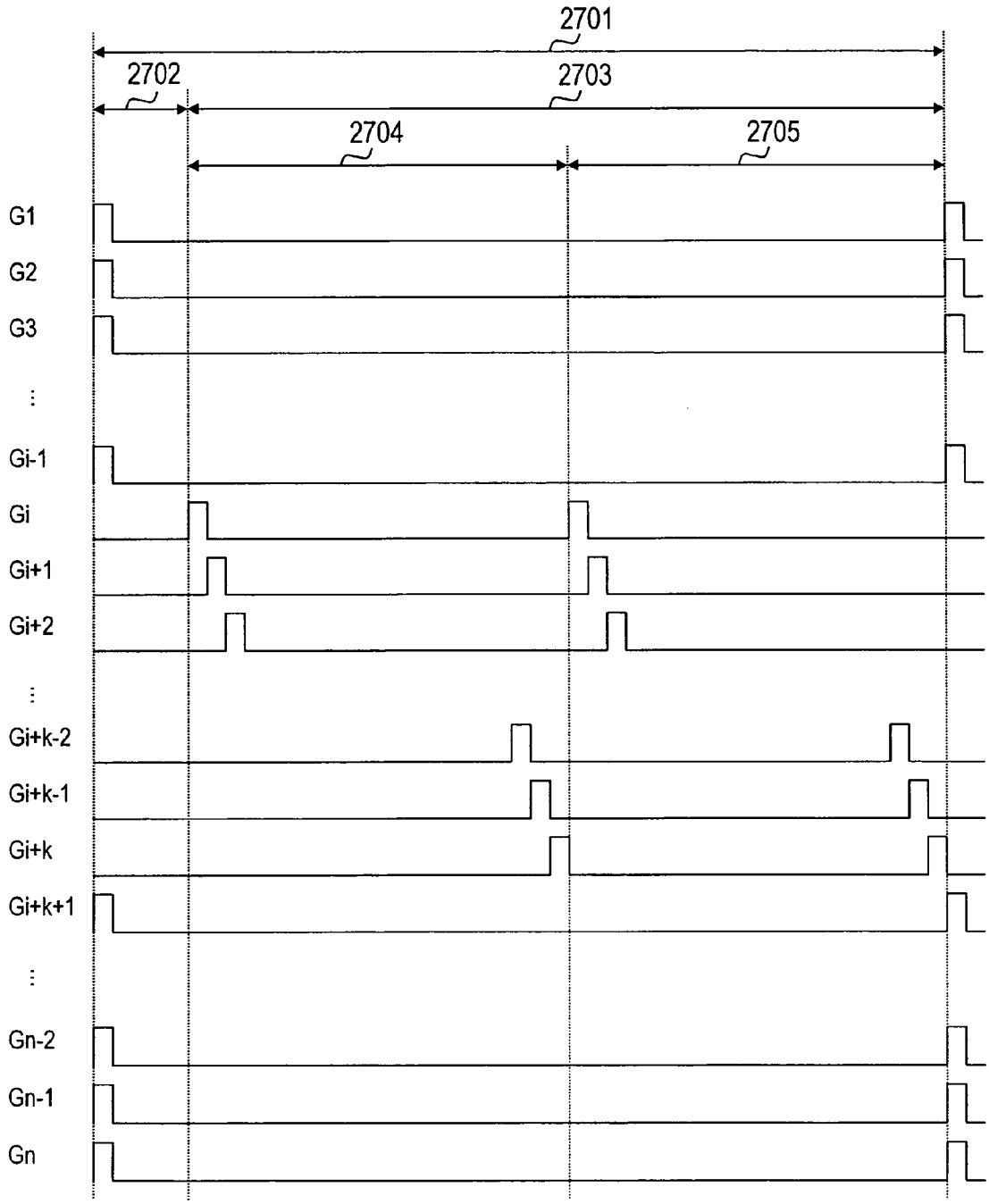
FIG. 27 is a waveform diagram of a gate line drive signal according to the fourth embodiment of the present invention.

The principle will be described in detail with reference to FIG. 27. FIG. 27 is a timing chart for gate selection pulses in the display array. FIG. 27 includes a frame cycle 2701, a retrace period 2702, a display period 2703, an image writing period 2704 within the display period 2703, and a blanking data writing period 2705 for impulsing. FIG. 27 has invalid areas from G1 to Gi−1 and from Gi+k+1 to Gn of n gate lines, which are padded by blanking data. Further, FIG. 27 has a valid area including k lines from Gi to Gi+k. The same black data may be written therein as the blanking data. Thus, the G1 to Gi−1 and from Gi+k+1 to Gn are selected at the same time for the retrace period 2702. Then, the blanking data is written therein, and then images and impulsed blanking data are written therein in the display period 2703.

Referring to FIG. 14, when the 1080i image is displayed in the XGA display array, for example, there are 192 invalid display lines and 576 valid display lines. The valid display period can be used for writing 576 lines. Therefore, when impulsed display is performed in the XGA scanning band, 192 times of two-line synchronous writing and 192 times of one-line synchronous writing may be performed. Thus, by performing the two-line writing and one-line writing alternately, impulsed driving may be performed by which 384 lines of an original image having 540 lines is reconstructed. Alternatively, impulsing may be performed by every-line writing. In order to the impulsing, 576×2=1052 lines of scanning band is needed in one frame period. However, the scanning band is substantially equal to that for SXGA and therefore the existing data transfer band of the drain driver IC can be used as the scanning band. This may be combined with the multiple-line synchronous writing and interlace scanning in order to perform the four-screen scanning in one frame period like the third embodiment, faster responses can be obtained by performing filter processing when displaying moving pictures having a lot of motion.

The backlighting for the invalid display area may be shut off and/or the lighting the backlighting may be controlled like the second embodiment. Thus, the moving images can have higher image quality. In addition, the light-emitting efficiency can be improved, and the power consumption can be reduced.

In order to execute the above-described switching, like the first to third embodiment, the data generating circuit 102 for multiple scans receives an instruction for switching the display mode from the outside through the control bus 109 according to the system configuration in FIG. 1. Then, the data generating circuit 102 for multiple scans first converts the image to an image suitable for the display method. Then, one of the parameter shown in FIG. 28 relating to the display method according to this embodiment, parameters in FIG. 17 according to the first embodiment and parameters in FIG. 20 according to the second embodiment is attached to the converted image. Then, the data generating circuit 102 for multiple scans transfers the converted image having the control information to the timing generating circuit 103 for multiple scans. The timing generating circuit 103 for multiple scans receives the image data having control information generates timing for controlling the gate line drive circuit 104, a drain line drive circuit 105 and the backlighting drive circuit 108 based on the information. As a result, the image quality can be improved by switching the impulse driving and the hold driving in accordance with the image contents.

Fifth Embodiment

A fifth embodiment of the present invention will be described below.

Scanning band twice as large as the conventional scanning band is required for performing the image writing and the blanking writing in one frame period by using the every-line scanning in order to obtain the impulse type light-emitting characteristic without reducing the resolution. For example, one frame of the impulse images is generated for the XGA display array, a band for scanning 768 lines in ½ frame period, that is, 1536 lines in one frame period. This band corresponds to the data transfer band of the UXGA or above.

Figures 28, 29:
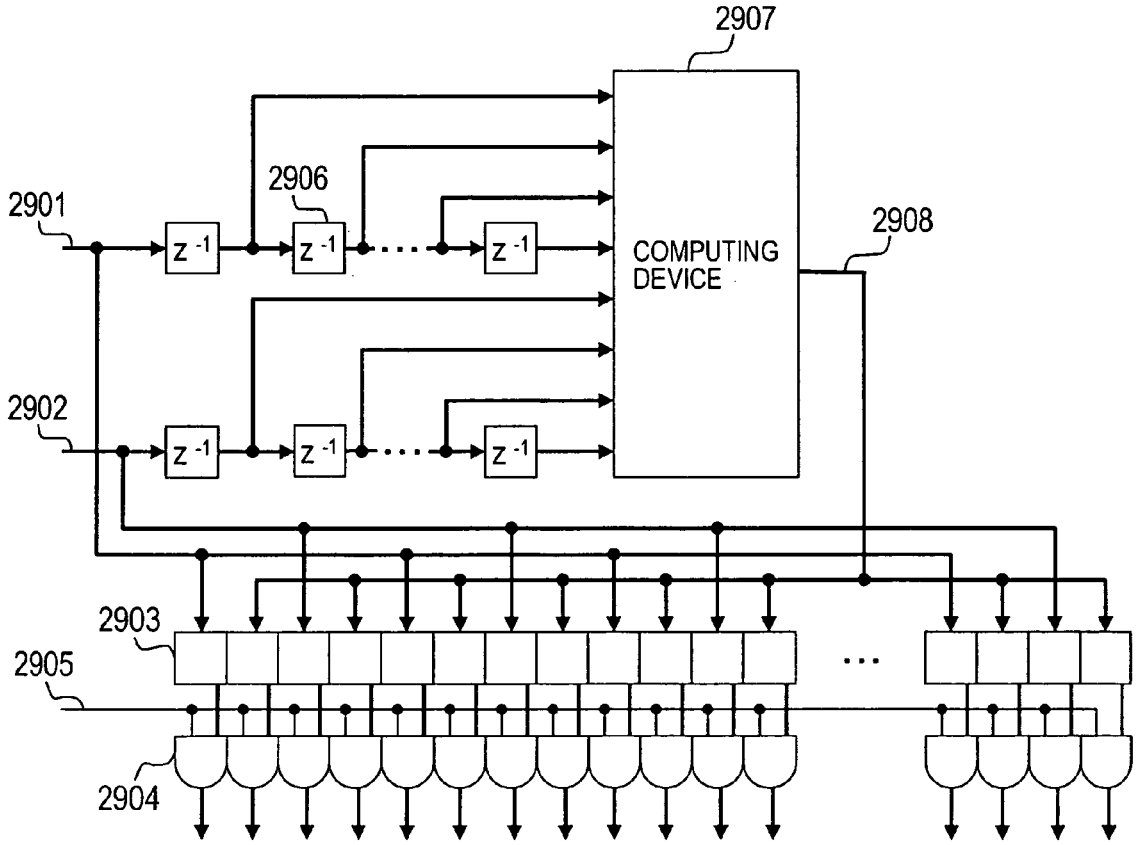
FIG. 28 is an explanatory diagram showing specific examples of control parameter and the values according to the fourth embodiment of the present invention.
FIG. 29 is a diagram showing the configuration of a drain line drive circuit (drain driver IC) according to the fifth embodiment of the present invention.
Figure 30:
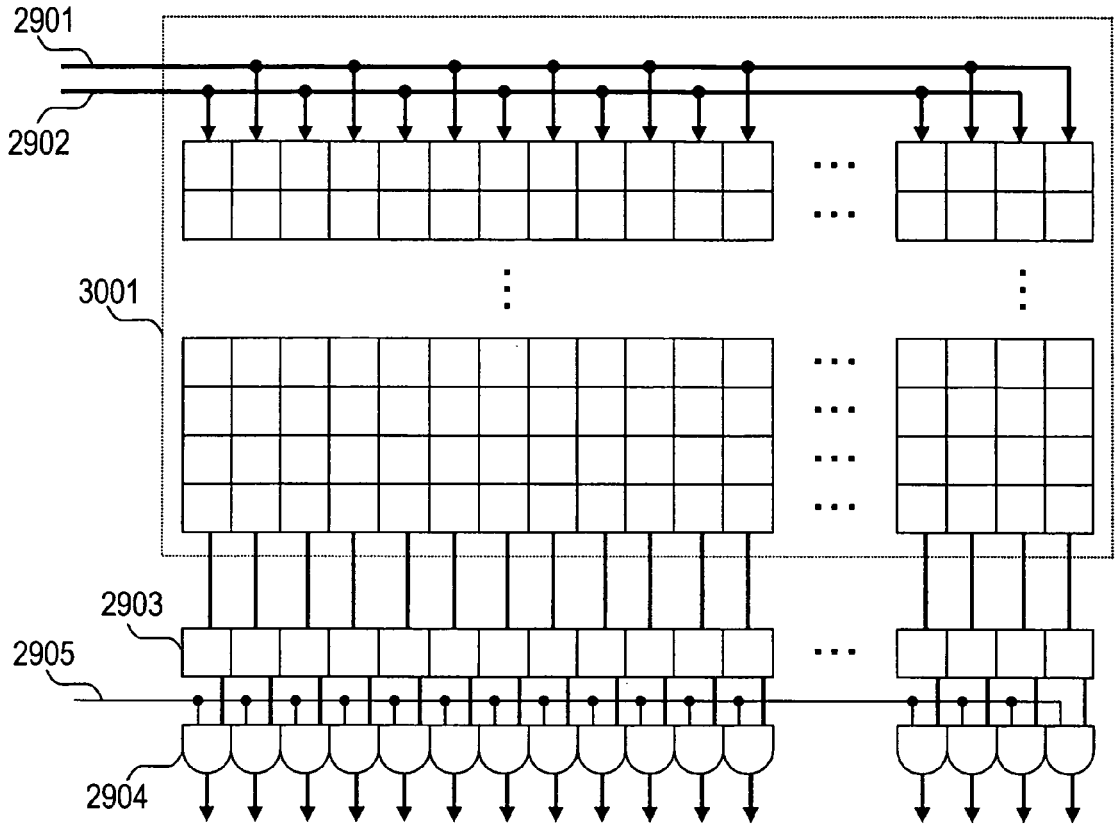
FIG. 30 is a diagram showing the configuration of a drain line drive circuit (drain driver IC) according to the fifth embodiment of the present invention.
Figure 31:
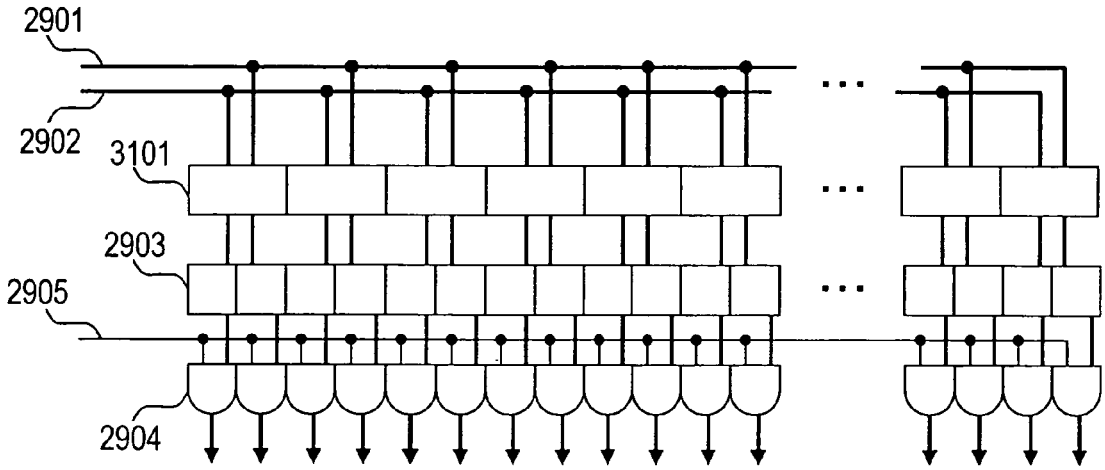
FIG. 31 is a diagram showing the configuration of another drain line drive circuit (drain driver IC) according to the fifth embodiment of the present invention.

For the third embodiment, it has been described that the currently available drain driver IC has the band barely and data can be transferred therethrough. However, the operational allowance is extremely small. Thus, if twice as much as the data transfer can be achieved without an increase in transfer clock by using the data bus width of the current drain driver IC, the above-described driving becomes possible. FIGS. 29, 30 and 31 shows the configuration of the drain driver IC, which makes it possible. There, only the logic portion is shown.

FIG. 29 shows an example where the impulse driving is achieved by reducing the transfer amount of horizontal image data to half. The feature is that the other half of data is generated within the drain driver IC of the display array and supplemented. The configuration in FIG. 29 maintains the current driver interface having two-pixel transfer bus width. FIG. 29 includes an even-number pixel data bus 2901, an odd-number pixel data bus 2902, data latch circuits 2903, which is equal to the data bus width, a mask logic 2904, and a mask signal line 2905. The data latch circuit 2903 is required for each of horizontal pixels of the display array and for each of three RGB primary colors. Therefore, in the case of the XGA display array, eight drain driver IC's having 384 data latch circuit are used. Thus, totally 3072 (=384×8=1024×3) data latch circuits are prepared. FIG. 29 further includes synchronous delay elements 1906 (for example, data latch circuits), a computing circuit 2907 and a data bus 2908 after the computing.

Figure 32A:
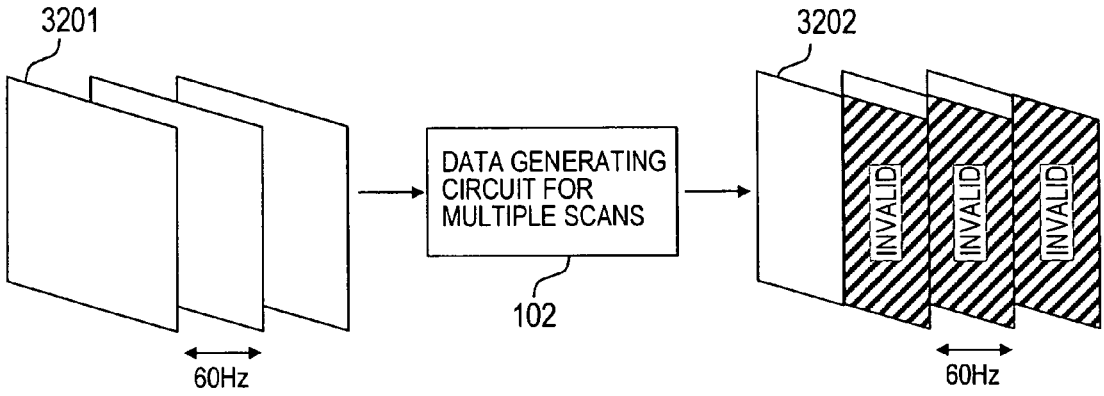
FIG. 32A is a conceptual diagram showing a video data generating process in a data generating circuit for multiple scans for rapid data transfer according to the fifth embodiment of the present invention.
Figure 32B:
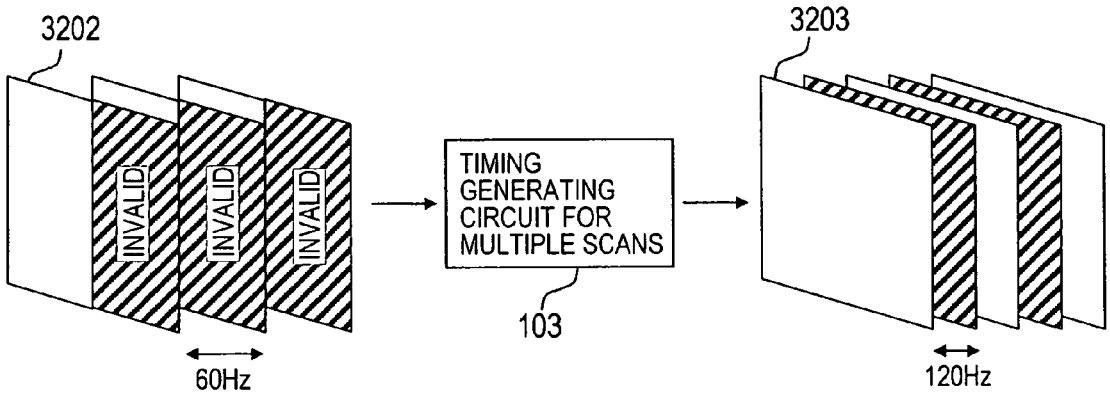
FIG. 32B is conceptual diagrams each showing a video data generating process in a timing generating circuit for multiple scans for rapid data transfer according to the fifth embodiment of the present invention.

FIGS. 32A and 32B show screens required by the drain driver IC's in FIG. 29. The data generating circuit 102 for multiple scans generates an image 3202 in which the left half of an original image 3201 is compressed. The timing generating circuit 103 for multiple scans transfers the image 3202 to the even-number and the odd-number pixel data buses. The data is transferred to latch circuits connecting either the even-number pixel data buses 2901 and the odd-number pixel data buses 2902 on every other basis. The data is stored by an address circuit (not shown) for selecting an address for the series of latch circuits. Then, gradation voltage in accordance with the data is output, and the drain line is driven thereby. Thus, the image 3203 having the original image and the blanking display is displayed on the display array in one frame period, which allows the impulse driving. According to this embodiment, double scaling of the horizontal line is assumed. However, the bus wires may be switched so as to select x times scaling. Each of the latch circuits, which is not connected to the even-number pixel data bus 2901 and the odd-number pixel data bus 2902 is connected to the output data bus of the computing circuit 2903. Therefore, data resulting from the computing may be stored therein. The pixel data transferred to either the even-number data bus or the odd-number data bus is delayed by using the delay element 2906 and is held within the delay element 2906. The held data for several pixels is transferred to the computing circuit 2907 and is processed by the FIR filter including the computing circuit 2907 and the delay elements 2906, which results in complementary data. In this way, the horizontal line can be generated by using horizontal image data in half of the display array when scaling is performed within the drain driver IC. Furthermore, a same number of the mask logic's 2904 as the number of the data latch circuits are prepared. Thus, the data within each data latch circuit can be masked by black blanking data. After writing an image in half of one frame period, the mask signal line 2904 may be enabled. Thus, black data can be always written in the other half blanking period without transferring the black data. Therefore, the data transfer during this period can be omitted.

Alternatively, as shown in FIG. 30, a frame buffer 3001 may be installed in the drain driver IC. Then, data can be transferred to the frame buffer 3001 in the background during the mask period. Therefore, even when data scaled in the outside of the drain driver IC is transferred as it is, the images can be impulse-displayed. By combining both of them, multifunction can be achieved within the drain driver IC such as partial scaling and partial display.

FIG. 31 shows an example where the bus width for one pixel of the conventional drain driver IC is divided into two, and an available mode is added thereto. When RGB each data 8 bit bus for one pixel is divided into two each having four bits, that is, four bits each for two pixels. Then, double pixel data can be transferred. With the one pixel RGB each four bits, 4096 (two to the twelfth power) colors can be reproduced. It is apparent that the RGB are not always necessary to divide equally. Data may be converted by using a logic pallet. According to this embodiment, a case where the RGB are divided equally will be described.

The feature of this embodiment is having a bus dividing multiplexer 3101. In the general 8 bit bus mode, the bus dividing multiplexer 3101 connects even-number and odd-number pixel latch circuits and the even-number and odd-number pixel data buses, respectively. However, in the half-bas mode described in this embodiment, the bus dividing multiplexer 3101 divides each of the even-number pixel data buses into two and connects it to the adjacent even-number or odd-number pixel latch. Then, each of the odd-number pixel data buses is connected to the next adjacent even-number or odd-number pixel latch. In this case, a bus switch (not shown) for switching a bus of the bus dividing multiplexer 3101 and an address selecting circuit (not shown) for selecting an address of the latch circuit at the same time need to select a corresponding latch circuit.

When this configuration is adopted, double pixel data can be transferred at a normal transfer rate. Thus, an image can be written within ½ frame period. In the other ½ frame period, which is the blanking period, data is masked by the mask logic 2904 and black data can be written. Therefore, the impulse drive can be achieved at the conventional driver data transfer rate.

Figures 33, 34:
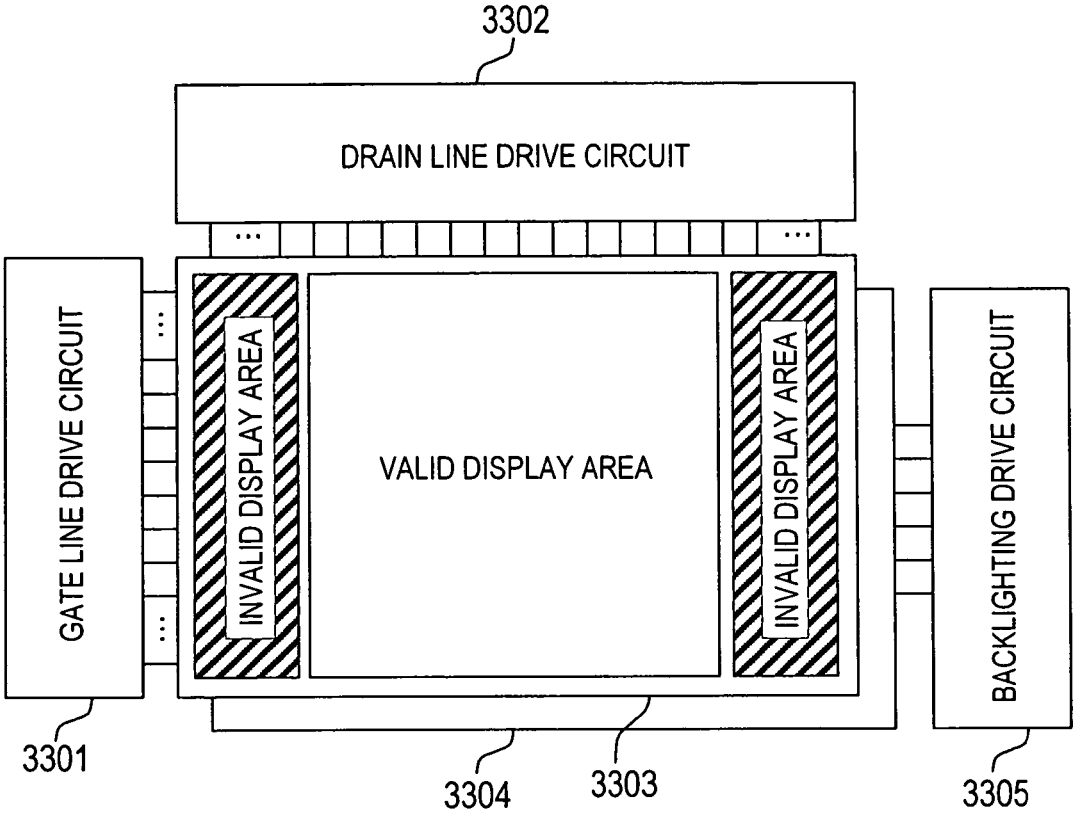
FIG. 33 is a configuration diagram of a main portion of a display device according to the fifth embodiment of the present invention.
FIG. 34 is an explanatory diagram showing specific examples of control parameter and the values according to the fifth embodiment of the present invention.

FIG. 33 shows a configuration of a display array. For the display array, the right and left blanking areas can be set for the display as shown in FIG. 13B because an image having a different aspect ratio from that of the display array is displayed on a wider display array. FIG. 33 includes a gate line drive circuit 3301, a drain line drive circuit 3302, a wider display array 3303, a backlighting 3304, and a backlighting drive circuit 3305. The blanking data for the invalid display area is black data and is not changed. Therefore, by using the drain driver IC as shown in FIGS. 29, 30, and 31, as the drain line drive circuit 3302, masking may be performed by the mask logic 2904. Thus, the blanking data does not have to be transferred. However, in the configuration shown in FIGS. 29, 30 and 31, a plurality of the mask signal line 2905 is required. When the display in this manner is performed, the band, which is not necessary to transfer, can be assigned to the impulse drive.

For example, when an XGA image is displayed in the WXGA display area in a way shown in FIG. 13B, data for 1280−1024=256 pixels is not necessary to transfer. Therefore, the valid display area in FIG. 33 can undergo the impulse driving efficiently by using the band acquiring function of the drain driver IC shown in FIGS. 29, 30 and 31. As described in the first embodiment, these changes in setting may be achieved by using image data to which the control information is added to the header, as shown in FIG. 16.

In this embodiment, parameters as shown in FIG. 34 are prepared as the control information for the drain driver IC shown in FIGS. 29 to 31. These parameters and the display device including a gate driver according to the fourth embodiment are used to perform four screen scanning in one frame period. Therefore, the quality of moving images can be improved more through the filter processing for increasing the response speed of the liquid crystal. Thus, the multifunctional display device can be configured. The combination of the first and second embodiments can naturally produce larger effects.

Furthermore, the display device having a TFT array using p-Si can have the driver IC on a glass substrate even though the display medium is liquid crystal or an organic and inorganic light-emitting diode. Thus, highly functional display device having the above-described functions can be achieved which provide narrow frame, higher definition and higher quality in moving pictures. The display element using the pseudo hold type of light-emitting diode does not need backlighting. Thus, the black level is very low. Therefore, the blanking effect is high. Therefore, a ultra thin display can be achieved which allows the clearer moving image display.

Sixth Embodiment

A sixth embodiment of the present invention will be described below.

Figure 35:
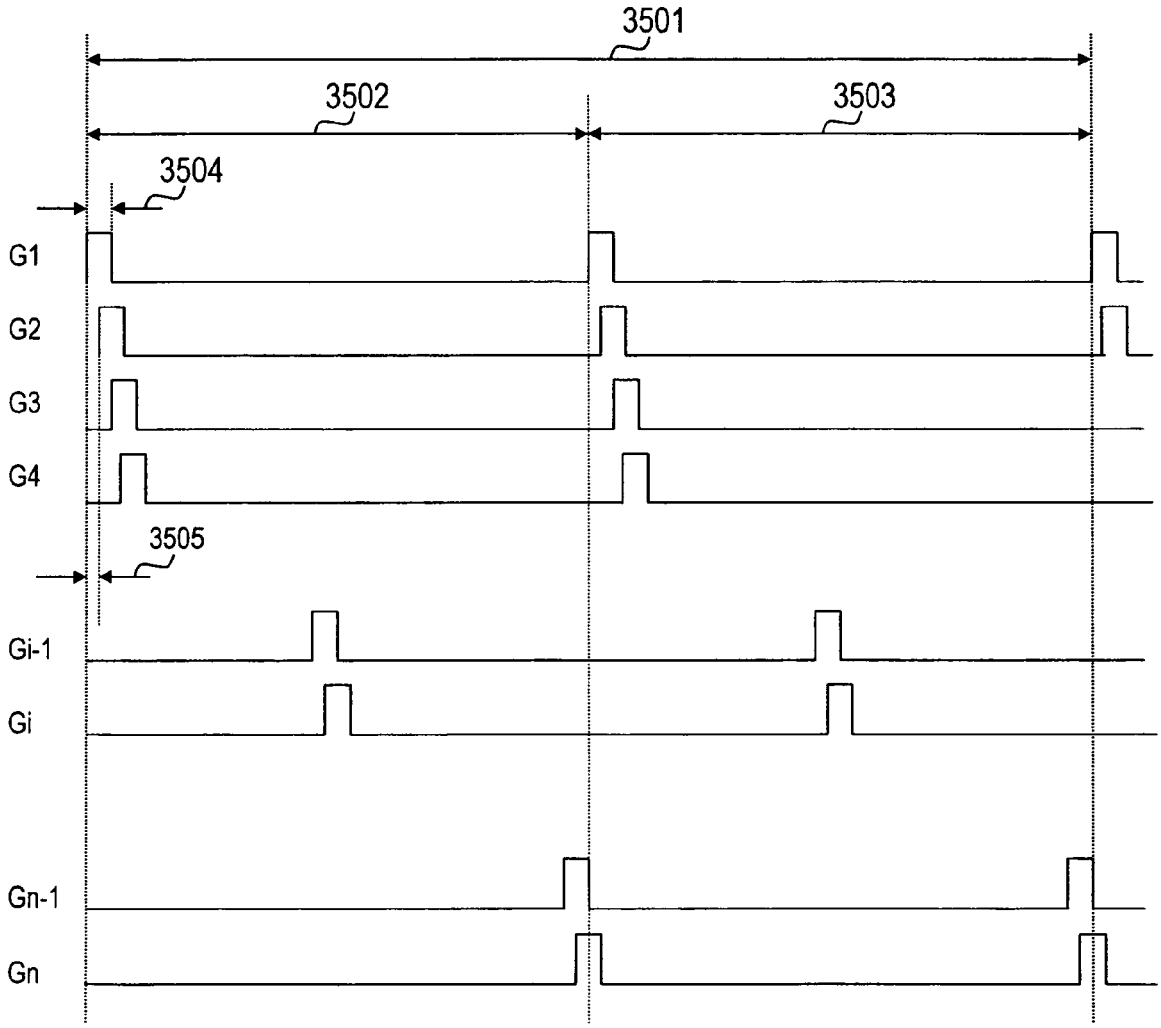
FIG. 35 is a waveform diagram of a gate line drive signal according to the sixth embodiment of the present invention.

FIG. 35 shows timing of gate select pulses. In this case, timing for two lines to be written is shifted from each other and an image is written in half of one frame period by the two-line interlace scanning. Then, black blanking data is written in the other half period.

FIG. 35 includes one frame period 3501, an image writing period 3502, a blanking data writing period 3503, a one-line selecting period 3504, and a gate select timing delay writing the two lines.

Figure 36:
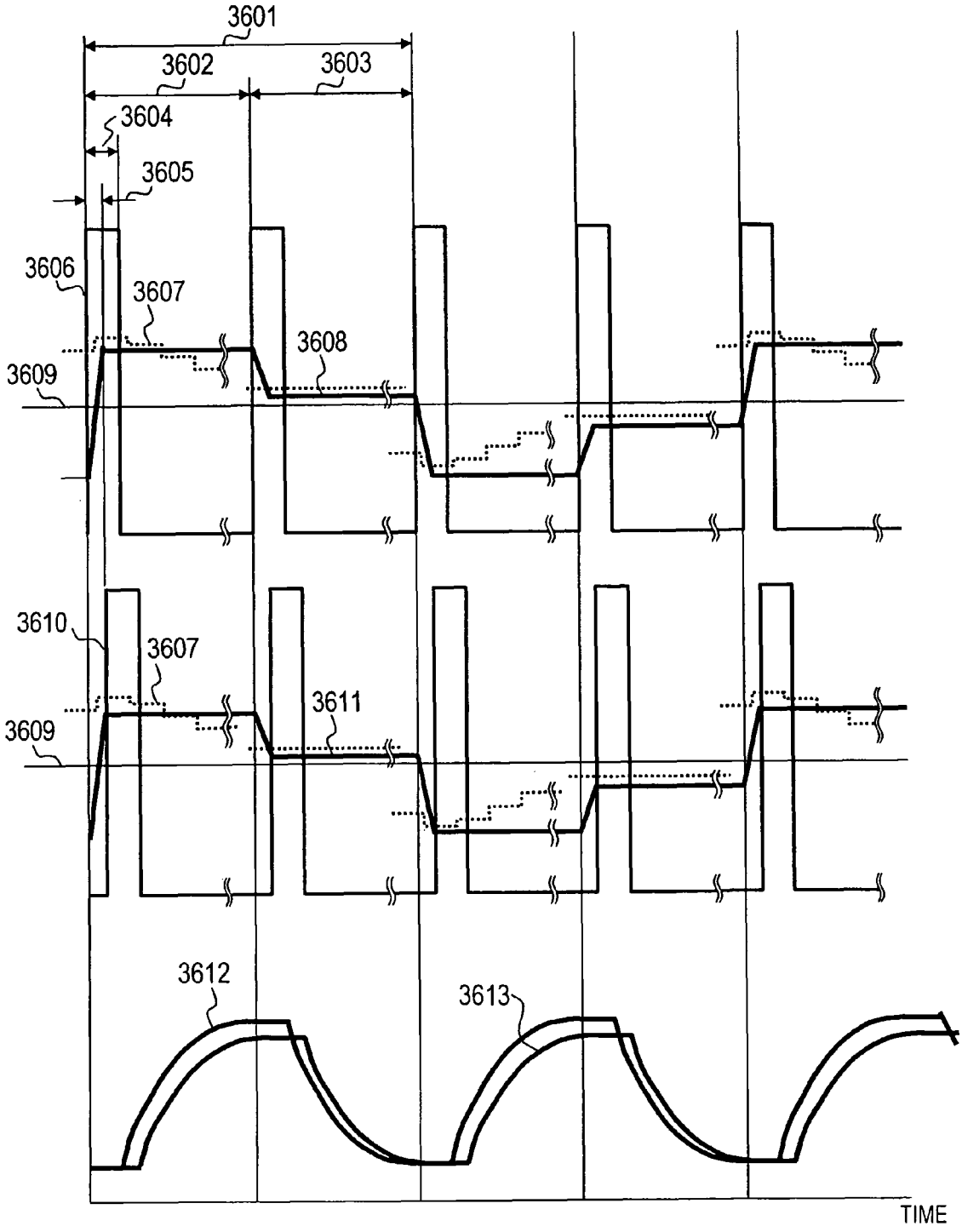
FIG. 36 is a diagram of a waveform of each drive signal line and a waveform of an optical response of a pixel included in serial lines according to the sixth embodiment of the present invention.

FIG. 36 shows a drive waveform in focusing on a certain pixel included in the two lines to be written. FIG. 36 includes a waveform 3606 of a gate line driving signal for the current line, a waveform 3607 of a drain line drive signal, a source voltage waveform 3608 of the current line and a common waveform 3609.

FIG. 36 further includes a waveform 3610 of a gate line drive signal for the next line, a waveform 3611 of source voltage for the next line, a frame period 3601, a image writing period 3602, a blanking data writing period 3603, line selecting period 3604, and a gate selecting pulse delay 3605.

The drain waveform 3607 exposes different levels between lines. Therefore, the gate selecting pulse waveform 3610 for the next line, which is delayed from the current line gate waveform 3606 by the period 3605 includes the next data writing period. This means that a different image from that written in the current line is written in the next line because both of the current data and the next data are written therein. In other words, the next line becomes a complementary line exposing the halftone of the current data and the next data. Therefore, in comparison with the case where the same data is written in two lines synchronously, the degree of the deterioration in picture quality can be reduced.

FIG. 36 further includes optical response waveforms 3612 and 3613 for respective lines. The optical response waveform 3612 is of the current line while the optical response waveform 3613 is of the next line. Due to the difference in writing voltage, both of them emit light having different brightness from each other. In this embodiment, the display array operates in the normally black mode. The frame inversion drive is assumed here where the writing polarities for all of the lines within a frame are the same.

In this way, by differentiating the timing for the writing gate from each other and by writing both of the current line data and the next line data, a gradation, which is not in the data, can be generated in an analog manner. As a result, the deterioration in image quality due to the reduction of the vertical resolution can be reduced. Here, to shift the timing for the writing gate, in other words, to shift the start timing for scanning, scanning periods need to overlap each other.

Examples Relating to Configuration of Display Device

Next, variation examples of the more specific configuration of the display device according to the above-described embodiments will be described.

In general, as shown in 61, the image signal source 101 (FIG. 1) is a signal source for generating analog or digital video signals for broadcasting images and/or recorded images, such as a television and a video player, and for image data stored in a medium, such as a personal computer.

In the display element 106, display pixels are arranged horizontally and vertically in a matrix form, and the resolution as shown in FIG. 10 is known.

Therefore, in order to display various kinds of image signals having different formats shown in FIG. 61 in the display element array 106, the resolution for the images needs to be converted so as to fit to the resolution of the display element array 106. Especially, in order to display image signals having multiple kinds of formats in one liquid crystal display device, the image format of each image signal shown in FIG. 61 is required to fit to the resolution of the displaying liquid crystal display element array 106 each time.

Thus, a resolution converting circuit is provided in the downstream side of the video signal source 101 for outputting video signals having different kinds of formats. The resolution converting circuit 8201 converts the video signals having different kinds of formats to video signals having a predetermined format. Here, each of video signal is displayed in a liquid crystal display element array having the XGA resolution (1024×768) as an example. In this case, the resolution converting circuit converts each of the signal formats to the XGA resolution. Thus, different video signals having multiple formats can be displayed in one kind of liquid crystal display element array.

The image quality when video signals transmitted in NTSC format from the image signal source 101 are read in XGA resolution by the resolution converting circuit 8201 will be described as an example.

NTSC video signals of television images are generally sent through about 240 valid scanning lines and 60 Hz interlace. However, the XGA display element has 768 lines of vertical resolution and equal to 768 scanning lines and 60 Hz scanning. In other words, images are displayed by upsampling the horizontal frequency band (compliant with the general television images) at 240×60=14400 lines/second to the band at 768×60=46080 lines/second (compliant with XGA).

Signal processing methods such as interlace/progressive conversion and scaling are known as the method of upsampling. However, each of them generates scanning lines, which do not originally exist, through the complementary processing. Therefore, the image quality only maintains the original 14400 lines/second.

When images on which the resolution conversion is performed are displayed in the liquid crystal display element array, blurred moving pictures (most images in NTSC are moving pictures) are generated due to the response character of liquid crystal and the hold type of display characteristic of the liquid crystal display element. As a result, the quality in images is significantly deteriorated.

In other words, in the liquid crystal display element, a still images for a personal computer or the like having resolution equal to that of the liquid crystal display element can be displayed clearly. On the other hand, moving images for NTSC having different resolution from that of the liquid crystal display element may have deteriorated image quality due to the influence of both of the appropriateness of the resolution conversion and the display characteristic of the liquid crystal.

Here, focusing on the moving image display by liquid crystal display element, moving image video signals typically for the NTSC originally are standardized for being read by using the display characteristic (impulse type) of CRT type televisions. Therefore, the standardized moving image video signals do not always match with the liquid crystal display, which displays still images without flicker in personal computers.

Accordingly, the inventor considers that, in principle, moving pictures cannot be displayed in high quality when, as conventional, the liquid crystal display displays the moving pictures in the same manner as displaying still images in personal computers.

In the above point of view, the present invention is based on the idea that video signals having the resolution equivalent to that of the liquid crystal display element maintains higher image quality by applying the same display characteristic as conventional. At the same time, when image signals, especially moving images, having resolution different from that of the liquid crystal display element are displayed, higher quality in moving images than the conventional is achieved by adopting a different display method.

Nineteenth Example

FIG. 62 shows an example where the two-line synchronous writing and two-line interlace scanning are performed, rather than the general XGA scanning, on the NTSC signals, which results in the double frame rate (120 Hz). Then, the one screen scanning is assigned to the black data writing. FIG. 62 shows basically the same content as those in FIG. 3.

As described above, the liquid crystal display element array having the XGA resolution for the monitor application for personal computers undergoes the scanning in the 46080 lines/second band. Therefore, displaying the NTSC video signals requires only the 14400 lines/second band. Thus, there is an extra room in the band. Here, the remaining band can be assigned to the frame rate to be used for the black writing by upsampling by the two-line synchronous writing and two-line interlace scanning performed on the liquid crystal display element.

Black writing is performed for obtaining the impulse type display characteristic like that in the CRT type television. Like the technology of the related art disclosed in the Japanese Unexamined Patent Application Publication No. 11-109921, black data is written in the hold-type display so as to overcome the blurred moving images.

FIG. 65 shows an example of the configuration of a display device, which can achieve the two-line synchronous writing and the two-line interlace scanning. FIG. 65 includes, according to this example, an image signal source 8501, a data generating circuit 8502 for multiple scans, a liquid crystal display element array 8504, a liquid crystal drive/control circuit 8503, backlighting 8506, and a backlighting control circuit 8505. The configuration is the same as the configuration in FIG. 1. However, the data generating circuit 8502 for multiple scans according to this example corresponds to the data generating circuit 102 for multiple scans in FIG. 1. The liquid crystal drive/control circuit 8503 according to this example includes the timing generating circuit 103 for multiple scans, the gate line drive circuit 104 and the drain line drive circuit 105 in FIG. 1.

The image signal source 8501 generates different kinds of video signals shown in FIG. 61 and transmits the video signals to the data generating circuit 8502 for multiple scans.

It is assumed that the data generating circuit 8502 for multiple scans multiple times scans the video signals transmitted from the image signal source 8501 having different resolution (band) from that of the liquid crystal display element array 8504. (In this case, two scans are performed twice by the two-line synchronous writing and two-line interlace scanning, and one of the scans is black scanning). Then, Image data is processed, and the processed image data is transferred to the liquid crystal drive/control circuit 8503.

Here, the liquid crystal drive/control circuit 8503 does not know how the received image has been processed and how the liquid crystal display element array 8504 should be scanned. Thus, the data generating circuit 8502 for multiple scans attaches, as the header, control information regarding processed data, as shown in FIG. 63, to the image data. Then, the image format as shown in FIG. 16 is transferred by, for example, using the retrace band. The control information in this case includes information that two scans are performed by the two-line synchronous writing and two-line interlace scanning and one scan is used for black scanning.

The image data having the control information header transferred from the data generating circuit 8502 for multiple scans is received by the liquid crystal drive/control circuit 8503. Then, the liquid crystal drive/control circuit 8503 receives the control information from the control information header and drives the liquid crystal display element array 8504 in accordance with the control steps (in this case, two scans are performed by the two-line synchronous writing and two-line interlace scanning and one scan is used for black scanning).

The data generating circuit 8502 for multiple scans sends image data by attaching, to the image data, the control information header, including information that the number of times of scan is once as usual when images having the same resolution as the resolution of, for example, the personal computer. The liquid crystal drive/control circuit 8503 can then easily achieve the switching display frame by frame based on the information. As a result, the resolution of the liquid crystal display element array is used to the maximum.

By adopting the switching display, images can be provided to users by using a scanning method suitable for various video formats (multi-formats) as shown in FIG. 65. Therefore, both of still images and moving images can be displayed with higher image quality on one liquid crystal display (liquid crystal display compliant with multi-contents).

The system configuration of this example has been described briefly. Next, the system configuration of this example will be described in detail which can achieve a popular liquid crystal display compliant with multi-contents with low costs. The liquid crystal display in this case uses the current liquid crystal display elements and liquid crystal drive circuit.

Figure 69:
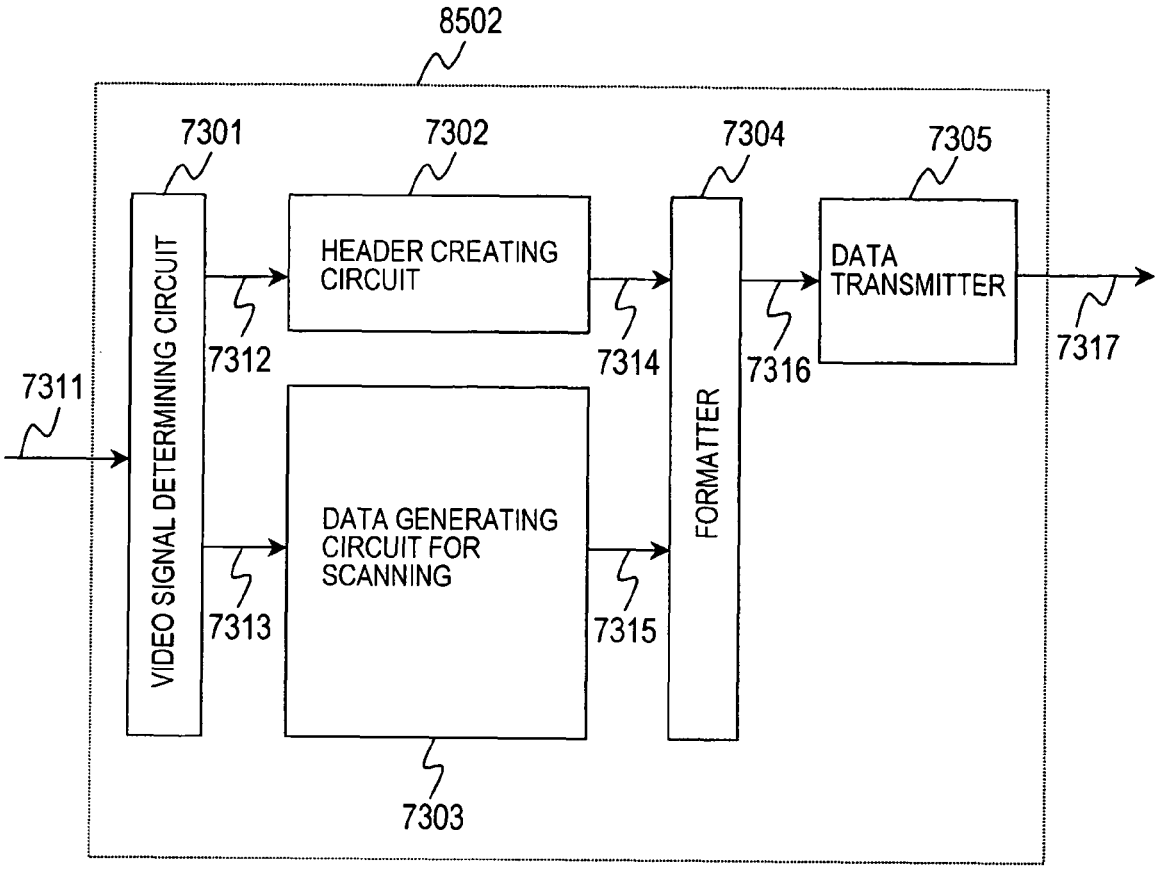
FIG. 69 is a diagram showing the configuration of a control circuit for data displayed multiple times according to examples of the present invention.

FIG. 69 shows the system configuration of the data generating circuit 8502, 102 for multiple scans shown in FIG. 65. FIG. 69 includes a multi-format input video signal 7311 from the image signal source, a video signal determining circuit 7301, a video determining information 7312, video data 7313, a header generating circuit 7302, a data generating circuit 7303 for scanning, header information 7314, a data 7315 subject to multiple scans, a formatter 7304 for storing information in the video transfer format, and a data transmitter 7305 for transferring video information.

In order to be compliant with the video multi-formats shown in FIG. 61, the data generating circuit 8502 for multiple scans determines a video format of the input video signal 7311 in the video signal determining circuit 7301. Then, in order to fit images to the displaying liquid crystal display element array 8504, control information, such as the scanning method and black blanking data, as shown in FIG. 63 is extracted from the input video signal 7311. Then, the control information 7312 and the image data 7313 are sent to the header generating circuit 7302 and the data generating circuit 7303 for scanning. The header generating circuit 7302 generates a header from the control information 7312. The data generating circuit 7303 for scanning processes video data such that the processed video data can fit to the liquid crystal display element array 8504.

Figures 73A, 73B, 73C:
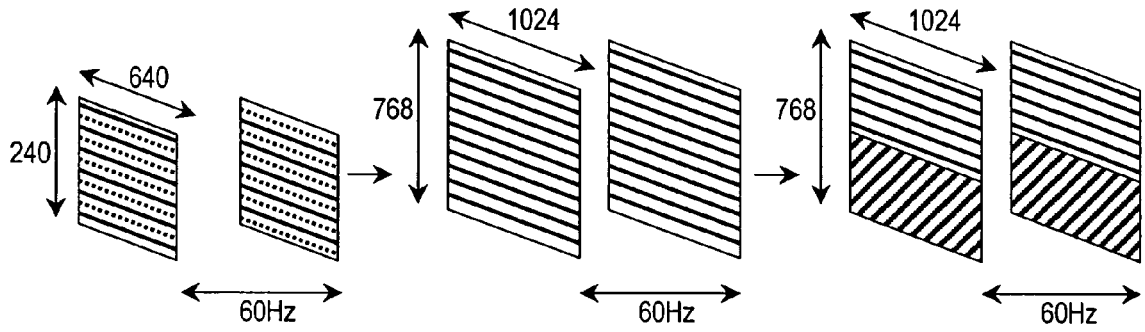
FIG. 73A is an explanatory diagram showing NTSC input images in the process for generating data to be displayed multiple times according to each example of the present invention.
FIG. 73B is an explanatory diagram showing data obtained by performing scaling processing on an input image in the process for generating data to be displayed multiple times according to each example of the present invention.
FIG. 73C is an explanatory diagram showing data to be scanned multiple times in the process for generating data to be displayed multiple times according to each example of the present invention.

FIG. 73 shows diagrams describing the process method. It shows input images, which are, in this case, NTSC interlace images. For example, input video signals are simply upsampled so as to fit to the horizontal resolution of the displaying liquid crystal element. Then, the resolution of the input video signals is changed in the vertical direction to fit the resolution based on the scanning method for the liquid crystal display element in accordance with the video format. Specifically, when an image is displayed on the XGA (1024×768) liquid crystal display element array, the two-line synchronous writing and two-line interlace scanning is performed, whereas the second image scan is black display.

NTSC video signals are scaling-converted to XGA (1024×768) images once. For example, data subject to multiple scans may be generated by thinning out every other line. With this procedure, middle images are generated in the process for generating the data subject to multiple scans such that image processing can be performed thereon. For example, images are reproduced by using the previous and the sequent frames. Then, anti-alias filter processing is performed thereon in order to remove ringing, noise and so on. The anti-aliasing is a method for reducing aliasing. For example, the resolution of a display can be increased such that the aliasing cannot be identified. Alternatively, the brightness of pixels can be changed therefor. The image data 7315 generated from the data generating circuit 7303 for scanning is coupled with the header 7314 in the formatter 7304. Then, the data 7316 and the video synchronous signal (not shown) are transferred to the data transmitter 7305. The data transmitter 7305 is supported by the LVDS interface or the CMOS interface, for example, which is widely used as an interface for the conventional liquid crystal display. Then, the data transmitter 7305 generates and sends the transmitting signals 7317 to the liquid crystal drive/control circuit 8503.

Figure 70:
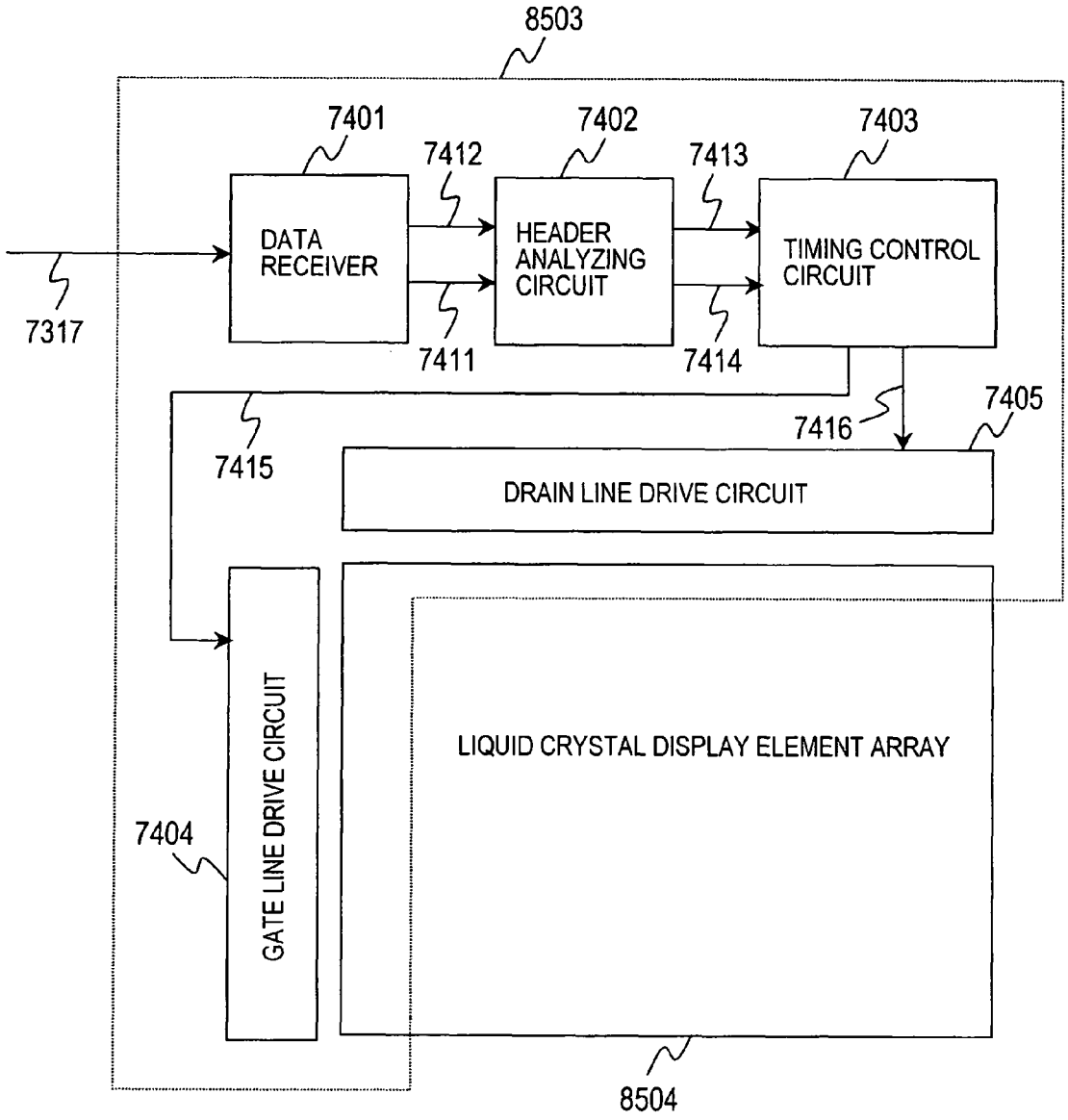
FIG. 70 is a diagram showing the configuration of a liquid crystal drive/control circuit according to examples of the present invention.

FIG. 70 is a configuration diagram of the liquid crystal drive/control circuit 8503 and the liquid crystal display element array 8504. FIG. 70 includes a data receiver 7401 for receiving the transmitted data 7317 and for dividing the data 7317 to header information 7412 and video data 7411. A header analyzing circuit 7402 in FIG. 70 outputs a mode setting signal 7413 to a timing control circuit 7403. Then, the operation mode of the timing control circuit 7403 is determined. The timing control circuit 7403 outputs a control signal 7415 for controlling a gate line drive circuit 7404 and a control signal 7416 for controlling a drain line driving circuit 7405 to respective drive circuits. Then, the liquid crystal display element array 8504 is driven in accordance with the mode signal 7413. Here, the timing generating circuit 103 for multiple scans in FIG. 1 is configured with the data receiver 7401, the header analyzing circuit 7402 and the timing control circuit 7403.

Figure 71:
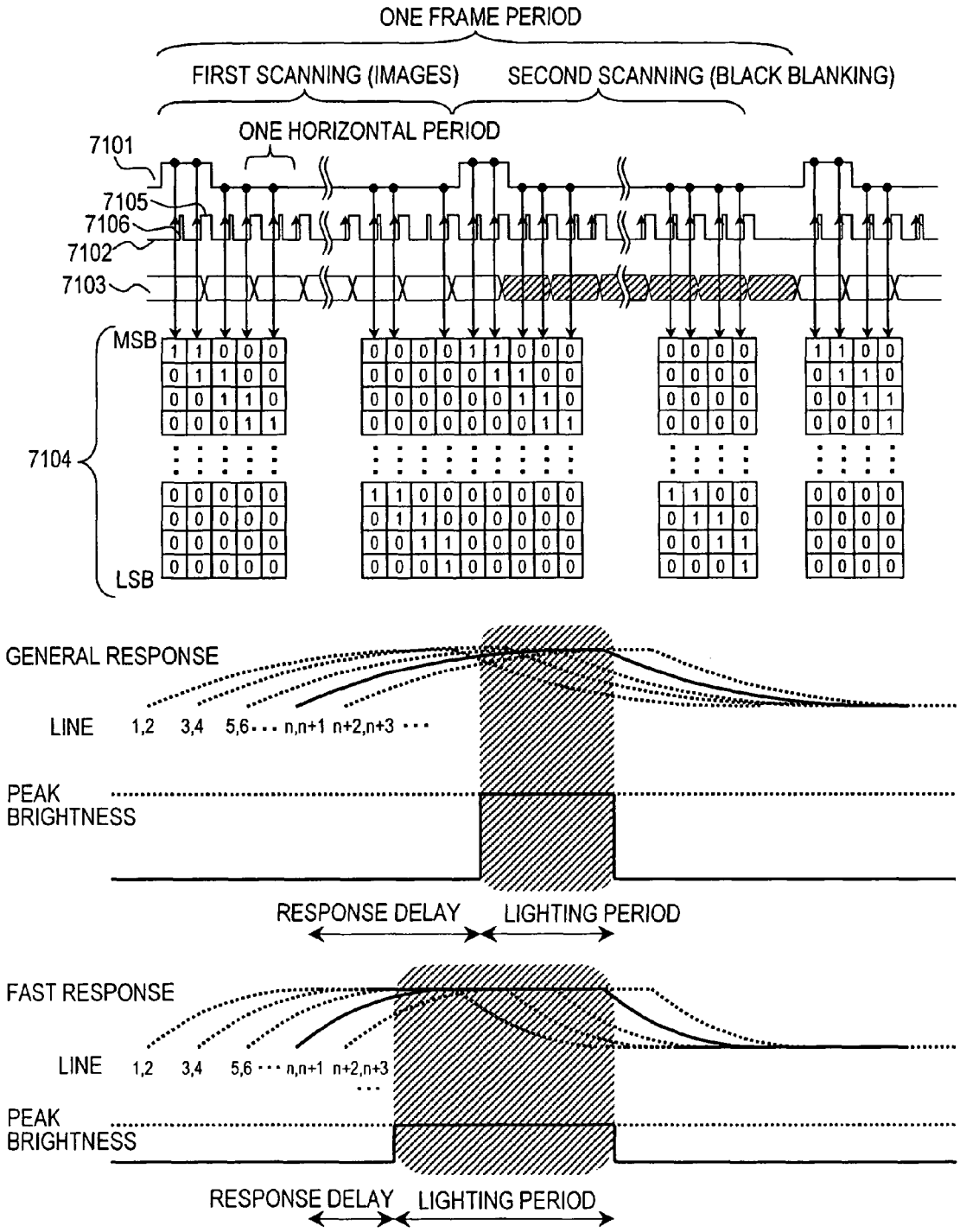
FIG. 71 is an explanatory diagram showing a relationship between multiple-time scanning and backlighting blinking control of a combination between the configuration according to the nineteenth to twenty first examples of the present invention and backlighting blinking control.

FIG. 71 shows the driving signal of the gate line drive circuit 7404. FIG. 71 shows a drive waveform for displaying NTSC moving pictures in high quality. In this case, two screens are scanned in one frame period by the two-line synchronous writing and the two-line interlace scanning. Then, one of the screens is used for the black blanking display. FIG. 71 includes a frame start signal 7101, a shift clock 7102 for shifting a shift register within the gate line drive circuit 7404, data 7103 to be written in each line, and a shift register bit status 7104 for a number of vertical resolution of the liquid crystal display element array. The gate selecting operation by the gate line drive circuit 7404 starts with capturing the High level of the frame start signal 7101 into MSB (the most significant bit) of the shift register at the rising edge of the increment clock 7106 and the select clock 7105 of the shift clock 7102. In this case, the MSB of the shift register is one at the rising edge of each clock 7106, 7105.

Here, the select clock 7105 is a legal shift clock satisfying the specification for selecting a gate. The increment clock 7106 is an illegal shift clock, which does not always satisfy the specification of the gate line drive circuit, intending only to incrementing the shift register. In this example, both of them are dealt separately. In this example, the select clock 7105 is distinguished from the increment clock 7106 by the indication taking a larger High width. An operation for capturing the frame start signal 7101 into the shift register in the shift clock determines the number of selected lines. In this case, two lines are always synchronously selected. At the same time, the shift clock is input in the increment clock 7105 and in the select clock 7106, which is twice totally, within one horizontal period. Therefore, two lines are interlaced and are shifted. Naturally, when the number of increment clocks is increased to two or three, the number of shifts is also increased to three or four, which includes one select clock. Thus, the number of interlace lines can be set freely. When two or three of the clocks can be input in the High period of the frame start signal 7101, three or four selected lines can be set. Therefore, the n-line synchronous writing and the m-line interlace scanning can be performed.

Since one screen can be scanned in half of the frame period in FIG. 71, another one screen can be scanned by inputting a frame start signal again and by inputting the similar shift clock. Here, black blanking data needs to be input.

As described above, by using the current gate line drive circuit and by multiplying n shift register capturing bits and shift clocks by m, each of screens is scanned m times through the n-line writing m-line interlace scanning. An amount of black blanking data is set freely for the several screens. In this way, the system allowing to adjust the quality in moving pictures can be obtained. In the progressive scanning, an image is complemented and scaled in the extension direction. Alternatively, images (equal scale) may be thinned out without scaling.

Twentieth Example

Figure 66:
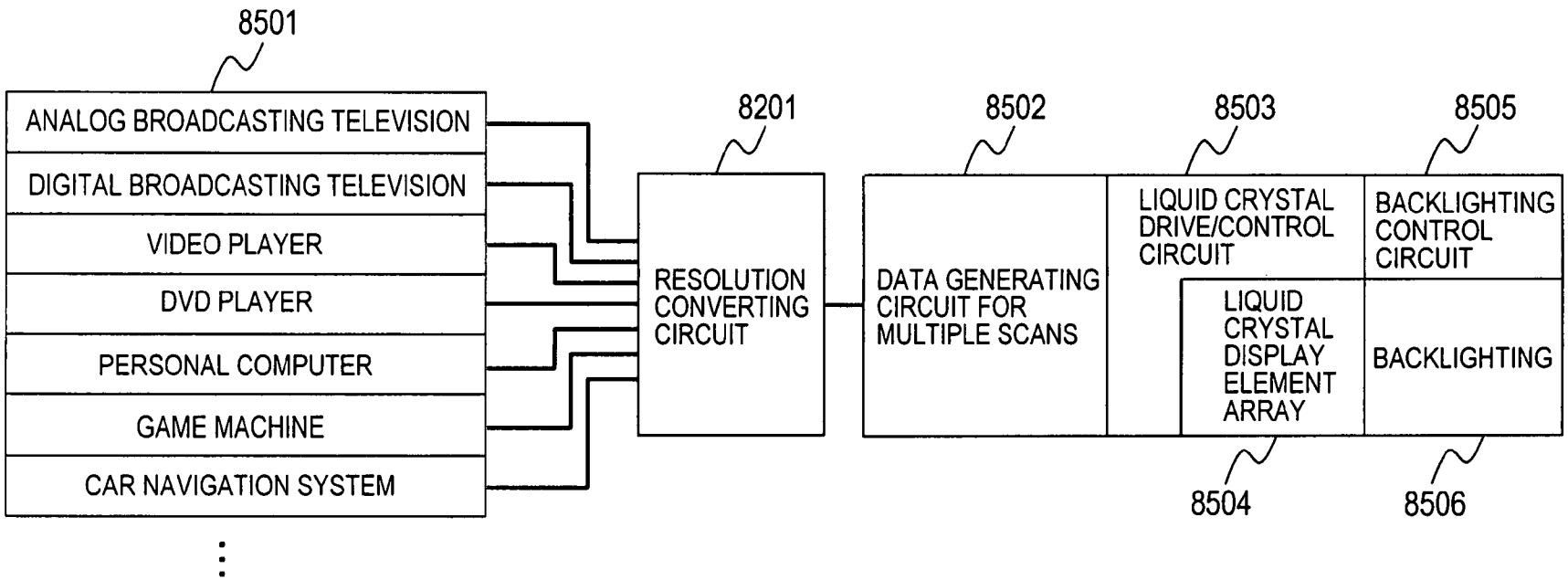
FIG. 66 is a diagram showing the configuration of a display device compliant with a video multi-format according to the twentieth example of the present invention.

FIG. 66 shows an example where the data generating circuit 8502 for multiple scans in the nineteenth example is incorporated in the liquid crystal drive/control circuit. In this configuration, the various video formats of signals from the image signal source is converted to the resolution of the liquid crystal display element array 8504 by the resolution converting circuit 8201. The resolution converting circuit 8201 is provided in the upstream of the data generating circuit 8502 for multiple scans. Then, the data generating circuit 8502 for multiple scans is incorporated into the liquid crystal drive/control circuit.

In this example, the multiple-line synchronous writing and multiple-line interlace scanning are the same as that in the nineteenth example. Thus, the description will be omitted here. In the configuration according to this example, the format data (FIG. 16) does not need to be transferred from the data generating circuit 8502 for multiple scans to the liquid crystal drive/control circuit 8503 as in the nineteenth example. Therefore, the compliance with existing display device components can be maintained.

Twenty First Example

FIG. 67 shows an example where the data generating circuit 8502 of the nineteenth example for multiple scans is incorporated into the image signal source side.

This example shows a liquid crystal display device in a mobile game machine. As shown in the figure, the liquid crystal display device in the mobile game machine displays signals only in a specific data format defined by the image signal source. Therefore, the data generating circuit 8502 for multiple scans only needs to support these signals. Therefore, the circuit can be simplified. As a result, the entire circuit in the image signal source side can be configured in small size. Therefore, the liquid crystal display device can be implemented by low costs.

Twenty Second Example

FIG. 68 shows an example where the data generating circuit 8502 for multiple scans in the nineteenth example is divided into two. In this case, one divided data generating circuit 1 (8801) for multiple scans is incorporated into the image signal source side. The other data generating circuit 2 (8802) for multiple scans is incorporated into the liquid crystal drive/control circuit side.

In this configuration, the data generating circuit 1 (8801) for multiple scans is incorporated into the conventional resolution converting circuit 8201. Then, an element, such as a frame memory, for providing common functions of the converting circuit 8201 and the generating circuit 1 (8801) is shared. By using existing resources effectively, data control for multiple scans can be performed. The data, which has been transmitted once, is stored in the frame memory in the other data generating circuit 2 (8802) for multiple scans. Then, the data control for multiple scans are performed. As a result, an amount of data transfer by the data generating circuit 1 for multiple scans and the data generating circuit 2 for multiple scans can be reduced and asynchronized.

By using the configuration in this example, when a still image without any changes in image is displayed, data is stored in the frame memory of the data generating circuit 2 (8802) for multiple scans once. Thus, data transfer by both are not needed. As a result, the power consumption can be reduced.

Twenty Third Example

Figure 74:
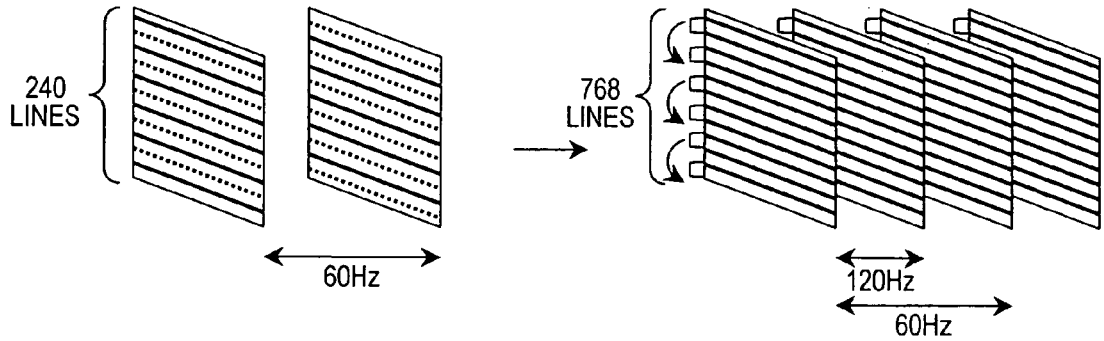
FIG. 74 is an explanatory diagram showing changes in screen scanning when the resolution is converted from NTSC to XGA and each frame is divided into sub-fields.

FIG. 74 is an example where one frame is divided into two sub-fields and one of the sub-fields is assigned to fast response filter processing. In this case, the two-line synchronous writing and two-line interlace scanning, rather than the general XGA scanning, is performed for the NTSC video signals.

As described above, the XGA liquid crystal display element array only needs 14400 lines/sec. of band for displaying the NTSC video signal because the scanning is performed in the 46080 lines/sec of band. Therefore, the two-line synchronous writing and the two-line interlace scanning is performed on the liquid crystal display element array for the upsampling. Then, the remained band is assigned to the frame rate and can be used for the fast response filter.

The configuration of a liquid crystal display device in this example is basically the same as the display device in FIG. 65. The data generating The data generating circuit 9102 for multiple scans performs sub-field scanning on the video signals having resolution (band) different from that of the liquid crystal display element array 8504, which is sent from the image signal source 8501. (In this case, two scans are performed by the two-line synchronous writing and two-line interlace scanning. One of the scans undergoes the fast response filter). Assuming the above, image data is processed and is transferred to the liquid crystal drive/control circuit 8503. Here, the liquid crystal drive/control circuit 8503 does not know how the received image has been processed and how the liquid crystal display element array should be scanned. Thus, the data generating circuit 8502 for multiple scans attaches, as the header, control information regarding processed data, as shown in FIG. 64, to the image data. Then, it is transferred in the image format as shown in FIG. 16. (The control information in this case includes information that two scans are performed by the two-line synchronous writing and two-line interlace scanning and one scan is used for fast response filter processing). The image data having the control information header transferred from the data generating circuit 8502 for multiple scans is received by the liquid crystal drive/control circuit 8503. Then, the liquid crystal drive/control circuit 8503 receives the control information from the control information header and drives the liquid crystal display element array 8504 in accordance with the control steps (in this case, two scans are performed by the two-line synchronous writing and two-line interlace scanning and one scan is used for fast response filter processing).

By the data generating circuit 8502 for multiple scans attaching, to the image data, information that the number of times of scan is once as usual when images having the same resolution as the resolution of, for example, the personal computer, the liquid crystal drive/control circuit 8503 can easily switch the display frame by frame based on the information. As a result, the resolution of the liquid crystal display element array 8504 is used to the maximum in the display. By adopting the switching display like this, images can be provided to users by using a scanning method suitable for various video formats (multi-formats). Therefore, both of still images and moving images can be displayed with higher image quality on one liquid crystal display (liquid crystal display compliant with multi-contents).

Twenty Fourth Example

FIG. 71 shows scanning and lighting timing for backlighting according to this example. In this example, backlighting flashing control is combined with the display devices in the nineteenth to twenty second examples so as to obtain sharper moving pictures.

FIG. 71 shows a transmissivity response characteristic (general response) of a generally available liquid crystal display and lighting control timing for backlighting for liquid crystal exposing fast responses (fast responsive). In this case, two screen scans are performed in one frame by the two-line synchronous writing and the two-line interlace scanning. The lighting control for backlighting in the case of the general response will be considered by focusing on the n-th and the (n+1)th lines. The nth and the (n+1)th lines in the first scanned screen start to respond at the end of the synchronous writing. In this case, the response completes almost in the beginning of the second screen scanning. Therefore, the backlighting is turned on at this timing. Then, when the n-th and the (n+1)th line of the second scanning black writing screen undergoes the synchronous writing, the backlighting is turned off. Then, the display of the n-th and the (n+1)th lines during the responding process are not recognized because the backlighting is turned off. As a result, the moving images become sharper. However, due to the slow response, the lighting period is not obtained so long. Therefore, the control for maintaining the brightness is performed by increasing the peak brightness. The fast response completes already toward the end of the same screen scanning period because timing is set for the n-th line and the (n+1)th line. Therefore, the backlighting is turned on at this timing. When the second black writing completes to write the n-th and the (n+1)th line, the backlighting is turned off. Therefore, as shown in FIG. 71, the longer lighting period can be obtained because of the fast response and the peak brightness can be reduced. As a result, the inverter driving characteristic can obtain some allowance.

In this device configuration, the lighting control can be obtained by setting the peak brightness so as to maintain the average brightness from the response delay parameters for the liquid crystal by using the backlighting control circuit 8505 in FIG. 65 etc.

Ideally, the response needs to complete at least in ½ frame, that is, within 8 ms. However, if the response completes in the order of 20 ms (general response), the effect of the lighting control can be identified. In other words, the falling edge to black is replaced by the response of the backlighting in combination with the lighting control for the backlighting. Therefore, the black writing through scanning can be supplemented. At the same time, the backlighting is not always lighted on. Therefore, the power consumption can be reduced.

Twenty Fifth Example

Figure 72:
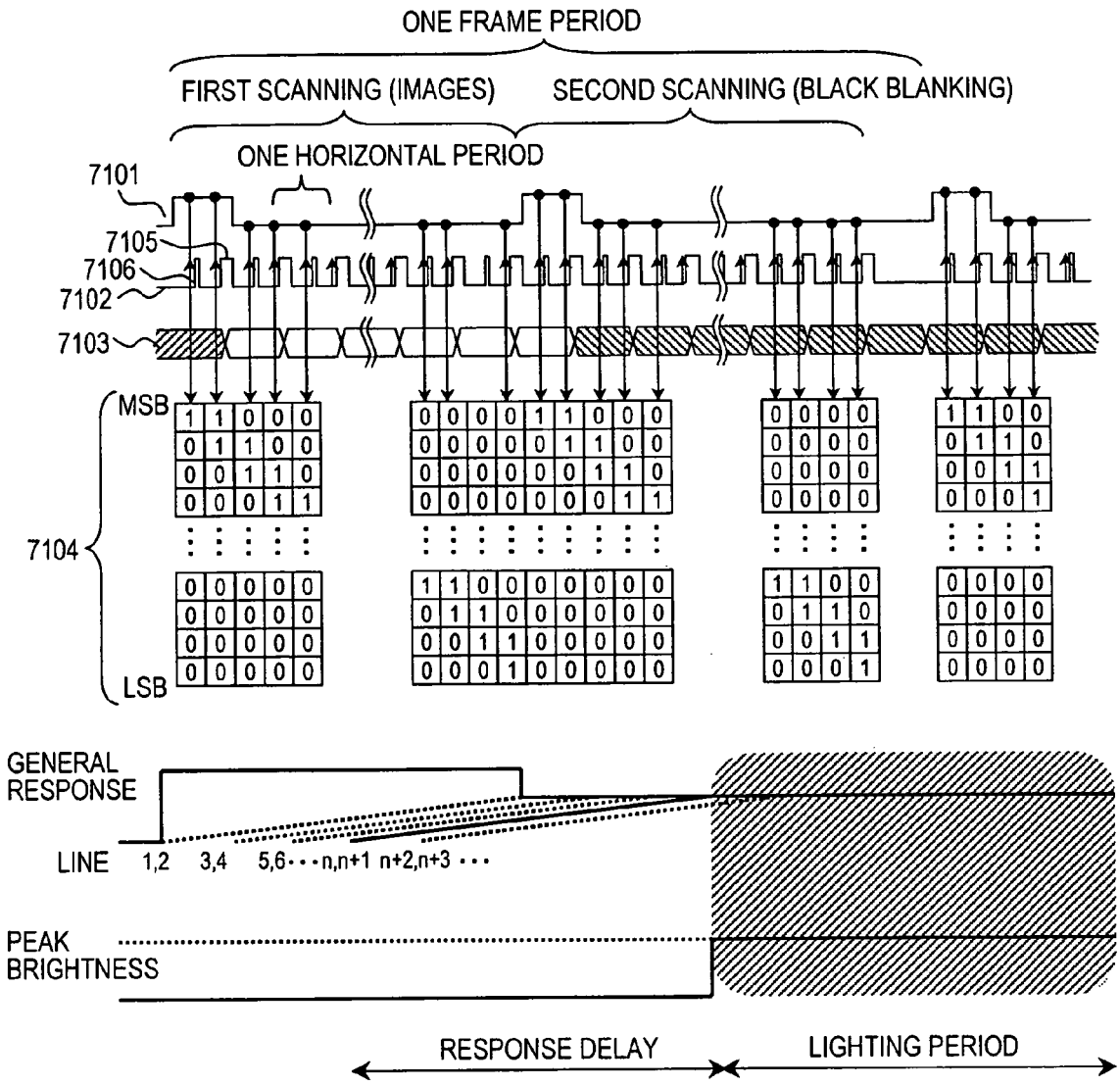
FIG. 72 is an explanatory diagram showing a relationship between sub-field scanning and backlighting blinking control of a combination between the configuration according to the twenty third to twenty eighth examples of the present invention and backlighting blinking control.

FIG. 72 shows scanning and lighting timing for backlighting according to this example. In this example, backlighting lighting control is combined with the device configuration in the twenty third example so as to obtain sharper moving pictures.

FIG. 72 is an explanatory diagram of this example. In this example, one frame period is divided into two sub-fields by the two-line synchronous writing and two-line interlace scanning. Then, a fast response filter is performed on the first sub-field such that the response can complete within ½ frame. Then, the backlighting is shut-off during the transmissivity transition period. By lighting the backlighting at the completion of the response, sharper images can be obtained.

As shown in FIG. 72, when an image is varied from the darker halftone to the brighter halftone, the response delay is about ½ frame period when focusing on the nth and the (n+1)th lines. After scanning the nth and the (n+1)th lines, the backlighting is lighted on after ½ frame period (about 8 ms). Therefore, the image in the nth and the (n+1)th lines become clearer. Because of the longer period of lighting the backlighting, some allowance is provided to the peak brightness. Therefore, it is effective for the application requiring low power consumption.

What is claimed is:

1. A display device comprising:

a display panel having a plurality of display elements which are arranged in a matrix form, a drain driver adapted to supply gradation voltages corresponding to image data to the display elements, a gate driver adapted to scan lines of the display elements for supplying the gradation voltage, and a data generating circuit adapted to divide, in a time direction, image data for one frame into a plurality of pieces of sub-field image data, wherein a total number of the plurality of pieces of the sub-field image data is smaller than a bit number of gradation levels of the image data, wherein:

the display panel includes a display screen, the drain driver is placed on one side of the display panel, and the data generating circuit is adapted to convert a first piece of the sub-field image data among the plurality of pieces of the sub-field image data into bright gradation data which has a higher brightness than that of the image data which has been inputted, and to convert a last piece of the sub-field image data among the plurality of pieces of the sub-field image data into dark gradation data which has a lower brightness than the image data which has been inputted.

2. A display device according to claim 1, wherein the data generating circuit is adapted to convert, by using a high speed response filtering process, the first piece of sub-field image data among the plurality of the sub-field image data into the bright gradation data.

3. A display device according to claim 1, wherein the dark gradation data includes black data.

4. A display device according to claim 1, wherein the data generating circuit maintains a gradation of at least one piece of sub-field image data between the first piece of the sub-field image data and the last piece of the sub-field image data among the divided plurality of pieces of sub-field image data in the manner of the inputted image data.

5. A display device according to claim 4, wherein a frequency of the frame is 60 Hz, and a frequency of each of the sub-field is 180 Hz.

6. A display device according to claim 1, comprising a timing generation circuit adapted to generate clock signals for displaying the plurality of sub-field image data within one frame period.

7. A display device according to claim 1, wherein the display device is a liquid crystal display device.

8. A display device comprising:

a display panel having a plurality of display elements which are arranged in a matrix, a drain driver adapted to supply gradation voltages to the display elements corresponding to the image data;

gate driver adapted to scan lines of the display elements for providing the gradation voltage, and a data generating circuit adapted to divide, in a time direction, image data for one frame into a plurality of pieces of sub-field image data, wherein a total number of the plurality of pieces of the sub-field image data is smaller than a bit number of gradation levels of the image data, wherein:

the display panel includes a display screen, the drain driver is disposed on one side of the display panel, and the display panel displays a last piece of sub-field image data among the plurality of sub-field image data with a gradation brightness lower than that of the inputted image data.

9. A display device according to claim 8, wherein the display panel displays a first piece of sub-field image data among the plurality of sub-field image data with a gradation brightness higher than that of the inputted image data.

10. A display device according to claim 9, further comprising a high response speed filtering process for changing the gradation of the first sub-field image data among the plurality of the sub-field image data into a gradation of higher brightness by using the high response speed filtering process.

11. A display device according to claim 9, further comprising means for increasing current of a back light that illuminates the display device to change a gradation of the first sub-field image data among the plurality of sub-field image data is changed into a brighter gradation.

12. A display device according to claim 8, the dark gradation data includes black data.

13. A display device according to claim 8, comprising a timing generation circuit adapted to generate clock signals for displaying the plurality of pieces of the sub-field image data within one frame period.

14. A display device according to claim 8, wherein the display device is a liquid crystal display device.

* * * * *